US010163539B2

(12) United States Patent
Oishi et al.

(10) Patent No.: US 10,163,539 B2
(45) **Date of Patent: *Dec. 25, 2018**

(54) HIGH STRENGTH AND HIGH CONDUCTIVITY COPPER ALLOY ROD OR WIRE

(71) Applicants: Mitsubishi Shindoh Co., Ltd., Tokyo (JP); Mitsubishi Materials Corporation, Tokyo (JP)

(72) Inventors: Keiichiro Oishi, Tokyo (JP); Kazumasa Hori, Tokyo (JP)

(73) Assignees: Mitsubishi Shindoh Co., Ltd., Tokyo (JP); Mitsubishi Materials Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/297,633

(22) Filed: Oct. 19, 2016

(65) Prior Publication Data

US 2017/0103825 A1 Apr. 13, 2017

Related U.S. Application Data

(62) Division of application No. 12/919,206, filed as application No. PCT/JP2009/053220 on Feb. 23, 2009, now Pat. No. 9,512,506.

(30) Foreign Application Priority Data

Feb. 26, 2008 (JP) ..... 2008-044353

(51) Int. Cl.
*C22C 9/02* (2006.01)
*C22C 9/00* (2006.01)
(Continued)

(52) U.S. Cl.
CPC ..... *H01B 1/026* (2013.01); *C22C 9/02* (2013.01); *C22C 9/06* (2013.01); *C22F 1/08* (2013.01);
(Continued)

(58) Field of Classification Search
CPC . F28F 21/085; C22C 9/00; C22C 9/02; C22C 9/04; C22C 9/06; C22F 1/08;
(Continued)

(56) References Cited

U.S. PATENT DOCUMENTS 2,074,713 A 3/1937 Tross
4,073,667 A 2/1978 Caron et al.
(Continued)

FOREIGN PATENT DOCUMENTS

CN 1546701 A 11/2004
CN 1693502 A 11/2005
(Continued)

OTHER PUBLICATIONS

Office Action issued in corresponding Indian Patent Application 3469/DELNP/2010 dated Dec. 20, 2016.
(Continued)

*Primary Examiner* — Keith Walker
*Assistant Examiner* — John A Hevey
(74) *Attorney, Agent, or Firm* — Griffin and Szipl PC

(57) ABSTRACT

A high strength and high conductivity copper rod or wire includes Co of 0.12 to 0.32 mass %, P of 0.042 to 0.095 mass %, Sn of 0.005 to 0.70 mass %, and O of 0.00005 to 0.0050 mass %. A relationship of $3.0 \leq ([Co]-0.007)/([P]-0.008) \leq 6.2$ is satisfied between a content [Co] mass % of Co and a content [P] mass % of P. The remainder includes Cu and inevitable impurities, and the rod or wire is produced by a process including a continuous casting and rolling process. Strength and conductivity of the high strength and high
(Continued)

conductivity copper rod or wire are improved by uniform precipitation of a compound of Co and P and by solid solution of Sn. The high strength and high conductivity copper rod or wire is produced by the continuous casting and rolling process, and thus production costs are reduced.

16 Claims, 8 Drawing Sheets

(51) Int. Cl.

| | |
|---|---|
| ***C22C 9/06*** | (2006.01) |
| ***C22F 1/08*** | (2006.01) |
| ***H01B 1/02*** | (2006.01) |
| ***H01B 7/00*** | (2006.01) |
| ***H01B 13/00*** | (2006.01) |
| ***H01B 13/012*** | (2006.01) |

(52) U.S. Cl.
CPC ..... *H01B 7/0045* (2013.01); *H01B 13/0016* (2013.01); *H01B 13/01209* (2013.01); *Y10T 428/2913* (2015.01)

(58) Field of Classification Search
CPC ..... B21C 23/002; B21C 23/085; B21C 1/003; Y10T 428/12
See application file for complete search history.

(56) References Cited

U.S. PATENT DOCUMENTS

| | | | | |
|---|---|---|---|---|
| 4,260,432 | A | 4/1981 | Plewes | |
| 4,388,270 | A | 6/1983 | Stavish et al. | |
| 4,427,627 | A | 1/1984 | Guerlet et al. | |
| 4,666,667 | A | 5/1987 | Kamio et al. | |
| 5,004,498 | A | 4/1991 | Shimamura et al. | |
| 5,322,575 | A | 6/1994 | Endo et al. | |
| 5,814,168 | A | 9/1998 | Hatakeyama et al. | |
| 6,132,529 | A | 10/2000 | Hatakeyama et al. | |
| 6,254,702 | B1 | 7/2001 | Hana et al. | |
| 7,608,157 | B2 | 10/2009 | Oishi | |
| 7,928,541 | B2 | 4/2011 | Miwa et al. | |
| 8,986,471 | B2 | 3/2015 | Oishi | |
| 9,163,300 | B2 * | 10/2015 | Oishi | C22C 9/02 |
| 9,455,058 | B2 | 9/2016 | Oishi | |
| 9,512,506 | B2 * | 12/2016 | Oishi | C22C 9/02 |
| 2006/0016528 | A1 | 1/2006 | Hatakeyama | |
| 2006/0260721 | A1 | 11/2006 | Oishi | |
| 2007/0051442 | A1 | 3/2007 | Yamamoto et al. | |
| 2007/0221396 | A1 * | 9/2007 | Izumida | C21D 8/06 174/128.1 |
| 2009/0014102 | A1 | 1/2009 | Hatakeyama | |
| 2010/0008817 | A1 | 1/2010 | Ando | |
| 2010/0047112 | A1 | 2/2010 | Fugono et al. | |
| 2010/0206513 | A1 | 8/2010 | Hattori et al. | |
| 2010/0297464 | A1 | 11/2010 | Oishi | |
| 2011/0056596 | A1 | 3/2011 | Oishi | |
| 2011/0200479 | A1 | 8/2011 | Mihara et al. | |
| 2011/0265916 | A1 * | 11/2011 | Oishi | C22C 9/02 148/501 |
| 2015/0198391 | A1 | 7/2015 | Oishi | |

FOREIGN PATENT DOCUMENTS

| | | | |
|---|---|---|---|
| EP | 1630240 | A1 | 3/2006 |
| JP | 60-245753 | A | 12/1985 |
| JP | 60-245754 | A | 12/1985 |
| JP | 6365039 | A | 3/1988 |
| JP | 01-108322 | A | 4/1989 |
| JP | 04-272148 | A | 9/1992 |
| JP | 36-094390 | A | 4/1994 |
| JP | 06-053901 | | 7/1994 |
| JP | 8-120368 | A | 5/1996 |
| JP | 10-130754 | A | 5/1998 |
| JP | 10-168532 | | 6/1998 |
| JP | 11-097609 | A | 4/1999 |
| JP | 11-256255 | | 9/1999 |
| JP | 2001-214226 | A | 8/2001 |
| JP | 2001-316742 | | 11/2001 |
| JP | 2003-268467 | | 9/2003 |
| JP | 2004-137551 | | 5/2004 |
| JP | 2004-292917 | A | 10/2004 |
| JP | 2007-031795 | A | 2/2007 |
| JP | 2007-100111 | A | 4/2007 |
| TW | 200417616 | | 9/2004 |
| TW | 200706660 | | 2/2007 |
| WO | 2004/079026 | A1 | 9/2004 |
| WO | 2004/079206 | A1 | 9/2004 |
| WO | 2007/139213 | A1 | 12/2007 |
| WO | 2008/041584 | A1 | 4/2008 |
| WO | 2008/099892 | A1 | 8/2008 |
| WO | 2009/107586 | A1 | 9/2009 |

OTHER PUBLICATIONS

JP 2001-316742, Sudo et al., Published Nov. 2001. (machine translation).
JP 2001-214226, Nagata et al., Published Aug. 2001. (machine translation).
Office Action issued in co-pending related U.S. Appl. No. 13/144,034, dated Apr. 20, 2017.
International Search Report issued in corresponding application No. PCT/JP2009/053220, completed May 19, 2009 and dated Jun. 2, 2009.
Office Action issued in co-pending related U.S. Appl. No. 12/555,990 dated Apr. 14, 2011.
Data Sheet No. A 6 Cu-DHP, Consel International Pour Le Developpement Du Cuivre, pp. 1, 2 and 4 (1968), submitted in a related application as Exhibit B.
Copper Parts Data Book, pp. 88 and 94 (1997), submitted in a related application as Exhibit C.
Office Action issued in related Canadian application 2,706,199 dated Dec. 2, 2011.
International Search Report issued in related application PCT/JP2009/071606, completed Mar. 19, 2010 and dated Apr. 6, 2010.
Table 1, compositions and elemental relationships of sample alloy Nos. 5-11, and Table 2, experimental results of alloy Nos. 55-61, submitted in related U.S. Appl. No. 12/555,990 as Exhibit A.
International Search Report issued in related application PCT/JP2008/070410, completed Jan. 23, 2009 and dated Feb. 10, 2009.
Restriction Election issued in co-pending related U.S. Appl. No. 13/144,034 dated Apr. 18, 2012.
International Search Report issued in related application PCT/JP2009/071599, completed Mar. 19, 2010 and dated Apr. 6, 2010.
Espacenet English Abstract of JP 10-130754 (filed as Exhibit A1 in related U.S. Appl. No. 12/555,990), modified 2011.
Definition of Tensile Strength, at http://metals.about.com/library/bldef-Tensile-Strength.htm (2002), (filed as Exhibit A2 in related U.S. Appl. No. 12/555,990).
"Definition of Hardness," at http://metals.about.com/library/bldef-Hardness.htm (2002), (filed as Exhibit A3 in related U.S. Appl. No. 12/555,990).
"Definition of Proof Stress," at http://metals.about.com/library/bldef-Proof-Stress.htm (2002), (filed as Exhibit A4 in related U.S. Appl. No. 12/555,990).
Pierre Leroux, Breakthrough Indentation Yield Strength Testing (Nanovea 2011), (filed as Exhibit A5 in related U.S. Appl. No. 12/555,990).
Copper and Copper Alloys of the ASM Specialty Handbook®, p. 454 (filed as Exhibit A6 in related U.S. Appl. No. 12/555,990).
Copper and Copper Alloys of the ASM Specialty Handbook®, pp. 3 and 4 (filed as Exhibit A7 in related U.S. Appl. No. 12/555,990).
Standards Handbook: Part 2—Alloy Data, Wrought Copper and Copper Alloy Mill Products 34 and 38 (Copper Development Association, Inc. 1985), (filed as Exhibit A8 in related U.S. Appl. No. 12/555,990).

(56) References Cited

OTHER PUBLICATIONS

Yield Strength—Strength(Mechanics) of Materials, at http://www.engineersedge.com/material_science/yield_strength.htm (downloaded Apr. 18, 2012), two pages.
J.R. Davies (ed.), ASM Specialty Handbook Copper and Copper Alloys 8-9 (ASM International), filed as Exhibit A in related U.S. Appl. No. 13/514,680.
E. Paul Degarmo et al., Materials and Processes in Manufacturing 402-404, 432-434, 989-998 (John Wiley & Sons, Inc. 2003).
International Search Report issued in corresponding application No. PCT/JP2009/053216, completed May 19, 2009 and dated May 26, 2009.
J.R. Davies (ed.), ASM Specialty Handbook Copper and Copper Alloys 243-247 (ASM International 2001), filed as Exhibit D in related application.
Office Action issued in related Taiwanese application 097143579 dated Oct. 24, 2012.
E. Paul Degarmo et al., Materials and Processes in Manufacturing 383-384 (9th ed. 2003), filed in a related application as Exhibit A1.
Copper Parts Data Book, pp. 88 and 94 (1997).
Copper and Copper Alloys, ASM Specialty Handbook, pp. 3-4, and 454 (2001).
1994 Annual Book of ASTM Standards, vol. 02.01, 480-486 and 514-521 (1994), filed in a related application Exhibit A1.
Office Action issued in co-pending related U.S. Appl. No. 13/144,034 dated Apr. 26, 2013.
Taiwanese office action issued in related matter 099100411 dated Oct. 22, 2013.
Fundamentals of Rockwell Hardness Testing, www.wilsonsinstrumenets.com, 2004, pp. 1-15.
Office Action issued in co-pending related U.S. Appl. No. 12/555,990 dated Mar. 27, 2014.
Restriction/Election issued in co-pending U.S. Appl. No. 13/144,057 dated Jun. 5, 2014.
Office Action issued in co-pending U.S. Appl. No. 12/808,564 dated Jun. 5, 2014.
Office Action issued in co-pending U.S. Appl. No. 13/144,057 dated Sep. 8, 2014.
Office Action issued in co-pending related U.S. Appl. No. 13/144,057 dated Feb. 25, 2015.
ASM Specialty Handbook, Copper and Copper Alloys, 2001, p. 521.
Office Action issued in related U.S. Appl. No. 14/596,630 dated Sep. 22, 2017.
Office Action issued in co-pending Indian application 8945/DELNP/2010 dated Aug. 24, 2017.

* cited by examiner

[FIG. 1]
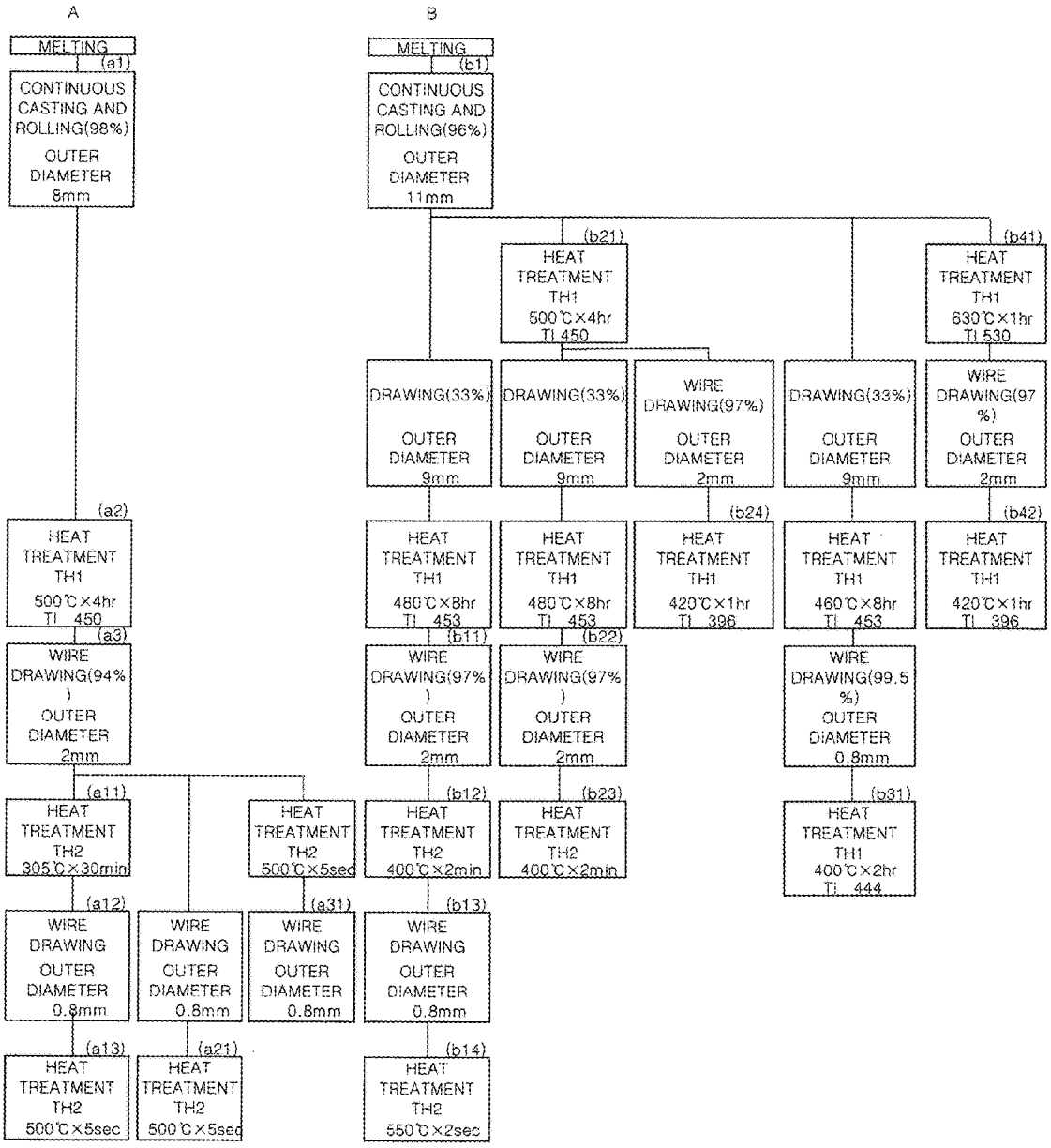

[FIG. 2]
C
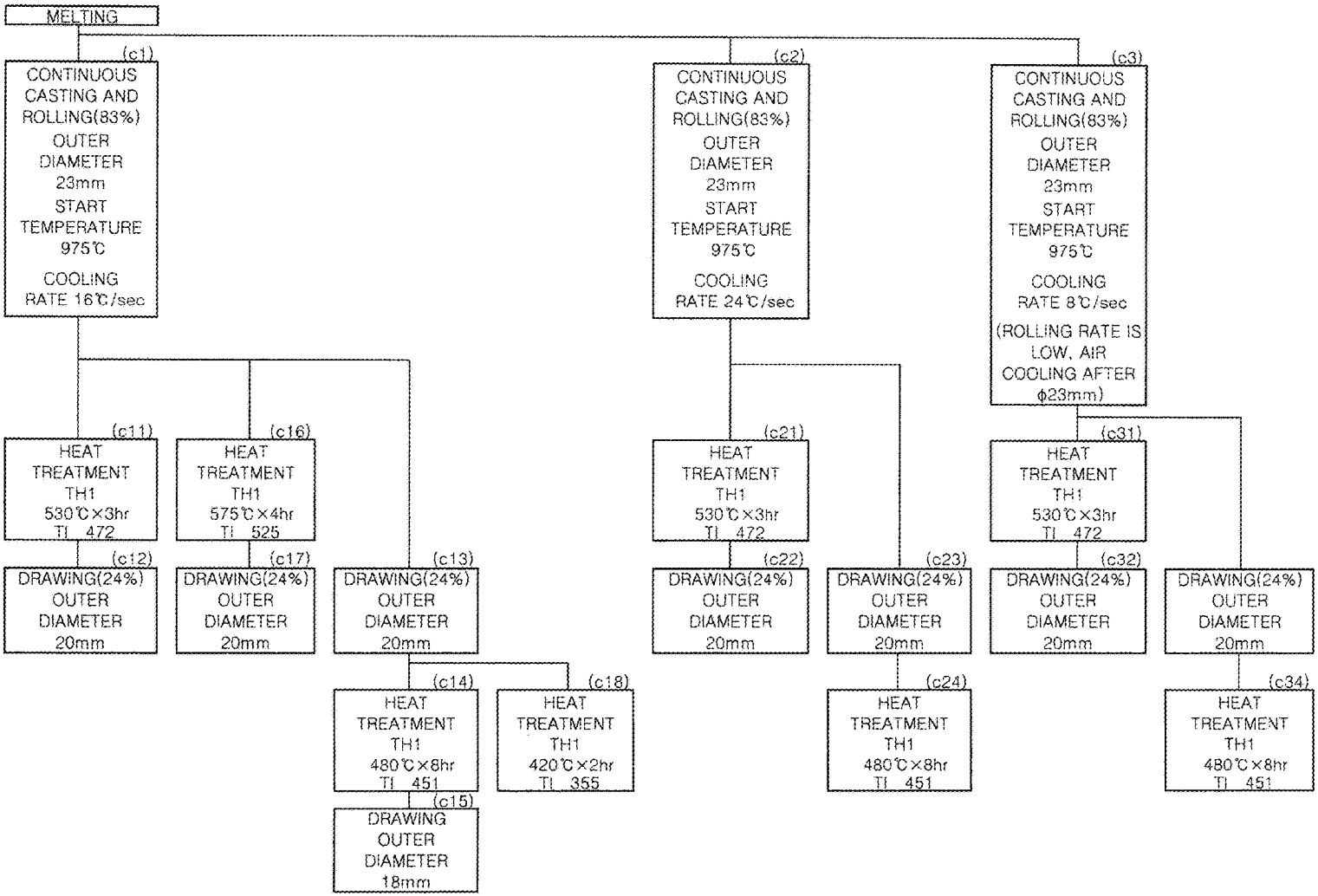

[FIG. 3]
C
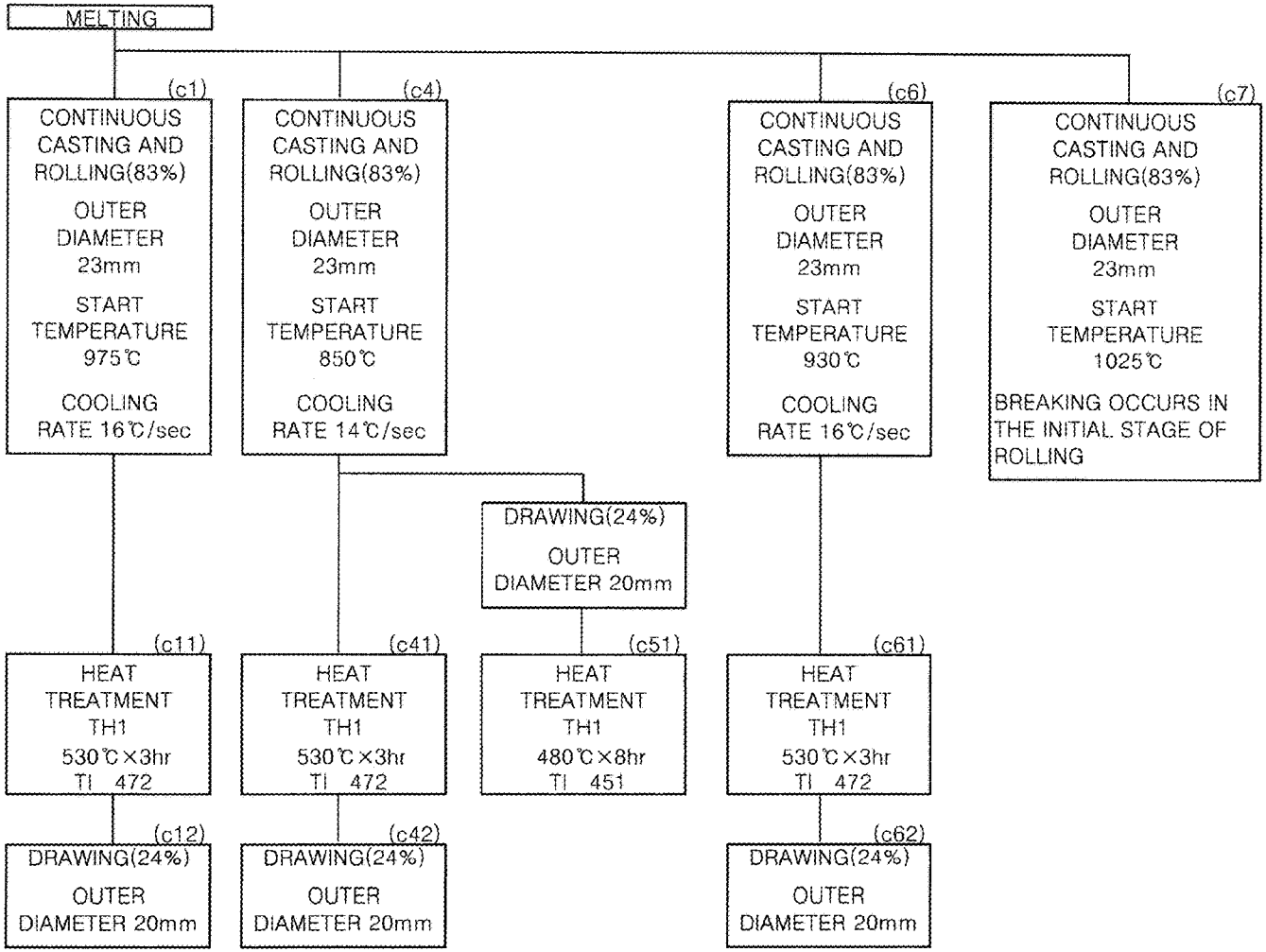

[FIG. 4]
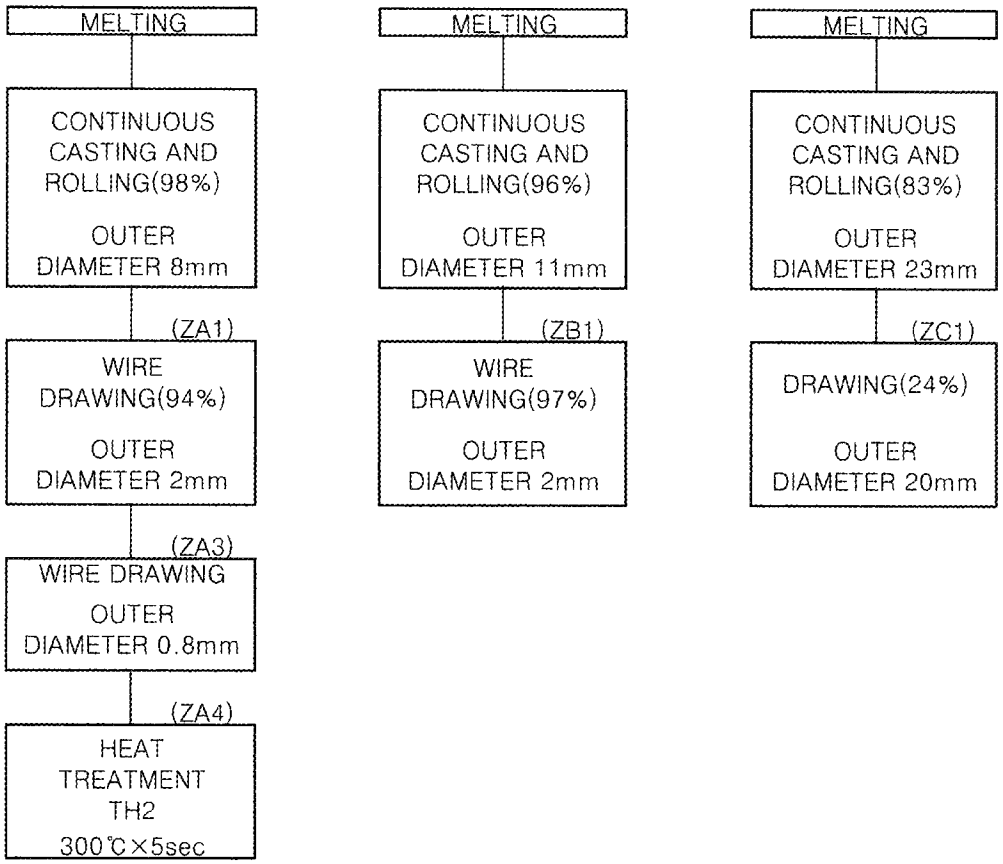

[FIG. 5]
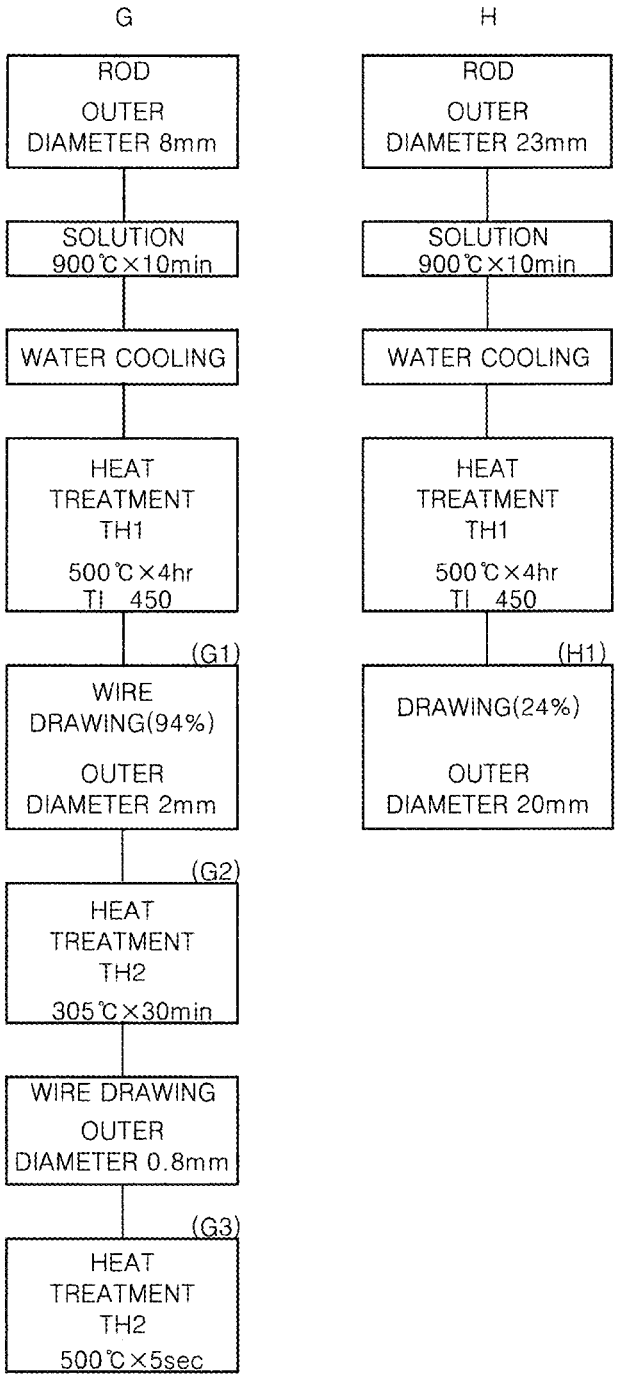

[FIG. 6]
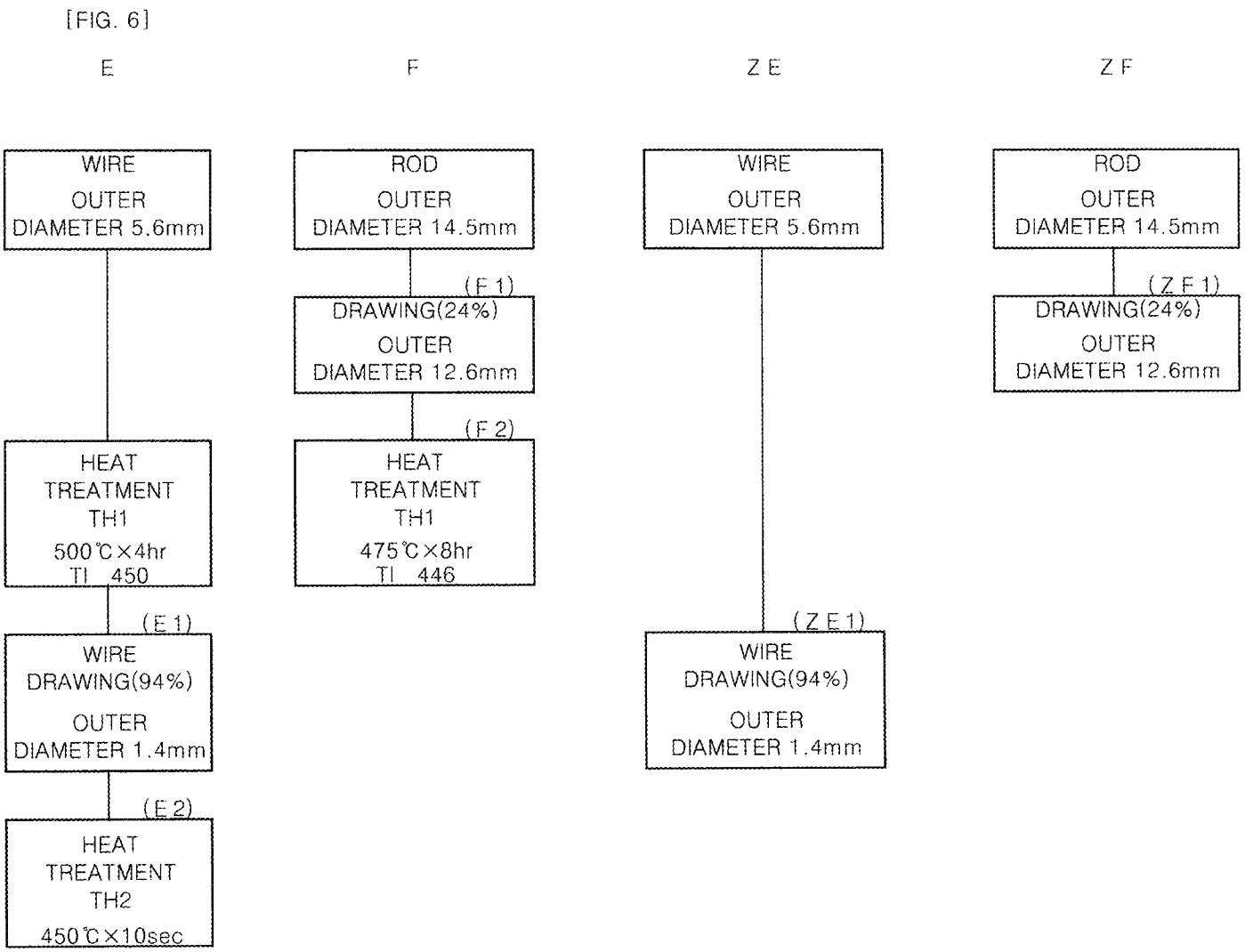

[FIG. 7]
(a)
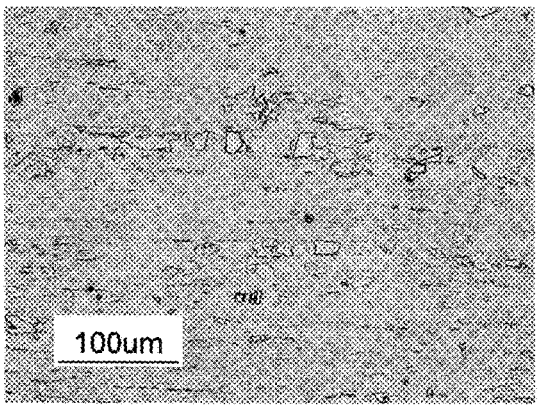
Alloy No.1 Process a3 diaφ 8mm
6/7R from Center
(b)
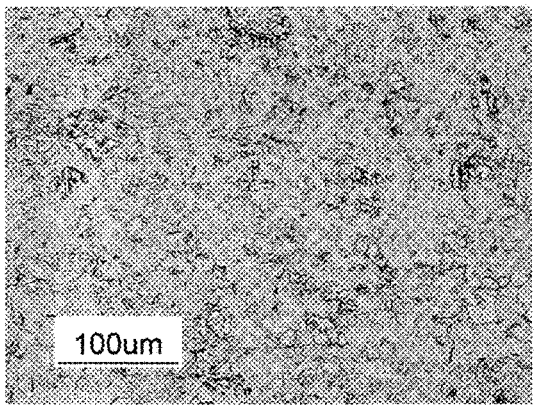
Alloy No.1 Process a3 diaφ 8mm
1/2R from Center
(c)
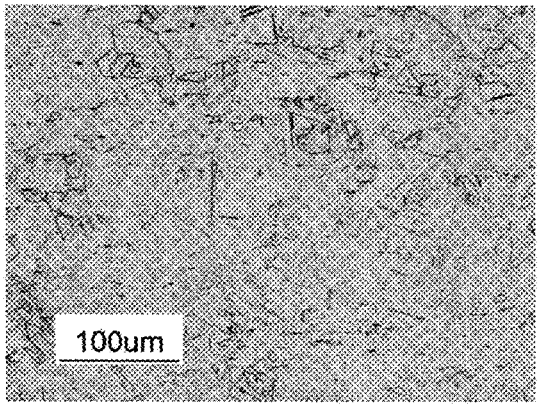
C1100 Process ZA1 diaφ 8mm
6/7R from Center
(d)
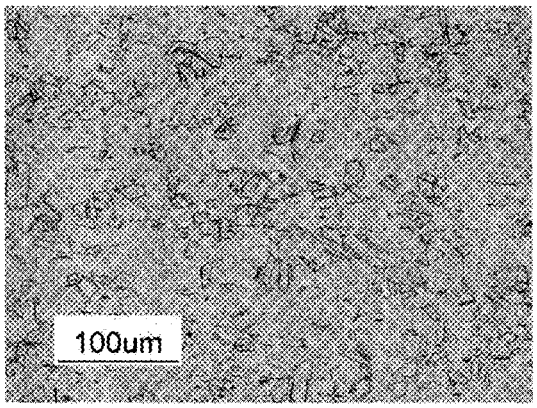
C1100 Process ZA1 diaφ 8mm
1/2R from Center

[FIG. 8]
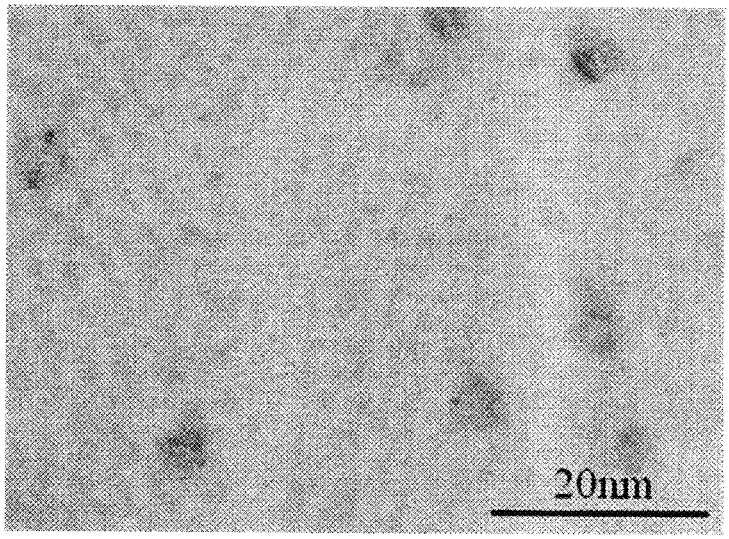
Alloy No.2 Process a2 Transmission Electron Microscope Image

HIGH STRENGTH AND HIGH CONDUCTIVITY COPPER ALLOY ROD OR WIRE

This is a divisional application of the National Phase Application in the U.S. application Ser. No. 12/919,206 filed Dec. 21, 2010, which claims priority on International Patent Application No. PCT/JP2009/053220 filed Feb. 23, 2009, which claims priority on Japanese Patent Application No. JP2008-044353, filed Feb. 26, 2008. The entire disclosures of the above patent applications are hereby incorporated by reference.

TECHNICAL FIELD

The present invention relates to a high strength and high conductivity copper rod or wire produced by a process including a continuous casting and rolling process.

BACKGROUND ART

Copper rods and wires have been used as electrical conductors in various fields. For example, copper rods and wires have been used in the wire harnesses of cars, and the weights of the cars need to be reduced to improve fuel efficiency to counter global warming. However, the weights of the wire harnesses used tend to increase along with developments in car information, electronics, and hybridization. Since copper is expensive metal, the car manufacturing industry wants to reduce the amount of copper to be used in view of the cost. For this reason, when using a copper wire having high strength, high conductivity, bending resistance, and excellent ductility for a wire harness, it is possible to reduce the amount of copper used and thus it is possible to reduce the size and weight of cars. As described above, the invention of a high strength and high conductivity rod or wire has been made in response to contemporary needs.

There are several kinds of wire harnesses, such as a power system and a signal system in which very little current flows. For the former, conductivity close to that of pure copper is required as the first priority. For the latter, high strength is especially required. Accordingly, a copper wire balanced in strength and conductivity is necessary depending on its purpose. Power distribution lines and the like for robots and airplanes are required to have high strength, high conductivity, and bending resistance. In such power distribution lines, there are many cases where copper wire is used as a stranded wire including several or several tens of thin wires in a structure in order to further improve bending resistance. In addition, copper rods used for welding tips are required to have high strength and high conductivity. In this specification, a wire means a product having a diameter or an opposite side distance of less than 6 mm. Even when the wire is cut in a rod shape, the cut wire is called a wire. The term rod refers to a product having a diameter or an opposite side distance of 6 mm or more. Even when the rod is formed in a coil shape, the coil-shaped rod is called a rod. Generally, material having a large outer diameter is cut in a rod shape, and thin material is formed into a coil-shaped product. However, the material can be referred to both as a wire and a rod when a diameter or an opposite side distance is 4 to 16 mm. Accordingly, the aforesaid definition was made herein. A collective term for a rod and a wire is also defined as a rod wire.

A high strength and high conductivity copper rod or wire (hereinafter, referred to as a high performance copper rod or wire) according to the invention requires the following characteristics according to applications:

A wire has become thinner on the male side of a connector cable and a bus bar along with any reduction in connector size, and thus strength and conductivity capable of withstanding the putting-in and taking-out of the connector is required. Since temperature rises while in use, a stress relief resistance is also necessary.

For a wire used as wire cutting (to discharge), high conductivity, high strength, wear resistance, high-temperature strength, and durability are required.

For a trolley line, high conductivity and high strength are required, and durability, wear resistance, and high-temperature strength are also required during use. Generally, such a trolley line is called a trolley "wire". However, since there are many trolley lines having a diameter of 20 mm, the trolley lines in fact fall within the scope of "rod" in this specification.

For a welding tip, high conductivity, high strength, wear resistance, high-temperature strength, and durability are required.

Electrical components, for example, bus bars, rotor bars, terminals, electrodes, relays, power relays, connectors, connection terminals, fixers, and the like, are required to have high conductivity and high strength. In addition, mechanical components such as the nuts and fittings of faucets are produced from rods by cutting, pressing, or forging, and thus are required to have high conductivity, high strength, and wear resistance. There are many cases where, from the viewpoint of bonding part reliability, brazing is used as a bonding means for faucets, electrical components such as rotor bars used in motors, or power relays, and thus heat resistance for keeping high strength even after high-temperature heating at, for example, 700° C. is necessary. Heat resistance in this specification means that recrystallization does not occur easily even by heating at a temperature of 500° C. or higher and that strength after heating is excellent.

For mechanical components or faucet fittings, a pressing process and a forging process are performed followed by a downstream process includes rolling and partial cutting. Particularly, formability in cold temperatures, ease of forming, high strength, and wear resistance are necessary, and it is required that there is no stress corrosion cracking.

A continuous casting and rolling method for producing a copper rod or wire provides high productivity and low costs. Generally, trapezoid, polygonal, oval, and cylindrical casting rods having a side of several tens millimeters (sectional area is 1000 to 9000 $mm^2$, generally about 4000 $mm^2$) obtained by melting and casting are continuously hot rolled (processing rate of 70 to 99.5%) by 8 to 20 rolling rollers after casting, thereby obtaining rods having circular, oval, polygonal shapes, and the like in the sectional view with a sectional area of 35 to 700 $mm^2$ (generally 100 $mm^2$).

In addition, these rods are drawn out by a drawing process to become thinner and are made into wire by a wire drawing process (the general term for the drawing process for drawing out the rods and the wire drawing process for drawing out the wires is referred to as the drawing/wire drawing process). Bus bars, polygonal rods, or rods having complicated shapes in the sectional view are made from the rods by a kind of extruding (generally referred to as conforming). Basically, in the continuous casting and rolling method, deformation resistance is low in the high temperature range encountered at the time of hot rolling, and the method is used as a method for producing materials for pure copper cables with excellent hot deformability immediately after solidification. However, when alloy elements are added to pure copper, hot deformation resistance becomes high and thus deformability becomes low. Particularly, the addition of elements increases the solidification temperature range, and the solidus temperature becomes low. Accordingly, copper alloy is unsuitable for the continuous casting and rolling process which requires excellent deformability immediately after solidification. That is, in order to make a copper alloy rod or wire by the continuous casting and rolling process, it is necessary that hot deformation resistance should be low and hot deformability be excellent immediately after solidification.

A copper rod or wire, which contains 0.15 to 0.8 mass % of Sn and In in total with the remainder including Cu and inevitable impurities, has been known (e.g., Japanese Patent Application Laid-Open No. 2004-137551). However, the strength of such a copper rod or wire is insufficient. In addition, a continuous casting and rolling process is not performed, but a casting process and a rolling process are performed separately, resulting in high costs.

DISCLOSURE OF THE INVENTION

The present invention has been made to solve the above-described problems, and an object of the invention is to provide a low-cost, high-strength and high-conductivity copper rod or wire having high strength and high conductivity.

DISCLOSURE OF THE INVENTION

The present invention has been made to solve the above-described problems, and an object of the invention is to provide a low-cost, high-strength and high-conductivity copper rod or wire having high strength and high conductivity.

To achieve the above-described object, according to the first aspect of the invention, there is provided a high strength and high conductivity copper rod or wire produced by a process including a continuous casting and rolling process, including: Co of 0.12 to 0.32 mass %; P of 0.042 to 0.095 mass %; Sn of 0.005 to 0.70 mass %; and O of 0.00005 to 0.0050 mass %, wherein a relationship of $3.0 \leq ([Co]-0.007)/([P]-0.008) \leq 6.2$ is satisfied between a content [Co] mass % of Co and a content [P] mass % of P, and the remainder includes Cu and inevitable impurities.

According to the invention, strength and conductivity of the high strength and high conductivity copper rod or wire are improved by uniformly precipitating a compound of Co and P and by means of a solid solution of Sn. In addition, the cost thereof is reduced since it is produced by a continuous casting and rolling process.

According to a second aspect of the invention, there is provided a high strength and high conductivity copper rod or wire produced by a process including a continuous casting and rolling process, including: Co of 0.12 to 0.32 mass %; P of 0.042 to 0.095 mass %; Sn of 0.005 to 0.70 mass %; O of 0.00005 to 0.0050 mass %; and at least any one of Ni of 0.01 to 0.15 mass % and Fe of 0.005 to 0.07 mass %, wherein a relationship of $3.0 \leq ([Co]+0.85\times[Ni]+0.75\times[Fe]-0.007)/([P]-0.008) \leq 6.2$ and a relationship of $0.015 \leq 1.5\times[Ni]+3\times[Fe] \leq [Co]$ are satisfied among a content [Co] mass % of Co, a content [Ni] mass % of Ni, a content [Fe] mass % of Fe, and a content [P] mass % of P, and the remainder includes Cu and inevitable impurities. With such a configuration, precipitates of Co, P, and the like become fine by Ni and Fe, thereby improving strength and heat resistance of the high strength and high conductivity copper rod or wire.

In the high strength and high conductivity copper rod or wire, it is preferable to further include at least any one of Zn of 0.002 to 0.5 mass %, Mg of 0.002 to 0.25 mass %, Ag of 0.002 to 0.25 mass %, and Zr of 0.001 to 0.1 mass %. With such a configuration, S mixed in the course of recycling Cu material is made harmless by Zn, Mg, Ag, and Zr, intermediate temperature embrittlement is prevented, and the alloy is further strengthened, thereby improving the ductility and strength of the high strength and high conductivity copper rod or wire.

In the high strength and high conductivity copper rod or wire, it is preferable that when a total hot processing rate in the continuous casting and rolling process is 75% or higher and lower than 95%, a non-recrystallization ratio of a metal structure at completion of the continuous casting and rolling process is 1 to 60% and an average grain size of a recrystallized part is 4 to 40 μm, and that when the hot processing rate is 95% or higher, a non-recrystallization ratio of a metal structure at completion of the continuous casting and rolling process is 10 to 80% and an average grain size of a recrystallized part is 2.5 to 25 μm. With such a configuration, there is a non-recrystallized structure at the continuous casting and rolling material stage, and a recrystallized grain diameter size is small, thereby improving the strength of the high strength and high conductivity copper rod or wire.

In the high strength and high conductivity copper rod or wire, it is preferable that the rolling start temperature in the continuous casting and rolling process is 860 to 1000° C., the total hot processing rate is 75% or higher, and the average cooling rate in a temperature range of 850 to 400° C. is 10° C./second or higher. With such a configuration, the rolling process is started at an appropriate high temperature, and the cooling process is performed at an appropriate cooling rate. Accordingly, it is possible to perform the rolling process with rolling equipment with lower power to produce the final wire, and thus most of the Co, P, and the like become solid solution state. Since most of Co, P, and the like become solid solution state, fine precipitates are uniformly dispersed by a subsequent heat treatment, strength and heat resistance become high, and conductivity is also improved.

In the high strength and high conductivity copper rod or wire, it is preferable that a cold drawing/wire drawing process is performed after the continuous casting and rolling process, a heat treatment at 350 to 620° C. for 0.5 to 16 hours is performed before, after, or during the cold drawing/wire drawing process, substantially circular or substantially oval fine precipitates are uniformly dispersed, and the average grain diameter of the precipitates is 2 to 20 nm, or 90% or more of all precipitates have a size of 30 nm or less. With such a configuration, since fine precipitates are uniformly dispersed, strength and heat resistance are high and conductivity is good.

In the high strength and high conductivity copper rod or wire, it is preferable that a heat treatment at 200 to 700° C. for 0.001 seconds to 180 minutes is performed during or after the cold wire drawing process, and bending resistance is excellent. With such a configuration, since bending resistance is satisfactory, wire reliability becomes high. In this specification, good bending resistance means that, for example, bending can be performed without trouble until the number of repetitive bending times reaches 15 or more in the case of an outer diameter of 2 mm, and the number of repetitive bending times reaches 20 or more in the case of an outer diameter of 0.8 mm.

In the high strength and high conductivity copper rod or wire, it is preferable that the wire has an outer diameter of 3 mm or less, and bending resistance is excellent. Since bending resistance is good, the high strength and high conductivity copper rod or wire can be used for an application involving repetitive bending.

In the high strength and high conductivity copper rod or wire, it is preferable that the wire has an outer diameter of 3 mm or less, conductivity is 45 (% IACS) or higher, a value of ($R^{1/2}$×S) is 4300 or more, where R (% IACS) is conductivity and S ($N/mm^2$) is tensile strength, and bending resistance is excellent. With such a configuration, since the value of ($R^{1/2}$×S) is 4300 or more and bending resistance is excellent, the high strength and high conductivity copper rod or wire can be used for applications in which conductivity and strength are required. In addition, it is possible to reduce the costs by thinning the outer diameter.

In the high strength and high conductivity copper rod or wire, it is preferable that the rod or wire is used for a wire harness. Since the strength, bending resistance, and the like of the high strength and high conductivity copper rod or wire are good, the reliability of wire harness increases. In addition, it is possible to reduce the costs by thinning the outer diameter.

In the high strength and high conductivity copper rod or wire, it is preferable that conductivity is 45 (% IACS) or higher, elongation is 5% or higher, and a value of ($R^{1/2}$×S×(100+L)/100) is 4200 or more, where R (% IACS) is conductivity, S ($N/mm^2$) is tensile strength, and L (%) is elongation. With such a configuration, the high strength and high conductivity copper rod or wire can be used for applications in which conductivity, elongation, and strength are required. In addition, it is possible to reduce the costs by thinning the outer diameter.

In the high strength and high conductivity copper rod or wire, it is preferable that the rod or wire has high-temperature strength in which tensile strength at 400° C. is 180 ($N/mm^2$) or higher. With such a configuration, high-temperature strength is high, and thus it is possible to use the rod or wire at a high temperature. In addition, it is possible to reduce the costs by thinning the outer diameter.

In the high strength and high conductivity copper rod or wire, it is preferable that the rod or wire is used for cold forging or pressing. Since fine precipitates are uniformly dispersed, the strength of cold-forged products or pressed products is improved. In addition, it is possible to easily perform a cold forging process or a press forming process even in processing equipment with low power, and strength and conductivity are improved by a heat treatment after processing. Accordingly, equipment with high power is not necessary, and thus the costs are reduced.

In the high strength and high conductivity copper rod or wire, it is preferable that Vickers hardness (HV) after heating at 700° C. for 30 seconds is 90 or higher, conductivity is 45 (% IACS) or higher, and an average grain diameter of precipitates in a metal structure after the heating is 2 to 20 nm, 90% or more of all precipitates have a size of 30 nm or less, or a recrystallization ratio of the metal structure is 45% or lower. With such a configuration, heat resistance is excellent, and thus the high strength and high conductivity copper rod or wire can be processed and used in an environment exposed to a high temperature. In addition, since there is little decrease in strength after high-temperature heating for a short time, the diameter of the rod or wire is made thinner and the pressed and cold-forged products, or the rod or wire, are made smaller, thereby reducing the costs.

BRIEF DESCRIPTION OF THE DRAWINGS

FIG. 1 is a flowchart of processes A and B for producing a high performance copper rod or wire according to an embodiment of the invention.

FIG. 2 is a flowchart of a part of process C for producing the high performance copper rod or wire.

FIG. 3 is a flowchart of a part of process C for producing the high performance copper rod or wire.

FIG. 4 is a flowchart of production processes ZA, ZB, and ZC in the conventional C1100 rod or wire.

FIG. 5 is a flowchart of production processes G and H in the conventional high performance copper rod or wire.

FIG. 6 is a flowchart of production processes E, F, ZE, and ZF in a laboratory test of the high performance copper rod or wire according to the embodiment.

FIG. 7(*a*) is a metal structure photograph of the high performance copper rod or wire in the vicinity (6/7R from the center) of the surface after a continuous casting and rolling process; FIG. 7(*b*) is a metal structure photograph of the high performance copper rod or wire at a position of 1/2R from the center after the continuous casting and rolling process; FIG. 7(*c*) is a metal structure photograph of the known C1100 in the vicinity (6/7R from the center) of the surface after the continuous casting and rolling process; and FIG. 7(*d*) is a metal structure photograph of C1100 at a position of 1/2R from the center after the continuous casting and rolling process.

FIG. 8 is a transmission electron microscope photograph in a process a2 of the high performance copper rod or wire.

BEST MODE FOR CARRYING OUT THE INVENTION

A high performance copper rod or wire according to an embodiment of the invention will be described. In the invention, according to the first to fourth claims, a first invention alloy, a second invention alloy, and a third invention alloy having alloy compositions in high performance copper rod or wire are proposed. In the alloy compositions described in the specification, a symbol of an element in parenthesis such as [Co] represents a content of the element. Invention alloy is the general term for the first to third invention alloys.

The first invention alloy contains Co of 0.12 to 0.32 mass % (preferably 0.14 to 0.32 mass %, more preferably 0.16 to 0.29 mass %), P of 0.042 to 0.095 mass % (preferably 0.047 to 0.095 mass %, more preferably 0.051 to 0.089 mass %), Sn of 0.005 to 0.70 mass % (preferably 0.005 to 0.40 mass %, more preferably 0.01 to 0.19 mass %; and preferably 0.005 to 0.095 mass %, and more preferably 0.005 to 0.045 mass % in a case where emphasis is placed on conductivity), and O of 0.00005 to 0.0050 mass %, in which a relationship of X1=([Co]−0.007)/([P]−0.008) is satisfied between a content [Co] mass % of Co and a content [P] mass % of P, X1 is 3.0 to 6.2, preferably 3.1 to 5.7, more preferably 3.3 to 5.1, and most preferably 3.5 to 4.5, and the remainder includes Cu and inevitable impurities.

The second invention alloy has the same composition ranges of Co, P, and Sn as those of the first invention alloy, and further contains at least any one of Ni of 0.01 to 0.15 mass % (preferably 0.02 to 0.12 mass %, more preferably 0.025 to 0.09 mass %) and Fe of 0.005 to 0.07 mass % (preferably 0.008 to 0.05 mass %, more preferably 0.015 to 0.035 mass %), in which a relationship of X2=([Co]+0.85×[Ni]+0.75×[Fe]−0.007)/([P]−0.008) and a relationship of X3=1.5×[Ni]+3×[Fe] is are satisfied, X2 is 3.0 to 6.2, preferably 3.1 to 5.7, more preferably 3.3 to 5.1, and most preferably 3.5 to 4.5, and X3 is 0.015 to [Co], preferably 0.035 to (0.9×[Co]), and more preferably 0.05 to (0.8×[Co]), among a content [Co] mass % of Co, a content [Ni] mass % of Ni, a content [Fe] mass % of Fe, and a content [P] mass % of P, and the remainder includes Cu and inevitable impurities.

The third invention alloy further contains, in addition to the composition of the first invention alloy or the second invention alloy, at least any one of Zn of 0.002 to 0.5 mass %, Mg of 0.002 to 0.25 mass %, Ag of 0.002 to 0.25 mass %, and Zr of 0.001 to 0.1 mass %.

Next, conditions for producing the high performance copper rod or wire will be described. A raw material is melted, a continuous casting and rolling process is performed, and then a drawing/wire drawing process is performed, thereby producing a rod or wire. Only the continuous casting and rolling process may be performed without performing the drawing/wire drawing process. The rolling is performed to an outer diameter of 8 to 25 mm by the continuous casting and rolling process. The rolling starting temperature is 860 to 1000° C., the total hot processing rate is 75% or higher, the temperature after the final pass is, for example, 500 to 600° C. in the case of an outer diameter of 8 mm and 600 to 700° C. in the case of an outer diameter of 20 mm. The average cooling rate from 850 to 400° C. is 10° C./second or higher. The total hot processing rate is (1−(sectional area of rod or wire after continuous casting and rolling)/(sectional area of the casting before rolling))×100%.

A heat treatment TH1 at 350 to 620° C. for 0.5 to 16 hours may be performed after the continuous casting and rolling process. The heat treatment TH1 is performed mainly for precipitation, and may be performed during the drawing/wire drawing process or after the drawing/wire drawing process possibly more than one time. A heat treatment TH2 at 200 to 700° C. for 0.001 seconds to 180 minutes may be performed after the drawing/wire drawing process. The heat treatment TH2 is performed mainly for restoration, and may be performed more than one time. In addition, the drawing/wire drawing process may be performed again after the heat treatment TH2, and the heat treatment TH2 may be performed again following the drawing/wire drawing process performed after the heat treatment TH2.

Next, the reason for adding each element will be described. High strength, high conductivity, and the like cannot be obtained through the independent addition of Co. However, when Co is added together with P and Sn, high strength and high heat resistance can be obtained without decreasing thermal and electrical conductivity. The independent addition of Co slightly increases the strength, and does not cause a significant effect. When the content is over the upper limit (0.32 mass %), the effects are saturated, high-temperature deformation resistance becomes high, and thus hot rolling workability is deteriorated. In addition, the conductivity is decreased. When the content is below the lower limit (0.12 mass %), the strength and the heat resistance do not increase even with P. In addition, the desired non-recrystallized structure is not formed. Moreover, a metal structure in which recrystallized grains are refined is not formed.

When P is added together with Co and Sn, it is possible to obtain high strength and high heat resistance without decreasing thermal and electrical conductivity. The independent addition of P improves fluidity and strength, and makes grain size refined. When the content is over the upper limit (0.095 mass %), the effects are saturated and the thermal and electrical conductivity is decreased. In addition, cracks occur easily at the time of casting or hot rolling. In addition, ductility, in particular repetitive bending workability is deteriorated. When the content is below the lower limit (0.042 mass %), the strength and the heat resistance do not improve, and the desired metal structure is not formed.

When Co and P are added together in the above-described composition ranges, strength, heat resistance, high-temperature strength, wear resistance, hot deformation resistance, deformability, and conductivity become satisfactory. Particularly, when it is necessary to reduce the diameter of a wire at completion of a continuous casting and rolling process, for example, Co of 0.16 to 0.29 mass % and P of 0.051 to 0.089 mass % are the most suitable for a sectional area of a wire of about 80 $mm^2$ or less. When either Co or P is low in content, no remarkable effect is exhibited in any one of the above-described characteristics. When either content is too high, there are problems such as cost increase, decrease in hot deformability, increase in hot deformation resistance, cracks during hot processing, and fractures during bending processing, as observed in the case of the independent addition.

Sn is required to fall within the above-described composition range. However, in a case where particularly high strength is not necessary but high conductivity is necessary in the high performance copper rod or wire, the content is preferably 0.005 to 0.095 mass %, and most preferably 0.005 to 0.045 mass %. On the other hand, when the emphasis is laid on strength for rod usage, the content is preferably 0.03 to 0.40 mass %. When it is necessary to thin a wire for a particular wire usage, the content is preferably 0.05 to 0.19 mass % since Sn improves hot deformation resistance. When a high cold process is added at an after-process for wire usage or the like, it is possible to obtain sufficiently high strength with the addition of a small amount of Sn of 0.05 to 0.095 mass % by the synergy effect of process hardening caused by cold wire drawing and solid solution strengthening of Sn. However with the addition of Co and P only, the heat resistance of matrix is insufficient and not stabilized. Sn improves heat resistance (particularly, it promotes the uniform generation of a non-recrystallized structure in a continuous casting and rolling process), makes the crystal grains of a recrystallized part refined, and improves strength, bending workability, bending resistance, and impact resistance. Ductility such as bending resistance is particularly important for wire harnesses, robot wirings, and airplane wirings, since such applications involve movements to open/close a door, an arm, etc.

Sn makes recrystallized grains generated by breaking a coarsened casting structure refined at the time of hot rolling from a rolling start temperature to 800° C. or 750° C., suppresses growth of the recrystallized grains, and makes most of Co, P, and the like into a solid solution state. The dynamic recrystallization temperature and the static recrystallization temperature of the matrix are raised by solid solution of Sn in the matrix and by the solid solution and precipitation of Co and P, and the non-recrystallized structure is uniformly dispersed, although the ratio of the non-recrystallized structure turns to increas when a hot rolling temperature is 750° C. or slightly lower than 750° C., for example, 700° C. The heat resistance of the matrix is increased by Co, P, and Sn, and fine recrystallized grains and uniformly distributed non-recrystallized grains are formed. In addition, precipitation of Co and P is suppressed during the continuous rolling by Sn solid solution in the matrix, and most of Co and P are in a solid solution state. That is, Sn decreases the solution sensitivity of Co, P, and the like. In addition, Sn has the effect of uniformly dispersing precipitates of Co, P, and the like at the time of a precipitation heat treatment thereafter. In the case of rod usage, since the diameters of the final products are large, the outer diameter after the continuous casting and rolling process is large. For this reason, the processing rate of the continuous casting and rolling process becomes low. Accordingly, Sn is necessary to make the recrystallized grains refined. Sn improves high temperature strength at about 300° C. required for welding tips or trolley lines. In addition, it has an effect on wear resistance depending on hardness and strength. In this specification, "solution sensitivity is low" means that atoms in a solid solution state at a high temperature are hardly precipitated during cooling even at a low cooling rate, whereas "solution sensitivity is high" means that atoms are easily precipitated at low cooling rate.

When Sn is less than the lower limit (0.005 mass %), strength, heat resistance of the matrix, and bending workability are decreased. When Sn is more than the upper limit (0.70 mass %), thermal and electrical conductivity are deteriorated, hot deformability immediately after solidification is deteriorated, and hot deformation resistance becomes high. Accordingly, it is difficult to perform a hot rolling process. For example, in case of a material with an addition of Sn: 0.2 mass %, hot deformation resistance at 700 to 900° C. is increased by about 20% as compared with a material containing Sn: 0.03 mass %, and the deformation resistance increases more at 700° C. or lower. As for the hot deformation resistance, when the Sn addition amount is large, it is difficult to add a large reduction at once even when a rolling pass schedule is changed. Particularly, deformation resistance becomes high at the later stage of the continuous casting and rolling process, and thus it is difficult to obtain thin wires. For example, to obtain wires of 3 mm or less, it is advantageous as regards costs and processes to reduce a sectional area by making the wires thinner at this stage. Accordingly, to obtain wires of, for example, a diameter of 10 mm, that is, a sectional area of about 80 $mm^2$, the content of Sn is preferably 0.19 or 0.095 mass % or less, and more preferably 0.045 mass % or less. On the other hand, the addition of Sn decreases conductivity. To obtain high conductivity, Sn is preferably 0.19 mass % or less. To secure 65% IACS or higher, more preferably 70% IACS or higher, and most preferably 75% IACS or higher as an indication of better conductivity than pure aluminum, Sn is preferably 0.095 mass % or less, and more preferably 0.045 mass % or less.

In order to obtain high strength and high conductivity as is the object of the invention, the size and distribution of precipitates, that is, the combination ratio of Co, Ni, Fe, and P is very important. By a precipitation process, the diameters of precipitates of Co, Ni, Fe, and P, for example, spheral or oval precipitates such as $Co_xP_y$, $Co_xNi_yP$, and $Co_xFe_yP_z$ are about 10 nm, that is, 2 to 20 nm, or 90% of the precipitates, and preferably 95% or more are 0.7 to 30 nm or 2.5 to 30 nm (30 nm or less), when defined as an average grain diameter of the precipitates represented in a plane. The precipitates are uniformly precipitated, thereby obtaining high strength. In addition, precipitated grains of 0.7 and 2.5 nm are the smallest sizes that can be measured in 750,000-fold magnification or 150,000-fold magnification, using a general transmission electron microscope: TEM. Accordingly, if precipitates having a diameter less than 0.7 nm could be observed, the ratio of precipitates having diameters of 0.7 nm or 2.5 nm to 30 nm might be changed. During the continuous casting and rolling process of castings, it is possible to obtain a non-recrystallized structure and a fine recrystallized structure by delaying the recrystallization due to the precipitates of Co, P, and the like. In addition, at a temperature of 800° C. or higher immediately after solidification, a coarse casting structure is completely broken during the continuous casting and rolling process, and fine recrystallized grains are smoothly created without delay. The precipitates of Co, P, and the like improve high-temperature strength at the 300° C. or 400° C. required for welding tips or the like. Wear resistance depends on hardness and strength, and thus the precipitates of Co, P, and the like have an effect on wear resistance. In addition, when the precipitates of Co, P, and the like are heated at a high temperature, for example, 700° C. for a short time, most of the precipitates do not disappear, but grow, although they are not coarsened. Accordingly, it is possible to obtain rods or wires having high strength and high conductivity, or press-formed materials thereof, even after heating them at a high temperature of 700° C. for a short time.

The Co, P, Fe, and Ni contents have to satisfy the following relationships. Among the content [Co] mass % of Co, the content [Ni] mass % of Ni, the content [Fe] mass % of Fe, and the content [P] mass % of P, as X1=([Co]−0.007)/([P]−0.008), X1 is 3.0 to 6.2, preferably 3.1 to 5.7, more preferably 3.3 to 5.1, and most preferably 3.5 to 4.5. In the case of adding Ni and Fe, as X2=([Co]+0.85×[Ni]+0.75×[Fe]−0.007)/([P]−0.008), X2 is 3.0 to 6.2, preferably 3.1 to 5.7, more preferably 3.3 to 5.1, and most preferably 3.5 to 4.5. When X1 and X2 are over the upper limits, thermal and electrical conductivity is decreased. Heat resistance is insufficient, a recrystallization temperature is decreased, growth of crystal grains is not suppressed, hot deformation resistance is increased, and improvement of strength cannot be obtained during the continuous casting and rolling process. When X1 and X2 are below the lower limits, thermal and electrical conductivity is decreased and hot and cold ductility is deteriorated. In addition, when the contents of Co and P are at an appropriate ratio, for example, hot deformation resistance (when a processing rate is 20%) of a material containing Co: 0.25 mass % at 700 to 900° C. is increased by about 5%, as compared with that of a material with Co: 0.15 mass %. In addition, hot deformation resistance of a material with Co: 0.15 mass % is higher than that of pure copper C1100 by about 5% in a temperature range of 900° C. or higher, and is higher than that by 15 to 20% at 800° C.

Even if the combination ratio of each element such as Co is the same as the configuration ratio in a compound, not all can be combined. In the above-described formula, ([Co]−0.007) means that Co remains in a solid solution state by 0.007 mass %, and ([P]−0.008) means that P remains in a solid solution state in the matrix by 0.008 mass %. That is, in the formula, when a ratio of ([Co]−0.007) and ([P]−0.008) is in the most preferable range of 3.5 to 4.5, precipitates formed from Co and P are represented in a combination formula such as $Co_2P$, $Co_{1.x}P$, or $Co_{2.y}P$. When falling within this combination ratio, desired fine precipitates are formed, and the key requirement to obtain a material having high conductivity and high strength is satisfied. On the other hand, when the ratio moves away from the most preferable range and the range of 3.0 to 6.2 in the first invention alloy, either Co or P does not form precipitates and enters a solid solution state. Accordingly, high strength materials cannot be obtained, and conductivity is deteriorated. Otherwise, precipitates having an undesired combination ratio are formed, diameters of the precipitates become large, or the precipitates do not contribute to strength so much. Accordingly, high conductivity and high strength materials cannot be obtained.

Similarly, in Co, Fe, Ni, and P, when a ratio of ([Co]+0.85×[Ni]+0.75×[Fe]−0.007) and ([P]−0.008) is in the most preferable range of 3.5 to 4.5, precipitates of Co, Ni, Fe, and P, such as $Co_xNi_yFe_zP_a$, $Co_xNi_yP_z$, $Co_xFe_yP_z$, and the like are formed, in which a part of Co represented as, for example, $Co_2P$ or $Co_{2-x}P_y$ is substituted with Ni and/or Fe. If fine precipitates based on $Co_2P$, $Co_{1-x}P$ or $Co_{2-y}P$ are not formed, the main subject of the invention, which is high strength and high electrical conductivity, cannot be obtained. When the ratio moves away from the most preferable range and the range of 3.0 to 6.2 in the second invention alloy, any one of Co, Ni, Fe, and P does not form precipitates and enters a solid solution state. Accordingly, high strength materials cannot be obtained, and conductivity is deteriorated. Otherwise, precipitates having an undesired combination ratio are formed, diameters of the precipitates become large, or they are the precipitates which do not contribute to strength so much. Accordingly, high conductivity and high strength materials cannot be obtained.

Independent addition of elements of Fe and Ni does not contribute to the characteristics such as heat resistance and strength so much, and also decreases conductivity. However, Fe and Ni replace a part of Co functions under the co-addition with Co and P. In the above-described formula ([Co]+0.85×[Ni]+0.75×[Fe]−0.007), a coefficient 0.85 of [Ni] and a coefficient 0.75 of [Fe] represent a coupling ratio of Ni and P and Fe and P, respectively, when a coupling ratio of Co and P is 1.

Meanwhile, when another element is added to copper, conductivity is decreased. For example, generally, when any of Co, Fe, and P is independently added to pure copper by 0.02 mass %, thermal and electrical conductivity is as low as about 10%. When Ni is independently added by 0.02 mass %, thermal and electrical conductivity is as low as about 1.5%.

When the values of the above-described formulas X1 and X2 with regard to Co, P, and the like fall outside of the most preferable range, uniform dispersion or extreme fineness of the precipitates is deteriorated. Accordingly, heat resistance or effects on a metal structure surface such as precipitation hardening, non-recrystallization, and fineness of recrystallized parts are deteriorated. In addition, Co, P, and the like enter a solid solution state, and thus thermal and electrical conductivity is decreased. When Co, P, and the like are appropriately combined and fine precipitates are uniformly distributed, a significant effect on ductility such as bending resistance is exhibited by synergy effect with Sn.

Fe and Ni partially replace the functions of Co. The independent addition of Fe and Ni decreases conductivity, and does not contribute to improvement of the characteristics such as heat resistance and strength so much. However, the independent addition of Ni improves stress relief resistance required for connectors or the like. In addition, Ni functions as a replacement of Co under the addition together with Co and P. Ni also has a function of minimizing the decrease of conductivity even when the value of the formula ([Co]+0.85×[Ni]+0.75×[Fe]−0.007)/([P]−0.008) gets away from the center value of 3.0 to 6.2. In addition, Ni has an effect of suppressing diffusion of Sn in Sn-plated connectors or the like. However, when Ni is excessively added by 0.15 mass % or more, or more than the formula (1.5×[Ni]+3×[Fe]≤[Co]), the composition of precipitates is gradually changed. Accordingly, Ni does not contribute to improvement of strength, and hot deformation resistance is increased, and electrical conductivity is deteriorated.

A small amount of Fe together with Co and P improves strength, increases non-recrystallized structure, and makes the recrystallized part refined. However, when Fe is excessively added by 0.07 mass % or more, or more than the formula (1.5×[Ni]+3×[Fe]≤[Co]), the composition of precipitates is gradually changed. Accordingly, Fe does not contribute to improvement of strength, and furthermore, hot deformation resistance is increased, and conductivity is deteriorated.

Zn, Mg, Ag, and Zr render the S mixed in during copper recycling harmless, decrease intermediate temperature embrittlement, and improve ductility and heat resistance. Zn, Mg, Ag, and Zr strengthen the alloy substantially without decreasing conductivity. Zn, Mg, and Ag improve strength of the alloy by solid solution strengthening. In addition, Zr improves strength of the alloy by a precipitation effect. Zn improves solder wettability and a brazing property. Zn or the like has an effect of promoting uniform precipitation of Co and P. When the contents of Zn, Mg, Ag, and Zr are below the lower limits of the composition ranges, the above-described effects are not exhibited. When the contents are over the upper limits, the above-described effects are saturated and conductivity starts to decrease. Hot deformation resistance is increased, thereby deteriorating deformability. Ag and Mg strengthen the material by solid solution to the same extent as Sn, but they also increases hot deformation resistance to the same extent as Sn. Accordingly, when wires are thinned by a continuous casting and rolling process, the content is preferably 0.19 mass % or less. Similarly, the content of Zr is preferably 0.0045 mass % or less.

Next, working processes will be described. Hot deformation resistance in a continuous casting and rolling process is exponentially increased with decrease in temperature. When other elements are added to pure copper, hot deformation resistance is increased. Particularly, in the invention alloy, there is not a large difference in hot deformation resistance at a high temperature higher than 800° C., compared to pure copper. However, at a temperature of 800° C. or lower, the difference gets larger with decrease in temperature. In order to overcome this, it is necessary to start a rolling process at a hot rolling start temperature equivalent to or higher than that of pure copper, for example, 860 to 1000° C., preferably 880 to 990° C., and more preferably 910 to 980° C. The deformation resistance depends on an area in contact with a roll, that is, how much area is rolled (i.e. reduction). In the early stage of rolling, hot deformation resistance is low, and thus the reduction is higher than that of pure copper, for example, increase of 5 to 20%. In the later stage of rolling, particularly, deformation resistance of the invention alloy becomes larger than that of pure copper, and thus it is possible to obtain thin wires having the same size as that of the final pure copper by decreasing the reduction.

In the hot processing, pure copper is sufficiently recrystallized at about 500° C. even for a short time of several seconds. However, in case of the invention alloy, non-recrystallized parts occur even when a plasticity process is performed at a temperature equal to or lower than 700 to 750° C., since the invention alloy has high heat resistance. The reason is because precipitation based on Co and P is started partially, and thus generation of recrystallization nucleuses is delayed. In addition, when the hot rolling process is started at 860 to 1000° C., preferably 880 to 990° C., and more preferably 910 to 980° C., an ingot structure is sufficiently broken and recrystallized at a time when the temperature reaches 700° C. or 750° C. corresponding to the middle of rolling, in case of a process for producing wires having an outer diameter of 8 mm. While they are recrystallized, most of Co, P, and the like are in a solid solution state. At a temperature of 700 to 750° C. or lower, a ratio of non-recrystallized grains is increased. When a cooling rate is low, Co, P, and the like are precipitated. However, at this time, the precipitated grains are large, and do not contribute to strength so much. With the rolling start temperature, it is preferable that a cooling rate is set to 10° C./second or higher in a temperature range from 850 to 400° C. that is a temperature of materials in the early stage of rolling, so that more Co and P remain in a solid solution state. The non-recrystallized structure has strength higher than that of the recrystallized structure, and it is possible to raise strength of materials using the non-recrystallized structure. In addition, the non-recrystallized structure obtained in the continuous casting and rolling process is not different from a processed structure obtained in cold working. The non-recrystallized structure has a dislocation density higher than that of the recrystallized structure, but has a dislocation density lower than that of the cold-processed structure and has good ductility. It is more preferable that original recrystallized grains of the non-recrystallized structure are finer.

Meanwhile, a non-recrystallization ratio depends on a rolling temperature and a processing rate, as well as a composition. For example, when a rolling process is started at 860 to 1000° C. at the time of a continuous casting and rolling process and a cooling rate is 10° C./second or higher, a non-recrystallization ratio is no more than 2 to 50% in case of rods having an outer diameter of 24 mm. On the contrast, in case of an outer diameter of 8 mm, a non-recrystallization ratio is increased to 10 to 80% mainly due to decrease of the final rolling temperature. Accordingly, when the outer diameter is smaller, the non-recrystallization ratio is higher. Being in contact with a roll and cooled by the air, plasticity deformation is performed mainly at an outer peripheral portion, and thus a non-recrystallization ratio in the vicinity of the surface layer is high. An average grain size of the recrystallized parts affects strength of the final products. When the recrystallized grains of the recrystallized parts are small and a ratio of the recrystallized parts and the non-recrystallized parts is appropriately balanced, it is possible to obtain copper alloy rods or wires having excellent mechanical properties.

To summarize from the hot processing rate, when a total hot processing rate of continuous casting and rolling materials of the high performance copper rod or wire is 75% or higher and lower than 95%, or when a sectional area is 150 $mm^2$ or more and less than 700 $mm^2$, it is preferable that a non-recrystallization ratio of a metal structure is 1 to 60% at the stage of completion of the continuous casting and rolling process, and an average grain size of the recrystallized parts is 4 to 40 More preferably, the non-recrystallization ratio of the metal structure is 3 to 45%, and the average grain size of the recrystallized parts is 4 to 30 μm. At the center in the section or in the area close to the center, it is preferable that a non-recrystallization ratio is 0 to 30%, and an average grain size of the recrystallized part is 5 to 35 μm. In the vicinity of the outer layer in the section, it is preferable that a non-recrystallization ratio is 20 to 80%, and an average grain size of the recrystallized part is 4 to 25 μm.

When the total hot processing rate of the continuous casting and rolling materials is 95% or higher, or when the sectional area is less than 150 $mm^2$, it is preferable that a non-recrystallization ratio of a metal structure is 10 to 80%, and an average grain size of the recrystallized part is 2.5 to 25 μm. In addition, it is preferable that the non-recrystallization ratio of the metal structure is 20 to 65%, and the average grain size of the recrystallized parts is 2 to 20 μm. At a part close to the center in the section, it is preferable that a non-recrystallization ratio is 1 to 45%, and an average grain size of the recrystallized parts is 3 to 35 μm. In the vicinity of the outer layer in the section, it is preferable that the non-recrystallization ratio is 35 to 95%, and the average grain size of the recrystallized parts is 3 to 15 μm. When the non-recrystallization ratio is high, strength becomes high with the next cold process by process hardening. In addition, when the non-recrystallization ratio is high, solution of Co, P, and the like is slightly insufficient, and thus precipitation hardening caused by Co, P, and the like becomes slightly low. In addition, when the non-recrystallization ratio is high, the size of the crystal grains of the recrystallized parts becomes small, and thus strength is increased. Specifically, for example, in the subsequent processes, when a cold process is not performed before or after a precipitation heat treatment or when a cold processing rate is low, precipitation hardening is better, and thus it is preferable that a non-recrystallization ratio is 1 to 45%. Similarly, also when a cold pressing process or a cold forging process is performed on rods, lower strength and abundant ductility are required. Accordingly, it is preferable that a non-recrystallization ratio is 1 to 45%. When a cold process of 20 to 50% is performed before or after the precipitation heat treatment, it is preferable that a non-recrystallization ratio is 20 to 65% in consideration of strength. When a cold processing rate is high in usage for wires or the like, it is preferable that a non-recrystallization ratio is 20 to 65%. The reason is because when a non-recrystallization ratio particularly in the vicinity of a material surface is as high as 35 to 95%, the material becomes rather soft, and thus a bending property is excellent at the time of the precipitation heat treatment. Herein, the total hot processing rate indicates (1−(sectional area of rod or wire after continuous casting and rolling)/(sectional area of casting before rolling))×100%.

Generally, it is satisfactory that recrystallized grains are basically fine. However, when high-temperature strength and ductility are necessary, it is satisfactory that the recrystallized grains are large to some extent rather than fine and preferably 10 to 30 μm in the viewpoint of a high-temperature (300° C.) creep. In the viewpoint of heat resistance, a non-recrystallization ratio is satisfactorily 1 to 45%. As described above, the reason why the total hot processing rate is 75% or higher is because it is a processing rate at which the casting structure is completely broken. Even in the case of being outside the range, at the processing rate of 70% or higher, which is close to 75%, the above description can be substantially applied. The rod or wire of the invention alloy formed of such a non-recrystallized structure and fine recrystallized grains and then subjected to a heat treatment has strength equivalent to that of a rod or wire passing through a generally performed solution-heat treatment. The rod or wire of the invention alloy is characterized in that good ductility, as well as strength.

Next, a heat treatment TH1 will be described. In a rod or wire, substantially circular or substantially oval fine precipitates are uniformly dispersed by the heat treatment TH1, and an average grain diameter of the precipitates is 2 to 20 nm, or 90% or more of all precipitates have a size of 30 nm or less. As described above, the fine precipitates are uniformly dispersed, and strength and conductivity of the rod or wire are improved, thereby improving reliability of the rod or wire. As a cold processing rate after a continuous casting and rolling process is higher, a precipitation site of a compound of Co, P, and the like is increased and the precipitation occurs at a low temperature. A basic condition of the heat treatment TH1 is at 350 to 620° C. for 0.5 to 16 hours. When a cold processing rate is 0%, the condition is at 450 to 600°

C. for 1 to 16 hours, and preferably at 475 to 550° C. for 2 to 12 hours. To obtain higher conductivity, a 2-step heat treatment, for example, at 525° C. for 2 hours and at 500° C. for 4 hours is effective. When a processing rate before a heat treatment is increased, the precipitation site is increased. Accordingly, in case of a processing rate of, for example, 10 to 40%, the most preferable heat treatment condition is shifted to a low temperature side by 10 to 20° C. A more preferable condition is at 425 to 580° C. for 1 to 16 hours.

In addition, a temperature, a heat treatment time, and a cold processing rate are more clarified. By expressing a heat treatment temperature as T (° C.), a heat treatment time as t (hour), and a cold processing rate as RE (%), when a value of $(T-100\times t^{-1/2}-50\times \mathrm{Log}\ \{(100-RE)/100\}\})$ represents a heat treatment index TI, $370\leq TI\leq 510$ is satisfactory, preferably $390\leq TI\leq 490$, and most preferably $400\leq TI\leq 480$. For example, when the heat treatment time is extended, the temperature of the heat treatment is shifted toward a low temperature side, and an influence on the temperature is substantially given as a reciprocal of a square root of a time. In addition, as the processing rate is increased, the precipitation site is increased and movement of atoms is increased, and thus it is easy to precipitate. Accordingly, the heat treatment temperature is shifted toward a low temperature side. The cold processing rate has a large influence on the heat treatment temperature. In this case, Log is natural logarithm, and the cold processing rate RE is (1−(sectional area of rod or wire after process)/(sectional area of rod or wire before process))×100%. When the heat treatment TH1 are performed more than once, a total cold processing rate from the continuous casting and rolling material is applied to RE.

The purpose of the heat treatment TH1 is to finely and uniformly precipitate Co, P, and the like. Therefore, although cost effectiveness is important, when the heat treatment TH1 is performed twice, conductivity of the rod or wire is further improved, thereby also improving ductility. Most of them are precipitated at the first heat treatment TH1, but it is not perfect yet and there are some of Co, P, and the like, in a state where they can be precipitated into matrix. By performing a plasticity process such as a drawing process and a wire drawing process after the first heat treatment TH1, micro-movement of atoms become easy as a temperature is gradually increased at the time of the next heat treatment, and thus Co, P, and the like, some of which cannot be precipitated by the first heat treatment, are additionally precipitated at the second heat treatment TH1. In case of wires needing to have particularly bending resistance, the heat treatment TH1 is performed more than once, and the wires are suitable for use after the final TH1 treatment.

As the precipitates are more uniformly and finely distributed and have the same size, and as the diameters of the precipitates become finer, the precipitates have a good influence on the grain size of the recrystallized parts, strength, and heat resistance. The sizes grain diameters of the precipitates have an influence on strength, heat resistance, formation of non-recrystallized structures, fineness of recrystallized structure, and ductility. The average grain diameter is satisfactorily 2 to 20 nm, and preferably 2 to 12 nm, and most preferably 3 to 9 nm. Particularly, in case of rods in which a non-recrystallization ratio of raw materials is low and a total cold processing rate before the heat treatment of precipitates is as low as 0 to 40%, strength depends mainly on precipitation hardening, and thus it is preferable that the precipitates are smaller, and most preferably, the average grain diameter is 2.5 to 5.5 nm. In case of wires in which a total cold processing rate is higher than 95%, ductility is insufficient by process hardening, and thus matrix has to be ductile at the time of the heat treatment TH1. As a result, it is preferable that the average grain diameter of the precipitates is most preferably 3.5 to 9.5 nm, the precipitation hardening is slightly sacrificed, and ductility and conductivity are improved, thereby taking a balance.

Even when the rod or wire of the invention alloy, and the pressed material obtained by pressing the rod or wire are exposed to, for example, a high temperature of 700° C. for 30 seconds, they still have high strength with a recrystallization ratio of 45% or lower. A decreasing ratio thereof is within 20% as compared with conductivity of a material before heating. In case of usage for high conductivity in which the content of Sn is 0.095% or lower, high conductivity of 60% IACS, or 65% IACS or higher is kept. This high conductivity and the like are superior as compared with a general precipitation hardening alloy Corson, Cr copper, Cr—Zr copper, or Ti copper. The reason is because even when it is exposed to a high temperature of 700° C. for 30 seconds, most precipitates do not disappear and the precipitates are grown but the average grain diameter as the size of the precipitates is 20 nm or less, or a ratio of the precipitates of 30 nm or less is 90% or higher. Reasonably, the precipitates do not include crystalline materials created at the step of casting.

The definition of uniform dispersion of precipitates, if necessary, is that when the precipitates were observed using the TEM in 150,000-fold magnification, a distance between the most adjacent precipitated grains of at least 90% or more of precipitated grains in any area of 1000 nm×1000 nm at a microscope observing position to be described later (except for particular parts such as the outermost layer) is 150 nm or less, preferably 100 nm or less, and most preferably within 5 times of the average grain diameter. In any area of 1000 nm×1000 nm at the microscope observing position to be described later, it can be defined that there are at least 25 precipitated grains or more, preferably 50 or more, most preferably 100 or more, that is, there is no large zone without precipitated grains, having an influence on characteristics, in view of any micro-part in a standard region. That is, it can be defined that there is not non-uniform precipitated zone. When the precipitates were observed using the TEM in 150,000-fold magnification, the limit of identifiable precipitates is 2.5 nm. Accordingly, in the average size of the precipitates, precipitates of 2.5 nm or more become a target. Similarly, in a ratio of precipitates of 30 nm or less, precipitates of 2.5 nm or more become a target. When the size of the precipitates was substantially 7 nm or less, the precipitates were observed in 750,000-fold magnification. When the precipitates were observed using the TEM in 750,000-fold magnification, the limit of identifiable precipitates is 0.7 nm. Accordingly, in an average size of precipitates and a ratio of precipitates of 30 nm or less, precipitates of 0.7 nm or more become a target.

Next, a heat treatment TH2 will be described. When a high cold processing rate is applied like a thin wire, a material of the invention alloy subjected to a continuous casting and rolling process is made to have ductility by adding a process such as restoration at a low temperature of a recrystallization temperature or lower in the course of wire drawing, and then a wire drawing is performed, strength is improved. In addition, when the heat treatment is performed after the final wire drawing, strength is slightly decreased, but ductility such as bending resistance is significantly improved, and conductivity is also improved. When an outer diameter is as small as 3 mm or less, it is preferable to perform a heat treatment at 350 to 700° C. for 0.001 seconds to several seconds by continuous annealing equipment in the viewpoint of productivity and a tendency of material to wind during annealing. As described above, bending resistance of the rod or wire is further improved by performing the heat treatment TH2, and thus reliability of the rod or wire is further improved. Herein, good bending resistance means that the number of repetitive bending times is 15 or more in case of a wire having an outer diameter of 2 mm, and the number of repetitive bending times is 20 or more in case of a wire having an outer diameter of 0.8 mm.

Characteristic of the high performance copper rod or wire according to the invention will be described. Generally, as means for obtaining a high performance copper rod or wire, there is structure control mainly based on grain refinement, solid solution hardening, and aging and precipitation hardening. For this structure control, various elements are added. However, as for conductivity, when the added elements are in a state of solid solution in matrix, conductivity is generally decreased, and conductivity is significantly decreased depending on the elements. Co, P, and Fe of the invention alloy are the elements that significantly decrease conductivity. For example, only with independent addition of Co, Fe, and P to pure copper by 0.02 mass %, conductivity decreases by about 10%. Even in the known aging and precipitation alloy, it is impossible to efficiently precipitate added elements completely without solid solution being remained in matrix, and thus there is a problem. A peculiar merit of the present invention is that most of Co, P, and the like subjected to solid solution can be precipitated in the later heat treatment when Co, P, and the like are added according to the above-described formulas, thereby securing high conductivity.

Meanwhile, a large amount of Ni, Si, or Ti remains in matrix in titanium copper or Corson alloy (addition of Ni and Si) known as aging hardening copper alloy as compared with the invention alloy, even when a complete solution-aging process is performed on titanium copper or Corson alloy. As a result, there is a defect that conductivity is decreased, although strength is high. Generally, when a solution treatment (e.g., heating at a typical solution temperature of 800 to 950° C. for several minutes or more) at a high temperature necessary for a complete solution-aging precipitation process is performed, crystal grains are coarsened. The coarsening of the crystal grains has a bad influence on various mechanical characteristics. In addition, the solution treatment is restricted in quantity during production, and thus cost is drastically increased. While grain refinement is mainly employed in structure control, when the amount of added elements is small, significant grain refinement cannot be expected to a great extent.

In the invention, it was found that solution and structure control of non-recrystallized structure and grain refinement can be performed at the same time in the course of a continuous casting and rolling process and the compositions of Co, p, and the like, and that Co, P, and the like can be finely precipitated in a heat treatment process thereafter. That is, in the continuous casting and rolling process, plasticity deformation caused by hot rolling is added to castings in a high-temperature solidification state, an average cooling rate in a temperature range of 850 to 400° C. is 10° C./second or higher, or an average cooling rate in a temperature range of 850 to 600° C. is 5° C./second or higher, and preferably 10° C./second or higher. In this case, industrially, Co, P, and the like can be subjected to solid solution sufficiently in matrix for solution.

There is a problem in equipment of the continuous casting and rolling process. However, when a cooling rate in a temperature range from 850 to 400° C. or from 850 to 600° C. becomes higher, more Co, P, and the like are subjected to solid solution and crystal grains become finer. Accordingly, it is possible to improve strength. In addition, it is preferable that a cooling rate of materials after the final rolling in the continuous casting and rolling process becomes higher because of the above-described reason. Specifically, it is preferable that the rolling start temperature is increased to be as high as at 880 to 990° C., the rolling rate is raised, a strengthening (rolling) and rolling process is performed, the cooling rate is raised by adjusting a rolling pass schedule or the like, a water cooling process (with reducible cooling water including alcohol) is performed immediately after the final rolling, a distance to water cooling equipment is shortened, and a shower water cooling process or a compulsory air cooling is performed.

It was found that when a rolling process is continuously performed from the castings of the compositions of the invention alloy, a large amount of crystal grains are dynamically and statically recrystallized at a high temperature of 750° C. or higher, and most of the crystal grains are not dynamically and statically recrystallized in a temperature range of 700° C. or lower. In the middle or later stage of the hot rolling process in a high temperature state of 700 to 750° C., most of the hot-rolled parts become recrystallized structures. A part or most of the recrystallized structures become non-recrystallized structures by the hot rolling at a temperature of 700° C. or lower, or 750° C. or lower thereafter. In addition, it was found that the non-recrystallized structures do not deteriorate ductility and contribute to strength. In addition, it was found that metal structures other than the non-recrystallized structures are formed of fine recrystallized grains. When a ratio of the non-recrystallized structure and the recrystallized structure is appropriately set, precipitation of Co, P, and the like and restoration of ductility of matrix are appropriately performed at the next heat treatment, and it was possible to obtain high strength and high conductivity rods or wires balanced in ductility based on a bending property, conductivity, and strength.

In summary, in the high performance copper rod or wire according to the invention, Co, P, and the like are in a state of solid solution in the course of the continuous casting and rolling process by the combination of the continuous casting and rolling process and the composition of Co and P, and non-recrystallized structures and recrystallized structures composed of fine recrystallized grains are formed. By performing a heat treatment in the course of a process after the continuous casting and rolling process, Co, P, and the like are finely precipitated, and it is possible to obtain high strength and high conductivity. When a drawing/wire drawing process is performed before and after the heat treatment, it is possible to obtain further high strength by process hardening without deteriorating conductivity. When a low-temperature annealing process (annealer annealing) is performed in the middle of the process of a wire, atoms are rearranged by restoration or a kind of softening phenomenon, and it is possible to obtain further higher conductivity and ductility. Nevertheless, when strength is not sufficient yet, it is possible to improve strength by addition (solution hardening) of Sn (Zn, Ag, or Mg), while balancing with conductivity. The addition of Sn has an effect of rather increasing ductility. The addition of a small amount of Sn (Zn, Ag, or Mg) does not have a significant negative influence on conductivity. In a metal structure, Sn or the like makes crystal grains of recrystallized parts refined.

The above-described continuous casting and rolling equipment is mainly for pure copper with low hot deformation resistance, and materials used for the equipment are required to have low hot deformation resistance. The invention alloy to which Co and the like are added represents that there is no large difference in low deformation resistance from that of pure copper, at 800° C. or higher, particularly 900° C. or higher. When non-recrystallized structures start occurring at a temperature of 700° C. or lower in the course of rolling, deformation resistance is increased. When a large amount of deformation of rolling is taken on the high temperature side, it is possible to solve the problem of hot deformation resistance in a process. In addition, it is possible to make a large amount of Co, P, and the like to be in a solid solution state, and thus matrix is strengthened by generation of non-recrystallized structures and grain refinement of recrystallized grains. The high performance copper rod or wire is obtained by precipitation hardening and process hardening thereafter. The invention alloy is characterized in low deformation resistance at the time of hot rolling, while the produced rod or wire has high strength. Within the composition range of the invention alloy, there is no problem with deformability that is another main problem in processing, since excellent hot deformability from a high temperature immediately after solidification is exhibited.

As described above, since the hot deformability is excellent immediately after completion of solidification and the low deformation resistance without a large difference from deformation resistance of pure copper until the middle of rolling is represented, there is no problem in production. In the later of rolling, non-recrystallized structures and fine recrystallized grains are formed, which becomes one large factor contributing to strength of the final products. Sufficient solution occurs in the continuous casting and rolling process, materials are strengthened by precipitation caused by a heat treatment process after the continuous casting and rolling process, conductivity is increased, and thus it is possible to obtain rods or wires having high strength by a plasticity process such as a cold drawing/wire drawing thereafter.

Generally, aging precipitation copper alloy is completely made into solution, and then a process of precipitation is performed, thereby obtaining high performance copper rod or wire. Performance of the rod or wire produced by the continuous casting and rolling method, in which solution is simplified, is generally inferior. However, performance of the rod or wire according to the invention is equivalent to or higher than that of the rod or wire produced by the complete solution-precipitation hardening process at high costs.

Among commercial alloys, only Cr—Zr copper and Cr copper are solution-aging precipitation alloys that have high strength and high conductivity. However, when Cr—Zr copper and Cr copper are used in the producing process according to the invention, only very insufficient strength can be obtained. That is, the upper temperature limit of solution is 960° C. or higher and hot deformability is insufficient, and thus there is a large restriction. The solution limit of Cr and Zr is rapidly decreased with slight decrease of temperature, and thus the lower temperature limit of solid solution is also restricted. Accordingly, the temperature range of solution is narrow, and sensitivity of a cooling rate is high. When the content of Cr is over 0.5 mass % or the content of Zr is over 0.1 mass %, the hot deformation resistance becomes high. In this method according to the invention, it is difficult to produce such a rod or wire because of low power. In addition, Cr—Zr copper or Cr copper includes a large amount of active Zr and Cr, and thus there is limitation on melting and casting. As a result, Cr—Zr copper or Cr copper cannot be produced by the continuous casting and rolling method, materials are made by a high-cost hot extruding method, and it is necessary to take a batch of processes of solution-aging precipitation under a severe temperature management. Accordingly, it is not widely used in industry.

As described above, the invention alloy has an excellent hot deformability as much as the continuous casting and rolling process can be performed, has the low hot deformation resistance like pure copper, and can be subjected to structure control (non-recrystallized structures and fine recrystallized structures) for improving strength at a normal temperature in the course of the continuous casting and rolling process. In addition, it is possible to achieve solution without performing a particular process in the course of the continuous casting and rolling process, and it is possible to obtain high strength materials by performing a precipitation process thereafter and then performing a cold plasticity process. The rod or wire obtained in a series of processes according to the invention including the continuous casting and rolling process has high strength and high ductility rather higher than materials obtained by performing the solution-aging precipitation process in off-line on the invention alloy like Cr—Zr copper, and conductivity thereof is equivalent or higher than that of the materials. This is highly important.

In summary, in the known high strength and high conductivity copper alloy in which elements are added to copper, it is required that hot deformation resistance be low, in which a rolling process is performed from a high temperature immediately after solidification, in a continuous casting and rolling method, and that deformability be excellent. Accordingly, it has not been put to practical use. In addition, the known high strength and high conductivity copper has been produced by a producing method of performing an aging process, a rapid cooling process, and a solution process at a temperature of 900° C. or higher with costs, using hot extruding materials having low productivity. In the combination of the compositions and the producing process, these methods are not used, shapes of rods or wires are produced by a continuous casting and rolling process capable of producing wires or rods with a lowest cost, and structure control can be performed as well as solution in the course of the continuous casting and rolling process. The combination is not represented in the known art. It is very advantageous industrially in that alloy copper having excellent characteristics can be provided at a low cost. As yet, the relationship of deformability and deformation resistance in a temperature range from a high temperature to a hot state immediately after solidification and the plurality of alloy contents of Co, P, and the like is not known, solution sensitivity of the added elements is not known, and grain refinement and non-recrystallized structures generated in hot rolling mainly at 700° C. or lower are not known. The effect of formation of these metal structures on mechanical strength, and the relationship between solution performed at a low cooling rate in a continuous casting and rolling method and the precipitation grains precipitated thereafter could be found in the present invention. The effects of a series of solution, structure control, precipitation, and process hardening on strength, conductivity, ductility, and bending resistance could also be found.

As yet, such a copper rod or wire having high strength and high conductivity has not been produced by a continuous casting and rolling process. The non-recrystallized structures generated at the time of the continuous casting and rolling process in the copper rod or wire according to the invention have no large influence on ductility of the final products. Meanwhile, as precipitation hardening copper alloy, the uniform precipitation of the precipitates finely into 2.5 nm to 10 nm, the grain refinement of the recrystallized parts and the composition, the restoration caused by the heat treatment, and the like have a good influence on ductility such as bending resistance.

In determination whether or not wires are used as industrial materials, it is important whether or not balance between conductivity and strength, and balance among conductivity, strength, and ductility are precisely taken. High conductivity as the assumption is preferably 55% IACS, and more preferably 60% IACS or higher. In case of needing high conductivity, conductivity is preferably 65% IACS or higher, which is equivalent to or higher than that of aluminum, more preferably 70% IACS or higher, and most preferably 75% IACS or higher. In this specification, as an index for evaluation with combination between strength and conductivity of rods or wires, a wire performance index I1 is defined as follows:

$$\text{Performance index } I1=R^{1/2}\times S,$$

where conductivity is R (% IACS) and tensile strength is S ($N/mm^2$).

The wire performance index I1 is 4300 or more, preferably 4500 or more, more preferably 4700 or more, and most preferably 5000 or more. The above-described values represent very excellent high strength and high conductivity copper. The copper wires according to the embodiment have excellent strength, conductivity, and bending resistance even in an outer diameter of 3 mm or less, and thus reliability of the copper wires is improved.

The above-described wire can be used for wire harnesses, relays, connector lines, and wirings of robots and airplanes. In these usages, the balance among conductivity, strength, and ductility is necessary, which is classified largely into two options: high strength with conductivity of 50% IACS or higher, and conductivity of 70% IACS or higher or even 75% IACS or higher even if strength is slightly decreased. Materials are determined considering the balance according to the usage. On the assumption that there is bending resistance of wires, high strength in these fields results in light weight, improvement of efficiency of cars, and reduction of $CO_2$. When these characteristics are good, they are suitable for connectors or wire cutting lines. Since strength, conductivity, and bending resistance of the wires are good, reliability of wire harnesses and the like are improved.

In case of rods, elongation may be required. In this specification, as an index for evaluation with combination of strength, elongation, and conductivity of the rods, a rod performance index I2 is defined as follows.

$$\text{Performance index } I2=R^{1/2}\times S\times(100+L)/100,$$

where conductivity is R (% IACS), tensile strength is S ($N/mm^2$), and elongation is L (%).

Under the condition of conductivity of 45% IACS or higher and elongation of 5% or higher, preferably 10% or higher, the rod performance index I2 is 4200 or more, preferably 4400 or more, more preferably 4600 or more, and most preferably 4800 or more. Conductivity is preferably 55% IACS or higher, and more preferably 60% IACS of higher. In case of needing high conductivity, conductivity is 70% IACS or higher, and 75% IACS or higher. When the rod performance index I2 is set as described above, reliability of the rods is improved. The rods according to the embodiment have high wear resistance, and thus can be used for trolley lines, thereby improving reliability of the trolley lines. As for wires, in case of needing elongation irrespective of a wire diameter, the rod performance index I2 may be applied. Particularly, for wires having an outer diameter of 3 mm or more and less than 6 mm, there are many cases where elongation is necessary as well as for rods, and thus the rod performance index I2 may be applied.

For usage of rods, high-temperature strength may be required. For example, tensile strength at, for example, 400° C. is 180 $N/mm^2$ or higher, preferably 200 $N/mm^2$ or higher, more preferably 220 $N/mm^2$ or higher, and most preferably 240 $N/mm^2$ or higher. Since the rods according to the embodiment have high tensile strength at a high temperature such as 400° C., reliability is improved by using the rods for usage needing strength at a high temperature. Most of the precipitates of Co, P, and the like of the rods are not subjected to solid solution again at 400° C., that is, do not disappear, and most of diameters thereof are not changed. Heat resistance of matrix is improved by solid-solution of Sn. Accordingly, even when heating at 400° C., recrystallization does not occur in a state where diffusion of atoms is not active yet. In addition, even when deformation is applied thereto, the rod or wire exhibits resistance against deformation by the precipitates of Co, P, and the like. In addition, when the grain size of the recrystallized parts is 4 to 40 μm, it is possible to obtain satisfactory ductility. As a result, high tensile strength is exhibited. As another example exhibiting high heat resistance as described above, high strength after brazing at 600° C. or 700° C. is a characteristic. That is, even when heating at, for example, 700° C. for about 10 seconds, recrystallization does not occur still, and high strength is exhibited even after brazing.

For rods such as trolley lines or welding tips, high-temperature strength and wear resistance are required on the assumption of high strength and high conductivity. However, balance of strength, conductivity, high-temperature strength, wear resistance, and the like is different according to usage, and thus compositions and processes are determined according to the usage. Particularly, to obtain strength, the cold drawing is added before and/or after the heat treatment. As the total cold processing rate becomes higher, a higher strength material is obtained. However, balance with ductility is important. In order to secure elongation of at least 5% or more, and preferably 10% or more, it is preferable that the total drawing processing rate is 60% or lower or the drawing processing rate after the heat treatment is 40% or lower. In addition, in a using environment with a temperature higher than 300° C., a drawing processing rate after the heat treatment is preferably 50% or lower, and 30% or lower. Trolley lines and welding tips are consumables, but it is possible to extend the life thereof by using the invention. Accordingly, it is possible to reduce costs. The high performance copper rod or wire according to the embodiment is very suitable for trolley lines, welding tips, electrodes, power distribution members, and the like.

The high performance copper rod or wire according to the embodiment, and compressed products thereof have high heat resistance, Vickers hardness (HV) after heating at 700° C. for 30 seconds and water cooling is 90 or higher, and conductivity is 45% IACS or higher. An average grain diameter of precipitates in a metal structure after heating is 2 to 20 nm, 90% or more of all precipitates have a size of 30 nm or less, or a recrystallization ratio in the metal structure is 45% or lower. More preferably, the average grain diameter of the precipitates is 3 to 12 nm, 95% or more of all precipitates have a size of 30 nm or less, or the recrystallization ratio in the metal structure is 30% or lower. Accordingly, the high performance copper rod or wire according to the embodiment, and the compressed products thereof have high strength even after brazing used for bonding, since they can be used in the environment exposed to a high temperature. Specifically, the high performance copper rod or wire according to the embodiment is suitable for rotor bars used for motors, power relays in which rods are brazed after press forming, and the like. In addition, a brazing material is, for example, silver brazing BAg-7 (40 to 60 mass % of Ag, 20 to 30 mass % of Cu, 15 to 30 mass % of Zn, and 2 to 6 mass % of Sn described in JIS Z 3261), a solidus temperature is 600 to 650° C., and a liquidus temperature is 640 to 700° C.

The high performance copper rod or wire according to the embodiment is most suitable for electrical usage such as power distribution components produced by forging or pressing. Hereinafter, forging, pressing, and the like are referred to as a compression process in the general term. It is most preferable to use high strength and high conductivity rods subjected to a heat treatment and a cold drawing process in the step before a compression process, even depending on compression ability of the compression processing, shapes of products, and deformation, and the like. A processing rate of cold drawing of rods is appropriately determined according to the compression ability and the shapes of products. When compression ability of processing equipment is low, when a forming processing rate of a very high compression process is applied, and when high precision of size is required, an after-process of a continuous casting and rolling process is fixed as a drawing process of a processing rate of about 20% without a heat treatment, and a heat treatment is performed after the compression process. In this case, it is possible to obtain power distribution members having high conductivity and high strength, although characteristics thereof are slightly less than those of compressed products subjected to a heat treatment and a cold drawing process before the compression process. In addition, when rods or wires, and compression-processed materials are heated at about 700° C. for a short time by brazing or the like, a heat treatment is not particularly necessary in the course of a series of producing processes, and there is an advantage cost-wise. The reason is because fine precipitates of Co, P, and the like are precipitated during heating at about 700° C., and recrystallization of matrix is delayed by the precipitates to improve conductivity with high strength.

The heat treatment condition after the compression process is preferably a low temperature as compared with the heat treatment condition performed after the continuous casting and rolling or after the drawing/wire drawing process. When a high cold process is locally performed in the compression process, the heat treatment is preferably performed on the basis of the cold-processed part. Accordingly, when a high process is performed, the heat treatment temperature is shifted to a low temperature side or to a short time side. A preferable condition is to apply the above-mentioned conditional expression about the heat treatment TH1 or is at 380 to 630° C. for 15 to 180 minutes. When the heat treatment is performed on rods before the compression process, the heat treatment is not necessarily required. However, the heat treatment may be performed mainly for restoration of ductility, improvement of conductivity, and removal of remaining stress. In that case, a preferable condition is at 250 to 550° C. for 5 to 180 minutes.

Examples

A high performance copper rod or wire was produced using the above-described first invention alloy, second invention alloy, third invention alloy, and copper and comparative copper alloy. Table 1 shows compositions of alloys used to produce the high performance copper rod or wire. Using the first invention alloy No. 1, 2, 3, and 101, the second invention alloy No. 4, 5, and 102, the third invention alloy No. 6, 7, and 103, the comparative alloy No. 11, 12, and 104 having a composition close to the invention alloy, and the known tough pitch copper C1100 alloy No. 21, a high performance copper rod or wire was produced with arbitrary alloy by a plurality of process patterns.

TABLE 1

| | Alloy | Alloy Composition (mass %) | | | | | | | | | | | | | |
|---|---|---|---|---|---|---|---|---|---|---|---|---|---|---|---|
| | No. | Cu | P | Co | Sn | O | Ni | Fe | Zn | Mg | Ag | Zr | X1 | X2 | X3 |
| First | 1 | Rem. | 0.047 | 0.14 | 0.01 | 0.0005 | | | | | | | 3.41 | | |
| Inv. | 2 | Rem. | 0.056 | 0.18 | 0.03 | 0.0005 | | | | | | | 3.60 | | |
| Alloy | 3 | Rem. | 0.067 | 0.24 | 0.08 | 0.0006 | | | | | | | 3.95 | | |
| | 101 | Rem. | 0.079 | 0.28 | 0.09 | 0.0003 | | | | | | | 3.85 | | |
| Second | 4 | Rem. | 0.057 | 0.17 | 0.17 | 0.0005 | 0.02 | | | | | | | 3.67 | 0.03 |
| Inv. | 5 | Rem. | 0.072 | 0.23 | 0.04 | 0.0004 | 0.05 | | | | | | | 4.15 | 0.08 |
| Alloy | 102 | Rem. | 0.086 | 0.27 | 0.04 | 0.0003 | 0.04 | | | | | | | 3.81 | 0.06 |
| Third | 6 | Rem. | 0.056 | 0.17 | 0.01 | 0.0003 | | | | 0.04 | | | 3.40 | | |
| Inv. | 7 | Rem. | 0.069 | 0.24 | 0.06 | 0.0003 | 0.03 | | 0.05 | | | | | 4.24 | 0.05 |
| Alloy | 103 | Rem. | 0.082 | 0.26 | 0.08 | 0.0003 | 0.03 | | 0.04 | 0.12 | | | | 3.76 | 0 05 |
| Comp. | 11 | Rem. | 0.043 | 0.07 | 0.02 | 0.0005 | | | | | | | 1.80 | | |
| Alloy | 12 | Rem. | 0.029 | 0.13 | 0.02 | 0.0007 | | | | | | | 5.86 | | |
| | 104 | Rem. | 0.044 | 0.15 | 0.001 | 0.0005 | | | | | | | 3.97 | | |
| C1100 | 21 | Rem. | | | | 0.028 | | | | | | | | | |

X1 = ([Co] − 0.007)/([P] − 0.008)
X2 = ([Co] + 0.85[Ni] + 0.75[Fe] − 0.007)/([P] − 0.008)
X3 = 1.5[Ni] + 3[Fe]

FIG. 1 to FIG. 3 show processes for producing a high performance copper rod or wire. In the figures, a total hot processing rate of a continuous casting and rolling process, and a processing rate of a drawing or wire drawing process are represented in parentheses of a part representing each process. As shown in FIG. 1, wires were produced by Producing Processes A and B. In Producing Process A, a rod having an outer diameter of 8 mm was produced by a continuous casting and rolling process (hereinafter, a process from melting to continuous casting and rolling is referred to as Process a1). In the continuous casting and rolling process, a composition was adjusted in a retaining furnace of real operation, a casting process was performed to produce a trapezoid casting rod having a sectional area of about 4800 $mm^2$, and a rolling process was started at 975° C. After the rolling process, it was allowed to pass through a water cooling bath for surface oxidation-reduction (redox) by alcohol. At that time, an average cooling rate at the time of rolling from 850 to 400° C. was about 12° C./second, and an average cooling rate from 850 to 600° C. was about 10° C./second. A surface temperature of the rod at the time of putting it into the water cooling bath was about 400° C. After the rod was produced by the continuous casting and rolling process, a heat treatment TH1 at 500° C. for 4 hours was performed (Process a2), the rod was drawn by a cold wire drawing process so that the outer diameter was 2 mm (Process a3), a heat treatment TH2 at 305° C. for 30 minutes was performed (Process a11), the rod was drawn by a cold wire drawing process so that the outer diameter was 0.8 mm (Process a12), and subsequently a heat treatment TH2 at 500° C. for 5 seconds was performed (Process a13). In addition, after Process a3, the rod was drawn by a cold wire drawing process so that the outer diameter was 0.8 mm, and a heat treatment TH2 at 500° C. for 5 seconds was performed (Process a21). In addition, after Process a3, a heat treatment TH2 at 500° C. for 5 seconds was performed, and the rod was drawn by a cold wire drawing so that the outer diameter was 0.8 mm (Process a31).

In Producing Process B, a rod of an outer diameter of 11 mm was produced by the same continuous casting and rolling process as Producing Process A (Process b1). An average cooling rate from 850 to 400° C. was about 13° C./second. The rod was drawn so that the outer diameter was 9 mm by a cold drawing process, a heat treatment TH1 at 480° C. for 8 hours was performed, the rod was drawn by a cold wire drawing process so that the outer diameter was 2 mm (Process b11), a heat treatment TH2 at 400° C. for 2 minutes was performed (Process b12), the rod was drawn by a cold wire drawing process so that the outer diameter was 0.8 mm (Process b13), and subsequently a heat treatment TH2 at 550° C. for 2 seconds was performed (Process b14). As a process in which the heat treatment TH1 is performed twice, a rod having a outer diameter of 11 mm was produced by a continuous casting and rolling process, a heat treatment TH1 at 500° C. for 4 hours was performed (Process b21), the rod was drawn by a cold drawing process so that the outer diameter was 9 mm, a heat treatment TH1 at 480° C. for 8 hours was performed, the rod was drawn by a cold wire drawing process so that the outer diameter was 2 mm (Process b22), and subsequently a heat treatment TH2 at 400° C. for 2 minutes was performed (Process b23). In addition, after Process b21, the rod was drawn by a cold wire drawing process so that the outer diameter was 2 mm, and a heat treatment TH1 at 420° C. for 1 hour was performed (Process b24). In addition, after Process b1, the rod was drawn by a cold drawing process so that the outer diameter was 9 mm, a heat treatment TH1 at 460° C. for 8 hours was performed, the rod was drawn by a cold wire drawing process so that the outer diameter was 0.8 mm and, a heat treatment TH1 at 400° C. for 2 hours was performed (Process b31). In addition, after Process b1, a heat treatment at 630° C. for 1 hour was performed (Process b41), the rod was drawn by a cold wire drawing process so that the outer diameter was 2 mm, and subsequently a heat treatment TH1 at 420° C. for 1 hour was performed (Process b42).

As shown in FIG. 2, rods were produced by Producing Process C. In Producing Process C, a rod having an outer diameter of 23 mm was produced by the same continuous casting and rolling process as Producing Process A (Process c1). An average cooling rate from 850 to 400° C. was about 16° C./second. A heat treatment TH1 at 530° C. for 3 hours was performed for washing (Process c11), and subsequently the rod was drawn by a cold drawing process so that the outer diameter was 20 mm (Process c12). After Process c1, the rod was drawn by a cold drawing process so that the outer diameter was 20 mm (Process c13), a heat treatment TH1 at 480° C. for 8 hours was performed for washing (Process c14), and subsequently the rod was drawn by a cold drawing process so that the outer diameter was 18 mm (Process c15). As a producing process in which the heat treatment TH1 is out of the producing condition, after Process c1, a heat treatment TH1 at 575° C. for 4 hours was performed for washing (Process c16), and the rod was drawn by a cold drawing process so that the outer diameter was 20 mm (Process c17). After Process c13, a heat treatment TH1 at 420° C. for 2 hours was performed for washing (Process c18). In the heat treatment TH1 in Process c16, a heat treatment index TI was over the producing condition. In the heat treatment TH1 in Process c18, a heat treatment index TI was below the producing condition.

Unlike the general continuous casting and rolling process, as a process of performing a rapid water cooling process immediately after hot rolling, a rod having an outer diameter of 23 mm was formed by a continuous casting and rolling process, and immediately the rod was put into a water bath (Process c2). A surface temperature of the rod immediately before the rod was put into the water bath was about 650° C. An average cooling rate from 850 to 600° C. was about 15° C./second, and an average cooling rate from 850 to 400° C. was about 24° C./second. After the rod was produced by the continuous casting and rolling process, Process c21 to Process c24 were performed in the same manner as Process c11 to Process c14.

As a process in which a cooling rate after hot rolling is lower than the producing condition, a process in which a cooling manner was air cooling after a rolling process was performed (Process c3). An average cooling rate from 850 to 400° C. was about 8° C./second. After the rod was produced by the continuous casting and rolling process, Process c31 to Process c34 were performed in the same manner as Process c11 to Process c14.

A plurality of processes in which a hot rolling start temperature was changed was performed. As a process in which a hot rolling start temperature is lower than the producing condition, Process c4 in which a start temperature was 850° C. was performed. After rolling, Process c41 and Process c42 were performed in the same manner as Process c11 and Process c12. At that time, after Process c4, the rod was drawn by a cold drawing process so that the outer diameter was 20 mm, and a heat treatment TH1 at 480° C. for 8 hours was performed for washing (Process C51). As a process in which a hot rolling start temperature is higher than the producing condition, Process c7 in which a start temperature was 1025° C. was performed, but the producing process was stopped since breaking occurred in the initial stage of rolling. As a process in which a hot rolling start temperature falls within the producing condition, Process c6 in which a start temperature was 930° C. was performed. After rolling, Process c61 and Process c62 were performed in the same manner as Process c11 and Process c12.

In C1100, wires and rods were produced by Producing Processes ZA, ZB, and ZC corresponding to Producing Processes A, B, and C. FIG. 4 shows a configuration of Producing Processes ZA, ZB, and ZC. C1100 is pure copper including oxygen of about 0.03 mass %, and generates copper oxide ($Cu_2O$) as a crystalline material. However, precipitates are not generated, and thus the heat treatment TH1 for precipitation is not performed in Producing Processes ZA, ZB, and ZC in the same manner as the general producing process of C1100. In Producing Process ZA, a rod having an outer diameter of 8 mm was produced by a continuous casting and rolling process, the rod was drawn by a cold wire drawing process so that the outer diameter was 2 mm (Process ZA1), the rod was further drawn by a cold wire drawing process so that the outer diameter was 0.8 mm (Process ZA3), and subsequently a heat treatment TH2 at 300° C. for 5 seconds was performed (Process ZA4). In Producing Process ZB, a rod having an outer diameter of 11 mm was produced by a continuous casting and rolling process, and subsequently the rod was drawn by a cold wire drawing process so that the outer diameter was 2 mm (Process ZB1). In Producing Process ZC, a rod having an outer diameter of 23 mm was produced by a continuous casting and rolling process, and subsequently the rod was drawn by a cold drawing process so that the outer diameter was 20 mm (Process ZC1).

As a comparative process for producing rods and wires, Producing Processes G and H including a complete solution-precipitate process were performed. FIG. 5 shows a configuration of Processes G and H. In Producing Process G, a solution heat treatment at 900° C. for 10 minutes was performed on a rod having an outer diameter of 8 mm, a water cooling process was performed, a heat treatment TH1 at 500° C. for 4 hours was performed, the rod was drawn by a cold wire drawing process so that the outer diameter was 2 mm (Process G1), a heat treatment TH2 at 305° C. for 30 minutes was performed (Process G2), the rod was drawn by a cold wire drawing process so that the outer diameter was 0.8 mm, and subsequently a heat treatment TH2 at 500° C. for 5 seconds was performed (Process G3). In Producing Process H, a solution heat treatment at 900° C. for 10 minutes was performed on a rod having an outer diameter of 23 mm, a water cooling process was performed, a heat treatment TH1 at 500° C. for 4 hours was performed, and subsequently the rod was drawn by a cold drawing process so that the outer diameter was 20 mm (Process H1).

The above-described test was performed by actual production equipment, but a laboratory test was performed separately from the actual equipment test. Table 2 shows an alloy composition on which the laboratory test is performed, and FIG. 6 shows a producing process in the laboratory test.

In the laboratory test, a plate-shaped casting having a thickness of 50 mm was produced, the casting was heated at 970° C., a plate rolling was performed to be thicknesses of 6 mm and 15 mm, plates are cut from them, and subsequently a rod and a wire having outer diameters of 14.5 mm and 5.6 mm were produced by a lathe process. At that time, average cooling rates from 850 to 400° C. were about 15° C./second and about 19° C./second, respectively. Subsequently, a wire and a rod were produced by Producing Processes E and F. In Producing Process E, a heat treatment TH1 at 500° C. for 4 hours was performed on the wire having the outer diameter of 5.6 mm, the wire was drawn by a cold wire drawing process so that the outer diameter was 1.4 mm (Process E1), and subsequently a heat treatment TH2 at 450° C. for 10 seconds was performed (Process E2). In Producing Process F, the rod having the outer diameter of 14.5 mm was drawn by a cold drawing process so that the outer diameter was 12.6 mm (Process F1), and subsequently a heat treatment TH1 at 475° C. for 8 hours was performed (Process F2).

In comparative C1100, wires and rods were produced by Producing Processes ZE and ZF corresponding to Producing Processes E and F. In Producing Processes ZE and ZF, the heat treatment TH1 for precipitation was not performed in the same manner as the above-described actual equipment test.

As assessment of the high performance copper rod or wire produced by the above-described method, tensile strength, Vickers hardness, elongation, Rockwell hardness, the number of repetitive bending times, conductivity, 400° C. high-temperature tensile strength, and Rockwell hardness and conductivity after cold compression were measured. In addition, a recrystallization ratio, a grain size, a diameter of precipitates, and a ratio of precipitates having a size of 30 nm or less were measured by observing a metal structure. In addition, conductivity and Rockwell hardness after a cold compression were measured for the rod in Process c12. In addition, a high-temperature heating test at 700° C. for 30 seconds and 100 seconds was performed using a rod or wire and a compression-processed material.

Measurement of tensile strength was performed as follows. As for a shape of test pieces, in rods, 14A test pieces of (square root of sectional area of test piece parallel

TABLE 2

| | Alloy | Alloy Composition (mass %) | | | | | | | | | | | | | |
|---|---|---|---|---|---|---|---|---|---|---|---|---|---|---|---|
| | No. | Cu | P | Co | Sn | O | Ni | Fe | Zn | Mg | Ag | Zr | X1 | X2 | X3 |
| First | 31 | Rem. | 0.058 | 0.20 | 0.05 | 0.0009 | | | | | | | 3.86 | | |
| Inv. | 32 | Rem. | 0.052 | 0.15 | 0.06 | 0.0009 | | | | | | | 3.25 | | |
| Alloy | | | | | | | | | | | | | | | |
| Second | 33 | Rem. | 0.059 | 0.19 | 0.18 | 0.0009 | | 0.03 | | | | | | 4.03 | 0.09 |
| Inv. | 34 | Rem. | 0.062 | 0.18 | 0.42 | 0.0007 | 0.05 | | 0.31 | | | | | 3.99 | 0.08 |
| Alloy | 35 | Rem. | 0.072 | 0.25 | 0.03 | 0.0008 | 0.09 | 0.02 | | | | | | 5.23 | 0.20 |
| Third | 36 | Rem. | 0.057 | 0.19 | 0.05 | 0.0008 | | | 0.03 | 0.08 | | | 3.73 | | |
| Inv. | 37 | Rem. | 0.060 | 0.20 | 0.02 | 0.0009 | | | | | | 0.03 | 3.71 | | |
| Alloy | 38 | Rem. | 0.075 | 0.27 | 0.03 | 0.0008 | | | 0.02 | | | | 3.93 | | |
| | 110 | Rem. | 0.060 | 0.21 | 0.04 | 0.0008 | | | | | 0.06 | | 3.90 | | |
| Comp. | 41 | Rem. | 0.042 | 0.29 | 0.08 | 0.0009 | | | | | | | 8.32 | | |
| Alloy | 42 | Rem. | 0.064 | 0.13 | 0.09 | 0.0009 | 0.12 | 0 07 | | | | | | 4.96 | 0.39 |
| | 43 | Rem. | 0.130 | 0.24 | 0.12 | 0.0007 | | | | | | | 1.91 | | |
| | 44 | Rem. | 0.079 | 0.28 | 0.96 | 0.0008 | | | | | | | 3.85 | | |
| C1100 | 51 | Rem. | | | | 0.03 | | | | | | | | | |

X1 = ([Co] − 0.007)/([P] − 0.008)

X2 = ([Co] + 0.85[Ni] + 0.75[Fe] − 0.007)/([P] − 0.008)

X3 = 1.5[Ni] + 3[Fe]

portion)×5.65 as a gauge length of JIS Z 2201 were used. In wires, 9B test pieces of 200 mm as a gauge length of JIS Z 2201 were used.

Measurement of the number of repetitive bending times was performed as follows. A diameter R of a bending part was 2×D (diameter of product) mm, bending was performed by 90 degrees, the time of returning to an original position was defined as once, and additionally bending was performed on the opposite side by 90 degrees, which were repeated until breaking.

In measurement of conductivity, a conductivity measuring device (SIGMATEST D2. 068) manufactured by FOERSTER JAPAN limited was used in case of rods having a diameter of 8 mm or more and of cold compression test pieces. In case of wires and rods having a diameter less than 8 mm, conductivity was measured according to JIS H 0505. At that time, in measurement of electric resistance, a double bridge was used. In this specification, "electrical conductivity" and "conductivity" are used as the same meaning.

Measurement of 400° C. high-temperature tensile strength was performed as follows. After being kept at 400° C. for 30 minutes, a high-temperature tensile test was performed. A gauge length was 50 mm, and a test part was processed by lathe machining of ϕ10 mm.

Cold compression was performed as follows. Rods of Processes c1, c11, c12, c13, and c14 were cut by a length of 35 mm, and compressed to 7 mm (processing rate of 80%) by the Amsler type all-round tester. After the compression, the rods of Processes c1 and c13 were subjected to a heat treatment of 440° C.×60 minutes as an after-process heat treatment, and Rockwell hardness and conductivity were measured. Rods of Processes F1 and F2 were cut by a length of 20 mm, and compressed to 4 mm (processing rate of 80%) by the Amsler type all-round tester. After the compression, the rod of Process F1 was subjected to a heat treatment of 440° C.×60 minutes as an after-process heat treatment, and Rockwell hardness and conductivity were measured. C1100 was not subjected to a heat treatment since it is softened and recrystallized by a heat treatment.

Measurement of non-recrystallization ratios was performed as follows. Metal microscope structure photographs of 100-fold magnification, 200-fold magnification, or 500-fold magnification were used. When it was difficult to distinguish recrystallization and non-recrystallization, an area in which a length in a drawing direction is three times or more a length in a direction perpendicular to the drawing direction was set as a non-recrystallization area, as an area surrounded with a grain boundary of an orientation difference of 15 degree or higher from a crystal grain map by EBSP (Electron Backscatter Diffraction Pattern) of 200-fold magnification, 500-fold magnification, or 1000-fold magnification, an area ratio of the area was measured by image analysis (binarized by image processing software "WinROOF"), and the obtained value was set as a non-recrystallization ratio. EBSP consists of a device in which FE-SEM (Field Emission Scanning Electron Microscope, Product No. JSM-7000F FE-SEM) of JEOL, Ltd. is equipped with OIM (Orientation Imaging Microscopy: Crystal Orientation Analyzer, Product No. TSL-OIM 5.1) of TSL Solutions K.K.

Measurement of grain size was performed from optical microscope photographs on the basis of methods for estimating average grain size of wrought copper in JIS H 0501.

In measurement of diameters of precipitates, transmission electron images of TEM (Transmission Electron Microscope) of 150,000-fold magnification were binarized by the above-described "WinROOF" to extract precipitates, and an average value of areas of the precipitates was calculated, thereby measuring an average grain size. As for the measurement position, assuming that R is a radius in the rod or wire, two points at positions of 1R/2 and 6R/7 from the center of the rod or wire were taken, and then an average value thereof was calculated. When a dislocation density is high in a metal structure, it is difficult to measure the size of precipitates. Accordingly, measurement was performed mainly using the rod or wire in which the heat treatment TH1 was performed on the continuous casting and rolling material, for example, the rod or wire on which the process c11 was completed. As for the high-temperature heating test performed at 700° C., measurement was performed at the partially recrystallized parts. Although a ratio of the number of precipitates of 30 nm or less was performed from each grain diameter of precipitates, the size can be precisely measured only up to about 2.5 nm in the transmission electron images of TEM of 150,000-fold magnification. Accordingly, it becomes a ratio in precipitates lager than 2.5 nm. When the sizes of the precipitates are as small as about 7 nm or less, the observation was performed in 750,000-fold magnification. When the observation was performed by the TEM of 750,000-fold magnification, the limit of relatively precisely identifiable precipitates is 0.7 nm. Accordingly, even in the average size of the precipitates and the ratio of the precipitates of less than 30 nm, the precipitates of 0.7 nm or more are a target.

Measurement of wear resistance was performed as follows. A rod having an outer diameter of 20 mm was subjected to a cutting process, a punching process, and the like, and thus a ring-shaped test piece having an outer diameter of 19.5 mm and a thickness (axial directional length) of 10 mm was obtained. Then, the test piece was fitted and fixed to a rotation shaft, and a roll (outer diameter of 60.5 mm) manufactured by SUS304 consisting of Cr of 18 mass %, Ni of 8 mass %, and Fe as the remainder was brought into rotational contact with an outer peripheral surface of the ring-shaped test piece with load of 5 kg applied, and the rotation shaft was rotated at 209 rpm while multi oil was dripped onto the outer peripheral surface of the test piece (in early stage of test, the test surface excessively got wet, and then the multi oil was supplied by dripping 10 mL per day). The rotation of the test piece was stopped at the time when the number of rotations of the test piece reached 100,000 times, and a difference in weight before and after the rotation of the test piece, that is, abrasion loss (mg) was measured. It can be said that wear resistance of copper alloy is higher as the abrasion loss is less.

A high-temperature heating test was performed as follows. A rod or wire was immersed in a salt bath (NaCl and $CaCl_2$ are mixed at about 3:2) of 700° C. for 30 seconds, a water cooling process was performed. Then, conductivity, a metal structure, an average grain diameter of precipitates, and Vickers hardness were measured. For some parts, tensile strength, elongation, and Rockwell hardness were also measured. The high-temperature heating test was performed in any one of the following three conditions by a sample. In addition, as the sample of the high-temperature heating test, as for a rod or wire, an outer diameter of completion of each process was as it was, a rod or wire cut by a length of 35 mm was used, and a sample after the cold compression test was used as the cold compression material. In the tensile strength test performed in a part, an outer diameter at completion of each process was as it was, and a length of a test piece was 300 mm. Since the length and volume were increased, they were immersed in a salt bath for 100 seconds and then a water cooling process was performed as for tensile test pieces.

Condition 1: a rod or wire at completion of each process

Condition 2: the cold compression is performed on a rod or wire at completion of each process Condition 3: the cold compression is performed on a rod or wire at completion of each process, and a heat treatment of 440° C.×60 minutes (the same as [0097]) is performed In each table of test results to be described later, a test condition of each sample is represented by these numerals of 1 to 3, in a column of "process before heating" in a test item of "heat resistance at 700° C. for 30 seconds".

As for the above-described test, the results of the laboratory test will be described firstly. Tables 3 and 4 show the result in Process E1. In the tables, the first invention alloy, the second invention alloy, and the third invention alloy are represented by the first, the second, and the third; comparative alloy is represented by comparative; and C1100 is represented by C (the same in the following tables). The size of precipitated grains described in Processes E1 and E2 in the tables was examined in the step of an outer diameter of 5.6 mm.

TABLE 3

| | | | | Rolling Completion | | | After Final Process | | | | | | | | |
|---|---|---|---|---|---|---|---|---|---|---|---|---|---|---|---|
| | | | | | Non- | | | Precipitates | | | | After Final Process | | |
| | Alloy No. | Proc. | Test No. | Wire Outer Diameter Mm | recrystal-lization Ratio % | Avg. Grain Size μm | Final Outer Diameter mm | Avg. Grain Diameter nm | Ratio of 30 nm or less % | Tensile Strength N/mm$^2$ | Vickers Hardness HV | Elon-gation % | Rockwell Hardness HRB | Repet-itive Bending Times |
| First | 31 | E1 | 1 | 5.6 | 35 | 15 | 1.4 | 4.3 | 99 | 584 | 155 | | | 16 |
| | 32 | E1 | 2 | 5.6 | 20 | 18 | 1.4 | 5.8 | 98 | 536 | 147 | | | 16 |
| Second | 33 | E1 | 3 | 5.6 | 30 | 10 | 1.4 | | | 593 | 160 | | | 16 |
| | 34 | E1 | 4 | 5.6 | 35 | 7.5 | 1.4 | 5.2 | 100 | 614 | 163 | | | 15 |
| Third | 36 | E1 | 5 | 5.6 | 30 | 15 | 1.4 | | | 571 | 153 | | | 16 |
| | 37 | E1 | 6 | 5.6 | 45 | 15 | 1.4 | 3.8 | 99 | 555 | 152 | | | 17 |
| | 110 | E1 | 7 | 5.6 | 45 | 12 | 1.4 | | | 598 | 158 | | | 17 |
| Comp. | 41 | E1 | 8 | 5.6 | 7.5 | 35 | 1.4 | 21 | 80 | 478 | 140 | | | 14 |
| | 42 | E1 | 9 | 5.6 | 12.5 | 23 | 1.4 | 22 | 85 | 493 | 142 | | | 13 |
| | 43 | E-F | 10 | Large breaking occurred in hot rolling materials, and thus the following process was stopped. | | | | | | | | | | |
| | 44 | E-F | 11 | Large breaking occurred in hot rolling materials, rolling load was large, and thus the process was stopped. | | | | | | | | | | |
| C | 51 | ZE1 | 12 | 5.6 | 0 | 50 | 1.4 | $Cu_2O$ formed | | 397 | 108 | | | 13 |

TABLE 4

| | | | | After Final Process | | | | | | Heat Resistance at 700° C. for 30 seconds | | | | | |
|---|---|---|---|---|---|---|---|---|---|---|---|---|---|---|---|
| | | | | | | | 400° C. | After | | | | | | Precipitates | |
| | Alloy No. | Proc. | Test No. | Conduc-tivity % IACS | Wire Perfor-mance Index I1 | Rod Perfor-mance Index I2 | High-Temp. Tensile Strength N/mm$^2$ | Cold Compression Hard-ness HRB | Cold Compression Conduc-tivity % IACS | Process Before Heating | Vickers Hard-ness HV | Recrystal-lization Ratio % | Conduc-tivity % IACS | Avg. Grain Diam-eter nm | Ratio of 30 nm or less % |
| First | 31 | E1 | 1 | 75 | 5058 | | | | | | | | | | |
| | 32 | E1 | 2 | 71 | 4516 | | | | | | | | | | |
| Second | 33 | E1 | 3 | 64 | 4744 | | | | | | | | | | |
| | 34 | E1 | 4 | 57 | 4636 | | | | | | | | | | |
| Third | 36 | E1 | 5 | 75 | 4945 | | | | | | | | | | |
| | 37 | E1 | 6 | 74 | 4774 | | | | | | | | | | |
| | 110 | E1 | 7 | 74 | 5144 | | | | | | | | | | |
| Comp. | 41 | E1 | 8 | 60 | 3703 | | | | | | | | | | |
| | 42 | E1 | 9 | 62 | 3882 | | | | | | | | | | |
| | 43 | E-F | 10 | | | | | | | | | | | | |
| | 44 | E-F | 11 | | | | | | | | | | | | |
| C | 51 | ZE1 | 12 | 100 | 3970 | | | | | | | | | | |

In C1100, the result of Process ZE1 which was not subjected to the heat treatment TH1 is represented. In the invention alloy, a non-recrystallization ratio after hot rolling is high and a grain size is small, as compared with the comparative alloy or C1100. In the invention alloy, an average grain diameter of precipitates is small and a ratio of precipitates of 30 nm or less is high after a wire drawing process, as compared with the comparative alloy or C1100. In addition, tensile strength, Vickers hardness, the number of repetitive bending times, and a wire performance index I1 show satisfactory results. Conductivity of the comparative alloy is as low as about 60% of C1100, but conductivity of the invention alloy is as high as about 80% of C1100. In the comparative alloy of Alloy No. 43 and 44, the contents of P and Sn were high. Accordingly, they could not be processed into a wire since breaking occurred at the time of hot rolling.

Tables 5 and 6 show the result in Process E2.

In C1100, the result of Process ZE1 which was not subjected to the heat treatments TH1 and TH2 is represented. Similarly to the result of Process E1, also in the result of Process E2, the invention alloy showed satisfactory tensile strength, Vickers hardness, the number of repetitive bending times, and a wire performance index I1, as compared with the comparative alloy or C1100. Conductivity of the comparative alloy is as low as about 60% of C1100, but conductivity of the invention alloy is as high as about 75% of C1100. After Process E2, tensile strength becomes slightly lower than that after Process E1, but the number of repetitive bending times is improved. As described above, the invention alloy is high strength and high conductivity alloy, and particularly, in case of a preferable range of the formulas, the ranges of X1, X2, and X3, and the composition range, a wire performance index I1 is high (Alloys 32 and 35 are slightly inferior).

Tables 7 and 8 show the result in Process F1.

TABLE 5

| | | | | Rolling Completion | | | After Final Process | | | | | | | |
|---|---|---|---|---|---|---|---|---|---|---|---|---|---|---|
| | | | | | Non- | | | Precipitates | | | | After Final Process | | |
| | Alloy No. | Proc. | Test No. | Wire Outer Diameter Mm | recrystal-lization Ratio % | Avg. Grain Size μm | Final Outer Diameter mm | Avg. Grain Diameter nm | Ratio of 30 nm or less % | Tensile Strength N/mm$^2$ | Vickers Hardness HV | Elon-gation % | Rockwell Hardness HRB | Repet-itive Bending Times |
| First | 31 | E2 | 21 | 5.6 | 35 | 15 | 1.4 | | | 528 | 144 | | | 19 |
| | 32 | E2 | 22 | 5.6 | 20 | 18 | 1.4 | | | 517 | 145 | | | 21 |
| Second | 33 | E2 | 23 | 5.6 | 30 | 10 | 1.4 | | | 550 | 155 | | | 21 |
| | 34 | E2 | 24 | 5.6 | 35 | 7.5 | 1.4 | | | 582 | 157 | | | 19 |
| | 35 | E2 | 25 | 5.6 | 30 | 13 | 1.4 | 7.2 | 94 | 538 | 146 | | | 18 |
| Third | 36 | E2 | 26 | 5.6 | 30 | 15 | 1.4 | | | 542 | 146 | | | 18 |
| | 37 | E2 | 27 | 5.6 | 45 | 15 | 1.4 | | | 517 | 143 | | | 20 |
| | 38 | E2 | 28 | 5.6 | 35 | 15 | 1.4 | | | 588 | 158 | | | 19 |
| | 110 | E2 | 29 | 5.6 | 45 | 12 | 1.4 | | | 554 | 150 | | | 22 |
| Comp. | 41 | E2 | 30 | 5.6 | 7.5 | 35 | 1.4 | | | 444 | 133 | | | 16 |
| | 42 | E2 | 31 | 5.6 | 12.5 | 23 | 1.4 | | | 450 | 134 | | | 15 |
| C | 51 | ZE1 | 32 | 5.6 | 0 | 50 | 1.4 | $Cu_2O$ formed | | 397 | 108 | | | 13 |

TABLE 6

| | | | | After Final Process | | | | | | Heat Resistance at 700° C. for 30 seconds | | | | | |
|---|---|---|---|---|---|---|---|---|---|---|---|---|---|---|---|
| | | | | | | | 400° C. | After | | | | | | Precipitates | |
| | Alloy No. | Proc. | Test No. | Conduc-tivity % IACS | Wire Perfor-mance Index I1 | Rod Perfor-mance Index I2 | High-Temp. Tensile Strength N/mm$^2$ | Cold Compression Hard-ness HRB | Cold Compression Conduc-tivity % IACS | Process Before Heating | Vickers Hard-ness HV | Recrystal-lization Ratio % | Conduc-tivity % IACS | Avg. Grain Diam-eter nm | Ratio of 30 nm or less % |
| First | 31 | E2 | 21 | 79 | 4693 | | | | | | | | | | |
| | 32 | E2 | 22 | 76 | 4507 | | | | | | | | | | |
| Second | 33 | E2 | 23 | 69 | 4569 | | | | | | | | | | |
| | 34 | E2 | 24 | 62 | 4504 | | | | | | | | | | |
| | 35 | E2 | 25 | 70 | 4501 | | | | | | | | | | |
| Third | 36 | E2 | 26 | 79 | 4817 | | | | | | | | | | |
| | 37 | E2 | 27 | 79 | 4595 | | | | | | | | | | |
| | 38 | E2 | 28 | 79 | 5226 | | | | | | | | | | |
| | 110 | E2 | 29 | 77 | 4861 | | | | | | | | | | |
| Comp. | 41 | E2 | 30 | 63 | 3524 | | | | | | | | | | |
| | 42 | E2 | 31 | 64 | 3600 | | | | | | | | | | |
| C | 51 | ZE1 | 32 | 100 | 3970 | | | | | | | | | | |

TABLE 7

| | Alloy No. | Proc. | Test No. | Rolling Completion: Wire Outer Diameter mm | Rolling Completion: Non-recrystallization Ratio % | Rolling Completion: Avg. Grain Size μm | After Final Process: Final Outer Diameter mm | After Final Process: Precipitates: Avg. Grain Diameter nm | After Final Process: Precipitates: Ratio of 30 nm or less % | After Final Process: Tensile Strength N/mm² | After Final Process: Vickers Hardness HV | After Final Process: Elongation % | After Final Process: Rockwell Hardness HRB | After Final Process: Repetitive Bending Times |
|---|---|---|---|---|---|---|---|---|---|---|---|---|---|---|
| First | 33 | F1 | 41 | 14.5 | 20 | 25 | 12.6 | | | 346 | | 19 | 40 | |
| Third | 36 | F1 | 42 | 14.5 | 20 | 25 | 12.6 | | | 335 | | 22 | 38 | |
| Comp. | 41 | F1 | 43 | 14.5 | 0 | 55 | 12.6 | | | 345 | | 19 | 37 | |
| | 43 | E, F | 44 | Large breaking occurred in hot rolling materials, and thus the following process was stopped. | | | | | | | | | | |
| | 44 | E, F | 45 | Large breaking occurred in hot rolling materials, rolling load was large, and thus the process was stopped. | | | | | | | | | | |
| C | 51 | ZF1 | 46 | 14.5 | 0 | 90 | 12.6 | $CU_2O$ formed | | 319 | | 18 | 44 | |

TABLE 8

| | Alloy No. | Proc. | Test No. | After Final Process: Conductivity % IACS | After Final Process: Wire Performance Index I1 | After Final Process: Rod Performance Index I2 | After Final Process: 400° C. High-Temp. Tensile Strength N/mm² | After Final Process: After Cold Compression: Hardness HRB | After Final Process: After Cold Compression: Conductivity % IACS | Heat Resistance at 700° C. for 30 seconds: Process Before Heating | Heat Resistance at 700° C. for 30 seconds: Vickers Hardness HV | Heat Resistance at 700° C. for 30 seconds: Recrystallization Ratio % | Heat Resistance at 700° C. for 30 seconds: Conductivity % IACS | Heat Resistance at 700° C. for 30 seconds: Precipitates: Avg. Grain Diameter nm | Heat Resistance at 700° C. for 30 seconds: Precipitates: Ratio of 30 nm or less % |
|---|---|---|---|---|---|---|---|---|---|---|---|---|---|---|---|
| First | 33 | F1 | 41 | 53 | | 2998 | | 86 | 70 | 3 | 112 | 12 | 62 | | |
| Third | 36 | F1 | 42 | 55 | | 3031 | | 84 | 75 | | | | | | |
| Comp. | 41 | F1 | 43 | 53 | | 2989 | | 76 | 59 | | | | | | |
| | 43 | E, F | 44 | | | | | | | | | | | | |
| | 44 | E, F | 45 | | | | | | | | | | | | |
| C | 51 | ZF1 | 46 | 100 | | 3764 | | | | | | | | | |

In C1100, the result of Process ZF1 corresponding to Process F1 is represented. In the invention alloy, tensile strength is satisfactory, as compared with C1100. However, elongation and Rockwell hardness are equivalent to those of C1100, and conductivity is as low as 50% of C1100. In addition, in the invention alloy, tensile strength, elongation, Rockwell hardness, conductivity, and a rod performance index I2 are equivalent to those of the comparative alloy, and Rockwell hardness and conductivity after cold compression are satisfactory.

Tables 9 and 10 show the result in Process F2.

TABLE 9

| | Alloy No. | Proc. | Test No. | Rolling Completion: Wire Outer Diameter Mm | Rolling Completion: Non-recrystallization Ratio % | Rolling Completion: Avg. Grain Size μm | After Final Process: Final Outer Diameter mm | After Final Process: Precipitates: Avg. Grain Diameter nm | After Final Process: Precipitates: Ratio of 30 nm or less % | After Final Process: Tensile Strength N/mm² | After Final Process: Vickers Hardness HV | After Final Process: Elongation % | After Final Process: Rockwell Hardness HRB | After Final Process: Repetitive Bending Times |
|---|---|---|---|---|---|---|---|---|---|---|---|---|---|---|
| Second | 33 | F2 | 51 | 14.5 | 20 | 25 | 12.6 | | | 440 | | 23 | 68 | |
| | 35 | F2 | 52 | 14.5 | 20 | 18 | 12.6 | | | 419 | | 21 | 63 | |
| Third | 36 | F2 | 53 | 14.5 | 20 | 25 | 12.6 | | | 428 | | 24 | 65 | |
| | 37 | F2 | 54 | 14.5 | 30 | 35 | 12.6 | | | 443 | | 22 | 69 | |
| | 38 | F2 | 55 | 14.5 | 25 | 20 | 12.6 | | | 450 | | 23 | 70 | |
| | 110 | F2 | 56 | 14.5 | 30 | 20 | 12.6 | | | 456 | | 22 | 70 | |
| Comp. | 41 | F2 | 57 | 14.5 | 0 | 55 | 12.6 | | | 292 | | 38 | 25 | |
| | 42 | F2 | 58 | 14.5 | 0 | 60 | 12.6 | | | 333 | | 33 | 32 | |
| C | 51 | ZF1 | 59 | 14.5 | 0 | 90 | 12.6 | $Cu_2O$ formed | | 319 | | 18 | 44 | |

TABLE 10

| | | | | After Final Process | | | | | | Heat Resistance at 700° C. for 30 seconds | | | | | |
|---|---|---|---|---|---|---|---|---|---|---|---|---|---|---|---|
| | | | | | | | 400° C. | After | | | | | | Precipitates | |
| | Alloy No. | Proc. | Test No. | Conductivity % IACS | Wire Performance Index I1 | Rod Performance Index I2 | High-Temp. Tensile Strength N/mm$^2$ | Cold Compression Hardness HRB | Cold Compression Conductivity % IACS | Process Before Heating | Vickers Hardness HV | Recrystallization Ratio % | Conductivity % IACS | Avg. Grain Diameter nm | Ratio of 30 nm or less % |
| Second | 33 | F2 | 51 | 70 | | 4528 | 230 | 86 | 70 | 1 | 105 | 15 | 63 | | |
| | 35 | F2 | 52 | 72 | | 4302 | 210 | 83 | 71 | | | | | | |
| Third | 36 | F2 | 53 | 78 | | 4687 | 230 | 85 | 77 | | | | | | |
| | 37 | F2 | 54 | 83 | | 4924 | 233 | 84 | 81 | | | | | | |
| | 38 | F2 | 55 | 79 | | 4920 | 240 | 87 | 77 | | | | | | |
| | 110 | F2 | 56 | 78 | | 4913 | 267 | 87 | 78 | | | | | | |
| Comp. | 41 | F2 | 57 | 65 | | 3249 | 125 | 78 | 64 | | | | | | |
| | 42 | F2 | 58 | 64 | | 3543 | 153 | 80 | 61 | | | | | | |
| C | 51 | ZF1 | 59 | 100 | | 3764 | | | | | | | | | |

In C1100, the result of Process ZF1 which was not subjected to the heat treatment TH1 is represented. In the invention alloy, tensile strength, Rockwell hardness, a rod performance index I2, 400° C. high-temperature tensile strength, and Rockwell hardness and conductivity after cold compression are very satisfactory, as compared with the comparative alloy and C1100. As described above, in the invention alloy, performance such as tensile strength is significantly improved after Process F1 by performing a heat treatment (precipitation treatment) at 475° C. for 8 hours.

The results of each comparative alloy of Alloy No. 41 to 44 from Processes E1, E2, F1, and F2 are as follows. In Alloy No. 41 of the comparative alloy, a ratio of Co, P, and the like is not satisfactory, and thus conductivity is low. In addition, since grain diameters of precipitates are large, non-recrystallized grains are hardly generated and strength is low. In addition, since grain diameters of precipitates are large, high-temperature strength is low.

In Alloy No. 42 of the comparative alloy, to contain a more amount of Fe and Ni than a predetermined amount, grain diameters of precipitates are large, and forms of precipitates may be changed. As a result, generation of non-recrystallized parts does not progress, and strength and high-temperature strength is low.

In Alloy No. 43 of the comparative alloy, a ratio of Co, P, and the like is not satisfactory, the content of P is over the range described in Claim, and thus large breaking occurred in a hot state.

In Alloy No. 44 of the comparative alloy, the content of Sn is large, and rolling load was increased in the course of rolling by 70% of the case of C1100. Accordingly, the rolling was stopped.

Next, the result of the actual equipment test will be described. Tables 11 and 12 show the results in Processes a1, a2, a3, b1, and b11.

TABLE 11

| | | | | Rolling Completion | | | After Final Process | | | | | | | |
|---|---|---|---|---|---|---|---|---|---|---|---|---|---|---|
| | | | | | | | | Precipitates | | | | After Final Process | | |
| | Alloy No. | Proc. | Test No. | Wire Outer Diameter mm | Non-recrystallization Ratio % | Avg. Grain Size μm | Final Outer Diameter mm | Avg. Grain Diameter nm | Ratio of 30 nm or less % | Tensile Strength N/mm$^2$ | Vickers Hardness HV | Elongation % | Rockwell Hardness HRB | Repetitive Bending Times |
| First | 1 | a1 | 61 | 8 | 35 | 10 | | | | | | | | |
| | 2 | a1 | 62 | 8 | 45 | 10 | | | | | | | | |
| Second | 5 | a1 | 63 | 8 | 55 | 7.5 | | | | | | | | |
| Third | 6 | a1 | 64 | 8 | 45 | 10 | | | | | | | | |
| | 7 | a1 | 65 | 8 | 45 | 7.5 | | | | | | | | |
| Comp. | 11 | a1 | 66 | 8 | 7.5 | 25 | | | | | | | | |
| | 12 | a1 | 67 | 8 | 7.5 | 25 | | | | | | | | |
| First | 1 | a2 | 68 | 8 | 35 | 10 | 8 | 5.2 | 98 | | | | | |
| | 2 | a2 | 69 | 8 | 45 | 10 | 8 | 4.8 | 100 | | | | | |
| Third | 6 | a2 | 70 | 8 | 45 | 10 | 8 | 4.6 | 99 | | | | | |
| | 7 | a2 | 71 | 8 | 45 | 7.5 | 8 | 4.4 | 99 | | | | | |
| Comp. | 11 | a2 | 72 | 8 | 7.5 | 25 | 8 | 17 | 94 | | | | | |
| | 12 | a2 | 73 | 8 | 7.5 | 25 | 8 | 22 | 94 | | | | | |
| First | 1 | a3 | 74 | 8 | 35 | 10 | 2 | | | 530 | 146 | | | 17 |
| | 2 | a3 | 75 | 8 | 45 | 10 | 2 | | | 551 | 150 | | | 16 |
| Third | 7 | a3 | 76 | 8 | 45 | 7.5 | 2 | | | 570 | 155 | | | 17 |
| Comp. | 11 | a3 | 77 | 8 | 7.5 | 25 | 2 | | | 445 | 130 | | | 15 |
| | 12 | a3 | 78 | 8 | 7.5 | 25 | 2 | | | 453 | 130 | | | 15 |
| C | 21 | ZA1 | 79 | 8 | 0 | 35 | 2 | 3000 | 0 | 411 | 118 | | | 13 |
| First | 3 | b1 | 80 | 11 | 40 | 15 | | | | | | | | |
| | 101 | b1 | 81 | 11 | 45 | 12 | | | | | | | | |

TABLE 11-continued

| | Alloy No. | Proc. | Test No. | Rolling Completion: Wire Outer Diameter mm | Rolling Completion: Non-recrystallization Ratio % | Rolling Completion: Avg. Grain Size μm | After Final Process: Final Outer Diameter mm | After Final Process: Precipitates: Avg. Grain Diameter nm | After Final Process: Precipitates: Ratio of 30 nm or less % | After Final Process: Tensile Strength N/mm² | After Final Process: Vickers Hardness HV | After Final Process: Elongation % | After Final Process: Rockwell Hardness HRB | After Final Process: Repetitive Bending Times |
|---|---|---|---|---|---|---|---|---|---|---|---|---|---|---|
| Second | 4 | b1 | 82 | 11 | 35 | 12 | | | | | | | | |
| | 102 | b1 | 83 | 11 | 50 | 13 | | | | | | | | |
| Third | 103 | b1 | 84 | 11 | 45 | 12 | | | | | | | | |
| Comp. | 104 | b1 | 85 | 11 | 7.5 | 20 | | | | | | | | |
| Second | 4 | b11 | 86 | 11 | 35 | 12 | 2 | | | 606 | 162 | | | 16 |
| C | 21 | ZB1 | 87 | 11 | 0 | 45 | 2 | | | 417 | 120 | | | 14 |

TABLE 12

| | Alloy No. | Proc. | Test No. | After Final Process: Conductivity % IACS | After Final Process: Wire Performance Index I1 | After Final Process: Rod Performance Index I2 | After Final Process: 400° C. High-Temp. Tensile Strength N/mm² | After Final Process: After Cold Compression: Hardness HRB | After Final Process: After Cold Compression: Conductivity % IACS | Heat Resistance at 700° C. for 30 seconds: Process Before Heating | Heat Resistance at 700° C. for 30 seconds: Vickers Hardness HV | Heat Resistance at 700° C. for 30 seconds: Recrystallization Ratio % | Heat Resistance at 700° C. for 30 seconds: Conductivity % IACS | Heat Resistance at 700° C. for 30 seconds: Precipitates: Avg. Grain Diameter nm | Heat Resistance at 700° C. for 30 seconds: Precipitates: Ratio of 30 nm or less % |
|---|---|---|---|---|---|---|---|---|---|---|---|---|---|---|---|
| First | 1 | a1 | 61 | | | | | | | | | | | | |
| | 2 | a1 | 62 | | | | | | | | | | | | |
| Second | 5 | a1 | 63 | | | | | | | | | | | | |
| Third | 6 | a1 | 64 | | | | | | | | | | | | |
| | 7 | a1 | 65 | | | | | | | | | | | | |
| Comp. | 11 | a1 | 66 | | | | | | | | | | | | |
| | 12 | a1 | 67 | | | | | | | | | | | | |
| First | 1 | a2 | 68 | | | | | | | | | | | | |
| | 2 | a2 | 69 | | | | | | | | | | | | |
| Third | 6 | a2 | 70 | | | | | | | | | | | | |
| | 7 | a2 | 71 | | | | | | | | | | | | |
| Comp. | 11 | a2 | 72 | | | | | | | | | | | | |
| | 12 | a2 | 73 | | | | | | | | | | | | |
| First | 1 | a3 | 74 | 79 | 4711 | | | | | | | | | | |
| | 2 | a3 | 75 | 75 | 4772 | | | | | 1 | 99 | 20 | 71 | | |
| Third | 7 | a3 | 76 | 72 | 4837 | | | | | | | | | | |
| Comp. | 11 | a3 | 77 | 72 | 3776 | | | | | 1 | 59 | 100 | 67 | | |
| | 12 | a3 | 78 | 69 | 3763 | | | | | | | | | | |
| C | 21 | ZA1 | 79 | 100 | 4110 | | | | | 1 | 38 | 100 | 101 | | |
| First | 3 | b1 | 80 | | | | | | | | | | | | |
| | 101 | b1 | 81 | | | | | | | | | | | | |
| Second | 4 | b1 | 82 | | | | | | | | | | | | |
| | 102 | b1 | 83 | | | | | | | | | | | | |
| Third | 103 | b1 | 84 | | | | | | | | | | | | |
| Comp. | 104 | b1 | 85 | | | | | | | | | | | | |
| Second | 4 | b11 | 86 | 68 | 4997 | | | | | | | | | | |
| C | 21 | ZB1 | 87 | 98 | 4128 | | | | | | | | | | |

In C1100, the result of Process ZA1 is represented with respect to Process a3, and the result of Process ZB1 is represented with respect to Process b11. FIG. 7 shows the observation result of metal structures in C1100 and the invention alloy of Alloy No. 1. FIG. 8 shows the observation result of the precipitates of Alloy No. 2 in Process a2 by a transmission electron microscope.

After the continuous casting and rolling process (Process a1 and Process b1), in the invention alloy, a non-recrystallization ratio is high, and a grain size is small, as compared with those of the comparative alloy. After the heat treatment TH1 (Process a2), in the invention alloy, an average grain diameter of precipitates is small, and a ratio of precipitates of 30 nm or less is high, as compared with those of the comparative alloy. In addition, in the invention alloy, after the drawing process is performed so that the outer diameter is 2 mm (Process a3 and Process b11), tensile strength, Vickers hardness, and a wire performance index I1 are very high, as compared with those of the comparative alloy or C1100.

The wire performance index I1 satisfies the preferable range of 4500 or more, which is preferable for as most of high performance copper rods and wires, and 4700 or more, including the following high performance copper rod or wire according to the invention. In addition, in the invention alloy, the number of repetitive bending times is satisfactory as compared with that of the comparative alloy or C1100. Conductivity of the comparative alloy is about 70% of C1100. On the other hand, conductivity of the invention alloy is about 80% of C1100 and is satisfactory as compared with the comparative alloy. As for heat resistance, in the invention alloy, Vickers hardness is high, and a recrystallization ratio is low, as compared with those of the comparative alloy or C1100. Also, conductivity is high, as compared with that of the comparative alloy.

Tables 13 and 14 show the results in Processes c1, c11, c12, c16 and c17.

TABLE 13

| | | | | Rolling Completion | | | After Final Process | | | | | After Final Process | | |
|---|---|---|---|---|---|---|---|---|---|---|---|---|---|---|
| | | | | | | | | Precipitates | | | | | | |
| | Alloy No. | Proc. | Test No. | Wire Outer Diameter mm | Non-recrystal-lization Ratio % | Avg. Grain Size μm | Final Outer Diameter mm | Avg. Grain Diameter nm | Ratio of 30 nm or less % | Tensile Strength N/mm$^2$ | Vickers Hardness HV | Elon-gation % | Rockwell Hardness HRB | Repet-itive Bending Times |
| First | 2 | c1 | 91 | 23 | 15 | 20 | 23 | | | 273 | | 45 | 16 | |
| | 101 | c1 | 92 | 23 | 30 | 18 | 23 | | | 303 | | 35 | 32 | |
| Second | 102 | c1 | 93 | 23 | 33 | 20 | 23 | | | 298 | | 36 | 28 | |
| Third | 7 | c1 | 94 | 23 | 20 | 18 | 23 | | | 282 | | 42 | 19 | |
| | 103 | c1 | 95 | 23 | 30 | 18 | 23 | | | 314 | | 34 | 32 | |
| Comp. | 11 | c1 | 96 | | 0 | 55 | | | | | | | | |
| | 12 | c1 | 97 | 23 | 0 | 60 | 23 | | | | | | | |
| | 104 | c1 | 98 | 23 | 0 | 35 | 23 | | | | | | | |
| First | 2 | c11 | 99 | 23 | 15 | 20 | 23 | 4.0 | 100 | 342 | | 39 | 49 | |
| | 101 | c11 | 100 | 23 | 30 | 18 | 23 | 3.5 | 100 | 379 | | 37 | 56 | |
| Second | 102 | c11 | 101 | 23 | 33 | 20 | 23 | 3.4 | 100 | 380 | | 37 | 55 | |
| Third | 7 | c11 | 102 | 23 | 20 | 18 | 23 | 3.6 | 100 | 357 | | 37 | 53 | |
| | 103 | c11 | 103 | 23 | 30 | 18 | 23 | 3.5 | 100 | 382 | | 36 | 57 | |
| Comp. | 11 | c11 | 104 | 23 | 0 | 55 | 23 | 16 | 94 | 255 | | 38 | 16 | |
| | 12 | c11 | 105 | 23 | 0 | 60 | 23 | 19 | 95 | 263 | | 39 | 18 | |
| | 104 | c11 | 106 | 23 | 0 | 35 | 23 | 16 | 93 | 288 | | 35 | 25 | |
| First | 2 | c12 | 107 | 23 | 15 | 20 | 20 | | | 408 | | 24 | 62 | |
| | 3 | c12 | 108 | 23 | 20 | 18 | 20 | | | 419 | | 22 | 67 | |
| | 101 | c12 | 109 | 23 | 30 | 18 | 20 | | | 436 | | 23 | 67 | |
| Second | 5 | c12 | 110 | 23 | 25 | 18 | 20 | | | 439 | | 21 | 69 | |
| | 102 | c12 | 111 | 23 | 33 | 20 | 20 | | | 433 | | 24 | 66 | |
| Third | 7 | c12 | 112 | 23 | 20 | 18 | 20 | | | 429 | | 20 | 71 | |
| | 103 | c12 | 113 | 23 | 30 | 18 | 20 | | | 444 | | 22 | 68 | |
| Comp. | 11 | c12 | 114 | 23 | 0 | 55 | 20 | | | 328 | | 20 | 46 | |
| | 12 | c12 | 115 | 23 | 0 | 60 | 20 | | | 332 | | 22 | 48 | |
| | 104 | c12 | 116 | 23 | 0 | 35 | 20 | | | 356 | | 23 | 49 | |
| First | 101 | c16 | 117 | 23 | 30 | 18 | 23 | 21 | 88 | 317 | | 40 | 36 | |
| First | 101 | c17 | 118 | 23 | 30 | 18 | 20 | | | 365 | | 23 | 57 | |
| C | 21 | ZC1 | 119 | 23 | 0 | 70 | 20 | | | 317 | | 19 | 44 | |

TABLE 14

| | | | | After Final Process | | | | | | Heat Resistance at 700° C. for 30 seconds | | | | | |
|---|---|---|---|---|---|---|---|---|---|---|---|---|---|---|---|
| | | | | | | | 400° C. | After | | | | | | Precipitates | |
| | | | | | Rod Perfor- | Abra- | High-Temp. | Cold Compression | | | Vickers | Recrystal- | | Avg. Grain | Ratio of 30 |
| | Alloy No. | Proc. | Test No. | Conduc-tivity % IACS | mance Index I2 | sion Loss mg | Tensile Strength N/mm$^2$ | Hard-ness HRB | Conduc-tivity % IACS | Process Before Heating | Hard-ness HV | lization Ratio % | Conduc-tivity % IACS | Diam-eter nm | nm or less % |
| First | 2 | c1 | 91 | 54 | 2909 | | | 78 | 73 | 2 | 105 | 12 | 71 | 7.9 | 97 |
| | 101 | c1 | 92 | 48 | 2834 | | | 85 | 71 | | | | | | |
| Second | 102 | c1 | 93 | 47 | 2778 | | | 84 | 74 | 2 | 119 | 7.5 | 69 | 6.7 | 98 |
| Third | 7 | c1 | 94 | 56 | 2997 | | | 83 | 72 | | | | | | |
| | 103 | c1 | 95 | 46 | 2854 | | | | | 2 | 117 | 10 | 66 | | |
| Comp. | 11 | c1 | 96 | | | | | | | | | | | | |
| | 12 | c1 | 97 | | | | | | | | | | | | |
| | 104 | c1 | 98 | | | | | | | | | | | | |
| First | 2 | c11 | 99 | 80 | 4252 | | 209 | 82 | 80 | 3 | 104 | 15 | 72 | 8.6 | 96 |
| | 101 | c11 | 100 | 76 | 4527 | | | | | | | | | | |
| Second | 102 | c11 | 101 | 78 | 4598 | | | | | | | | | | |
| Third | 7 | c11 | 102 | 78 | 4320 | | | 85 | 78 | | | | | | |
| | 103 | c11 | 103 | 73 | 4439 | | | | | | | | | | |
| Comp. | 11 | c11 | 104 | 77 | 3088 | | | | | | | | | | |
| | 12 | c11 | 105 | 76 | 3187 | | | | | | | | | | |
| | 104 | c11 | 106 | 81 | 3499 | | | | | | | | | | |
| First | 2 | c12 | 107 | 78 | 4468 | 93 | 221 | 83 | 78 | | | | | | |
| | 3 | c12 | 108 | 76 | 4456 | | 223 | 86 | 75 | 2 | 111 | 12 | 67 | | |
| | 101 | c12 | 109 | 74 | 4613 | | 235 | 88 | 75 | 1 | 114 | 12 | 70 | 7.2 | 97 |
| Second | 5 | c12 | 110 | 79 | 4721 | 66 | 233 | 87 | 78 | | | | | | |
| | 102 | c12 | 111 | 76 | 4681 | | 232 | 86 | 77 | 3 | 115 | 10 | 70 | 7.3 | 97 |

TABLE 14-continued

| | | | | After Final Process | | | | | | Heat Resistance at 700° C. for 30 seconds | | | | | |
|---|---|---|---|---|---|---|---|---|---|---|---|---|---|---|---|
| | | | | | | | 400° C. | After | | | | | | Precipitates | |
| | Alloy No. | Proc. | Test No. | Conductivity % IACS | Rod Performance Index I2 | Abrasion Loss mg | High-Temp. Tensile Strength N/mm$^2$ | Cold Compression Hardness HRB | Cold Compression Conductivity % IACS | Process Before Heating | Vickers Hardness HV | Recrystallization Ratio % | Conductivity % IACS | Avg. Grain Diameter nm | Ratio of 30 nm or less % |
| Third | 7 | c12 | 112 | 80 | 4605 | | 230 | 87 | 79 | 3 | 113 | 10 | 70 | | |
| | 103 | c12 | 113 | 71 | 4564 | | | | | 3 | 109 | 12 | 67 | | |
| Comp. | 11 | c12 | 114 | 75 | 3409 | | 113 | 72 | 74 | 1 | 58 | 100 | 68 | | |
| | 12 | c12 | 115 | 74 | 3484 | | 117 | 73 | 73 | 3 | 60 | 100 | 69 | 34 | 45 |
| | 104 | c12 | 116 | 80 | 3917 | | 146 | 76 | 80 | 3 | 82 | 65 | 71 | 23 | 75 |
| First | 101 | c16 | 117 | 80 | 3969 | | | | | | | | | | |
| First | 101 | c17 | 118 | 79 | 3990 | | 149 | | | 1 | 77 | 80 | 71 | 26 | 65 |
| C | 21 | ZC1 | 119 | 100 | 3772 | 652 | 64 | 63 | 99 | 1 | 39 | 100 | 101 | | |

In Process C for producing the rods, in the invention alloy, a non-recrystallization ratio after the continuous casting and rolling process (Process c1) is as high as 15 to 30%, as compared with that of the comparative alloy of Alloy No. 11 and 12, or C1100 of Alloy No. 21, and a size of recrystallized grains is as small as 18 to 20 μm, as compared with that of the comparative alloy or C1100. After the heat treatment TH1 (Process c11), in the invention alloy, an average grain diameter of precipitates is small, and a ratio of precipitates of less than 30 nm is high, as compared with those of the comparative alloy. In addition, tensile strength, Rockwell hardness, and a rod performance index I2 are very high. The invention alloy is soft after the continuous casting and rolling process of Process c1, but tensile strength and Rockwell hardness become high after the heat treatment TH1 of Process c11. Accordingly, conductivity and a rod performance index I2 are largely improved. The low strength of materials after the continuous casting and rolling process suggests that the materials can be easily formed in a low-power press or cold forging equipment with high precision in size. As described above, the mechanical properties or conductivity of the invention alloy are largely improved by performing the heat treatment TH1. In addition, in the invention alloy, after the rod is drawn so that the outer diameter is 20 mm (Process c12), tensile strength, Rockwell hardness, and a rod performance index I2 are very high, as compared with that of the comparative alloy and C1100.

The rod performance index I2 satisfies the range of 4400 or more, which is preferable for most of high performance copper rods and wires, including the following high performance copper rod or wire according to the invention. In addition, in the invention alloy, elongation is slightly better than that of the comparative alloy or C1100.

In Process c12, in the invention alloy, 400° C. high-temperature tensile strength is twice or more as high as the comparative alloy, and about four times as C1100. Rockwell hardness after cold compression is also satisfactory. As for 700° C. heat resistance, in the invention alloy, Vickers hardness is high, as compared with that of the comparative alloy or C1100. A recrystallization ratio is 45% or lower, and most of ratios are 20% or lower. Conductivity is as low as about 8% IACS, as compared with that of the material before heating, which is subjected to the heat treatment TH1 (Process c12), but conductivity is as high as about 70% IACS. In addition, conductivity is improved by about 20% IACS, as compared with that of the material before heating, which is not subjected to the heat treatment TH1 (Process c1), and conductivity is as high as about 70% IACS. Although a size of precipitates is increased from about 3.5 nm before heating to 7.5 nm after heating, the precipitates are still fine and precipitates with a size of more than 30 nm hardly exist. In case of general precipitation aging type alloy, when it is heated at a high temperature of 700° C., a recrystallization ratio is over 50%, precipitates are coarsened, conductivity is significantly decreased by re-solid solution of elements related to precipitates, and strength is also largely decreased. On the other hand, in the invention alloy, as described above, re-solid solution of elements related to precipitates hardly occurs, and the precipitates are fine, thereby preventing recrystallization. As a result, it is considered that the invention alloy has high strength and high conductivity even when the invention alloy is heated at 700° C. Although not described by numerical values in the tables, abrasion loss of wear resistance evaluated with the rod of Processes c12 and ZC1 is 93 mg in Test No. 107 of the first invention alloy is 66 mg in Test No. 110. On the other hand, abrasion loss is 652 mg in Test No. 119 of C1100. That is, the invention alloy is superior than that of C1100 in view of abrasion loss. In Process c16 in which a heat treatment index TI of the heat treatment TH1 is higher than the producing condition, matrix is softened and precipitates become large. Accordingly, tensile strength, Rockwell hardness, and a rod performance index I2 are significantly decreased as compared with the result in Process c11. In addition, even in Process c17 in which a drawing process is performed thereafter, tensile strength, Rockwell hardness, a rod performance index I2 are significantly decreased, as compared with the result in Process c12. In Process c16, a heat treatment index TI of a heat treatment TH1 is higher than the producing condition, and thus excessive precipitation occurs. Accordingly, strength is hardly improved by precipitation, and tensile strength, Rockwell hardness, a rod performance index I2 are low.

Table 15 shows the result of the high-temperature heating test of heating of rods at 700° C. for 100 seconds in Process c12 and Process c14 of the invention alloy, and in Process ZC1 of C1100.

TABLE 15

| | | | Heating at 700° C. for 100 seconds | | | | | Before Heating | | | |
|---|---|---|---|---|---|---|---|---|---|---|---|
| | Alloy No. | Proc. | Final Diameter mm | Tensile Strength N/mm$^2$ | Elongation (Rod) % | Rockwell Hardness HRB | Conductivity % IACS | Tensile Strength N/mm$^2$ | Elongation (Rod) % | Rockwell Hardness HRB | Conductivity % IACS |
| Second | 5 | C12 | 20 | 407 | 28 | 66 | 72 | 455 | 21 | 73 | 79 |
| | 5 | C14 | 20 | 403 | 33 | 64 | 72 | 446 | 26 | 72 | 82 |
| C | 21 | ZC1 | 20 | 212 | 33 | 8 | 101 | 317 | 19 | 44 | 100 |

In the invention alloy, all of tensile strength, Rockwell hardness, and conductivity are more excellent than those of C1100. Generally, determination whether or not an alloy has heat resistance is determined by whether or not the alloy has 80% of tensile strength of a raw material before heating. The invention alloy has 80% or higher of tensile strength of a raw material, and has 80% or higher of conductivity of the raw material. However, C1100 has only 70% or lower of tensile strength of a raw material, and the tensile strength is lower than that of the invention alloy by 150 N/mm$^2$ or higher.

Tables 16 and 17 show the results in Processes a11, a12, a13, a21, and a31, and Tables 18 and 19 show the result in Processes b12, b13, and b14.

TABLE 16

| | | | | Rolling Completion | | | After Final Process | | | | | | | |
|---|---|---|---|---|---|---|---|---|---|---|---|---|---|---|
| | | | | | | | | Precipitates | | | | After Final Process | | |
| | Alloy No. | Proc. | Test No. | Wire Outer Diameter mm | Non-recrystallization Ratio % | Avg. Grain Size μm | Final Outer Diameter mm | Avg. Grain Diameter nm | Ratio of 30 nm or less % | Tensile Strength N/mm$^2$ | Vickers Hardness HV | Elongation % | Rockwell Hardness HRB | Repetitive Bending Times |
| First | 1 | a11 | 121 | 8 | 35 | 10 | 2 | | | 518 | 145 | | | 20 |
| | 2 | a11 | 122 | 8 | 45 | 10 | 2 | | | 530 | 146 | | | 20 |
| Second | 5 | a11 | 123 | 8 | 55 | 7.5 | 2 | | | 556 | 159 | | | 19 |
| Third | 6 | a11 | 124 | 8 | 45 | 10 | 2 | | | 543 | 148 | | | 19 |
| | 7 | a11 | 125 | 8 | 45 | 7.5 | 2 | | | 543 | 147 | | | 20 |
| Comp. | 11 | a11 | 126 | 8 | 7.5 | 25 | 2 | | | 402 | 116 | | | 17 |
| | 12 | a11 | 127 | 8 | 7.5 | 25 | 2 | | | 408 | 119 | | | 18 |
| First | 2 | a12 | 128 | 8 | 45 | 10 | 0.8 | | | 591 | 157 | | | 25 |
| Comp. | 12 | a12 | 129 | 8 | 7.5 | 25 | 0.8 | | | 459 | 133 | | | 23 |
| C | 21 | ZA3 | 130 | 8 | 0 | 35 | 0.8 | $Cu_2O$ formed | | 420 | 120 | | | 19 |
| First | 2 | a13 | 131 | 8 | 45 | 10 | 0.8 | | | 570 | 153 | | | 29 |
| Third | 7 | a13 | 132 | 8 | 45 | 7.5 | 0.8 | | | 580 | 156 | | | 28 |
| Comp. | 12 | a13 | 133 | 8 | 7.5 | 25 | 0.8 | | | 441 | 126 | | | 25 |
| C | 21 | ZA4 | 134 | | 0 | 35 | 0.8 | | | 365 | 109 | | | 20 |
| First | 1 | a21 | 135 | 8 | 35 | 10 | 0.8 | | | 545 | 150 | | | 26 |
| | 2 | a21 | 136 | 8 | 45 | 10 | 0.8 | | | 565 | 152 | | | 28 |
| Second | 5 | a21 | 137 | 8 | 55 | 7.5 | 0.8 | | | 583 | 156 | | | 26 |
| Third | 6 | a21 | 138 | 8 | 45 | 10 | 0.8 | | | 565 | 153 | | | 27 |
| | 7 | a21 | 139 | 8 | 45 | 7.5 | 0.8 | | | 577 | 155 | | | 27 |
| Comp. | 11 | a21 | 140 | 8 | 7.5 | 25 | 0.8 | | | 450 | 124 | | | 24 |
| | 12 | a21 | 141 | 8 | 7.5 | 25 | 0.8 | | | 447 | 125 | | | 24 |
| First | 1 | a31 | 142 | 8 | 35 | 10 | 0.8 | | | 564 | 152 | | | 22 |
| | 2 | a31 | 143 | 8 | 45 | 10 | 0.8 | | | 587 | 158 | | | 25 |
| Second | 5 | a31 | 144 | 8 | 55 | 7.5 | 0.8 | | | 630 | 165 | | | 23 |
| Third | 6 | a31 | 145 | 8 | 45 | 10 | 0.8 | | | 586 | 156 | | | 23 |
| | 7 | a31 | 146 | 8 | 45 | 7.5 | 0.8 | | | 624 | 164 | | | 25 |
| Comp. | 11 | a31 | 147 | 8 | 7.5 | 25 | 0.8 | | | 464 | 133 | | | 20 |
| | 12 | a31 | 148 | 8 | 7.5 | 25 | 0.8 | | | 469 | 135 | | | 22 |

TABLE 17

| | | | | After Final Process | | | | | | Heat Resistance at 700° C. for 30 seconds | | | | | |
|---|---|---|---|---|---|---|---|---|---|---|---|---|---|---|---|
| | | | | | | | 400° C. | After | | | | | | Precipitates | |
| | | | | | Wire | Rod | High- | Cold | | | | Re- | | | |
| | | | | | Perfor- | Perfor- | Temp. | Compression | | | Vickers | crystal- | Con- | Avg. | Ratio of |
| | Alloy No. | Proc. | Test No. | Conductivity % IACS | mance Index I1 | mance Index I2 | Tensile Strength N/mm$^2$ | Hardness HRB | Conductivity % IACS | Process Before Heating | Hardness HV | lization Ratio % | ductivity % IACS | Grain Diameter nm | 30 nm or less % |
| First | 1 | a11 | 121 | 82 | 4691 | | | | | | | | | | |
| | 2 | a11 | 122 | 80 | 4740 | | | | | | | | | | |

TABLE 17-continued

| | | | | After Final Process | | | | | | Heat Resistance at 700° C. for 30 seconds | | | | | |
|---|---|---|---|---|---|---|---|---|---|---|---|---|---|---|---|
| | | | | | Wire | Rod | 400° C. High- | After Cold | | | | Re- | | Precipitates | |
| | | | | | Perfor- | Perfor- | Temp. | Compression | | | Vickers | crystal- | Con- | Avg. | Ratio of |
| | Alloy No. | Proc. | Test No. | Conduc-tivity % IACS | mance Index I1 | mance Index I2 | Tensile Strength N/mm$^2$ | Hard-ness HRB | Conduc-tivity % IACS | Process Before Heating | Hard-ness HV | lization Ratio % | duc-tivity % IACS | Grain Diameter nm | 30 nm or less % |
| Second | 5 | a11 | 123 | 77 | 4879 | | | | | | | | | | |
| Third | 6 | a11 | 124 | 81 | 4887 | | | | | | | | | | |
| | 7 | a11 | 125 | 76 | 4734 | | | | | | | | | | |
| Comp. | 11 | a11 | 126 | 75 | 3481 | | | | | | | | | | |
| | 12 | a11 | 127 | 72 | 3462 | | | | | | | | | | |
| First | 2 | a12 | 128 | 74 | 5084 | | | | | | | | | | |
| Comp. | 12 | a12 | 129 | 71 | 3868 | | | | | | | | | | |
| C | 21 | ZA3 | 130 | 98 | 4158 | | | | | | | | | | |
| First | 2 | a13 | 131 | 79 | 5066 | | | | | | | | | | |
| Third | 7 | a13 | 132 | 75 | 5023 | | | | | | | | | | |
| Comp. | 12 | a13 | 133 | 73 | 3768 | | | | | | | | | | |
| C | 21 | ZA4 | 134 | 100 | 3650 | | | | | | | | | | |
| First | 1 | a21 | 135 | 81 | 4905 | | | | | | | | | | |
| | 2 | a21 | 136 | 77 | 4958 | | | | | | | | | | |
| Second | 5 | a21 | 137 | 75 | 5049 | | | | | | | | | | |
| Third | 6 | a21 | 138 | 78 | 4990 | | | | | | | | | | |
| | 7 | a21 | 139 | 74 | 4964 | | | | | | | | | | |
| Comp. | 11 | a21 | 140 | 74 | 3871 | | | | | | | | | | |
| | 12 | a21 | 141 | 72 | 3793 | | | | | | | | | | |
| First | 1 | a31 | 142 | 75 | 4884 | | | | | | | | | | |
| | 2 | a31 | 143 | 73 | 5015 | | | | | | | | | | |
| Second | 5 | a31 | 144 | 71 | 5308 | | | | | | | | | | |
| Third | 6 | a31 | 145 | 75 | 5075 | | | | | | | | | | |
| | 7 | a31 | 146 | 70 | 5221 | | | | | | | | | | |
| Comp. | 11 | a31 | 147 | 71 | 3910 | | | | | | | | | | |
| | 12 | a31 | 148 | 69 | 3896 | | | | | | | | | | |

TABLE 18

| | | | | Rolling Completion | | | After Final Process | | | | | | | |
|---|---|---|---|---|---|---|---|---|---|---|---|---|---|---|
| | | | | | Non- | | | Precipitates | | | | | | |
| | | | | Wire | recrystal- | Avg. | Final | Avg. | Ratio of | | Vickers | After Final Process | | |
| | Alloy No. | Proc. | Test No. | Outer Diameter mm | lization Ratio % | Grain Size μm | Outer Diameter mm | Grain Diameter nm | 30 nm or less % | Tensile Strength N/mm$^2$ | Hard-ness HV | Elonga-tion % | Rockwell Hardness HRB | Repetitive Bending Times |
| First | 3 | b12 | 151 | 11 | 40 | 15 | 2 | | | 567 | 153 | | | 20 |
| | 101 | b12 | 152 | 11 | 45 | 12 | 2 | | | 580 | 157 | | | 20 |
| Second | 4 | b12 | 153 | 11 | 35 | 12 | 2 | | | 563 | 152 | | | 21 |
| | 102 | b12 | 154 | 11 | 50 | 13 | 2 | | | 575 | 157 | | | 20 |
| Third | 103 | b12 | 155 | 11 | 45 | 12 | 2 | | | 588 | 160 | | | 20 |
| Comp. | 104 | b12 | 156 | 11 | 7.5 | 20 | 2 | | | 423 | 122 | | | 21 |
| First | 3 | b13 | 157 | 11 | 40 | 15 | 0.8 | | | 641 | 163 | | | 24 |
| | 101 | b13 | 158 | 11 | 45 | 12 | 0.8 | | | 675 | 174 | | | 24 |
| Second | 4 | b13 | 159 | 11 | 35 | 12 | 0.8 | | | 656 | 170 | | | 23 |
| | 102 | b13 | 160 | 11 | 50 | 13 | 0.8 | | | 655 | 170 | | | 25 |
| Third | 103 | b13 | 161 | 11 | 45 | 12 | 0.8 | | | 693 | 174 | | | 23 |
| Comp. | 104 | b13 | 162 | 11 | 7.5 | 20 | 0.8 | | | 476 | 138 | | | 24 |
| First | 101 | b14 | 163 | 11 | 45 | 12 | 0.8 | | | 631 | 166 | | | 28 |
| Second | 4 | b14 | 164 | 11 | 35 | 12 | 0.8 | | | 622 | 163 | | | 29 |
| | 102 | b14 | 165 | 11 | 50 | 13 | 0.8 | | | 619 | 163 | | | 29 |
| Third | 103 | b14 | 166 | 11 | 45 | 12 | 0.8 | | | 649 | 168 | | | 26 |
| Comp. | 104 | b14 | 167 | 11 | 7.5 | 20 | 0.8 | | | 435 | 126 | | | 28 |

TABLE 19

| | | | | After Final Process | | | | | | Heat Resistance at 700° C. for 30 seconds | | | | | |
|---|---|---|---|---|---|---|---|---|---|---|---|---|---|---|---|
| | | | | | | | 400° C. High-Temp. | After Cold Compression | | | | | Precipitates | | |
| | Alloy No. | Proc. | Test No. | Conductivity % IACS | Wire Performance Index I1 | Rod Performance Index I2 | Tensile Strength N/mm$^2$ | Hardness HRB | Conductivity % IACS | Process Before Heating | Vickers Hardness HV | Recrystallization Ratio % | Conductivity % IACS | Avg. Grain Diameter Nm | Ratio of 30 nm or less % |
| First | 3 | b12 | 151 | 76 | 4943 | | | | | 1 | 102 | 15 | 68 | | |
| | 101 | b12 | 152 | 74 | 4989 | | | | | | | | | | |
| Second | 4 | b12 | 153 | 71 | 4744 | | | | | | | | | | |
| | 102 | b12 | 154 | 76 | 5013 | | | | | 1 | 110 | 15 | 70 | | |
| Third | 103 | b12 | 155 | 71 | 4955 | | | | | | | | | | |
| Comp. | 104 | b12 | 156 | 79 | 3760 | | | | | | | | | | |
| First | 3 | b13 | 157 | 71 | 5401 | | | | | | | | | | |
| | 101 | b13 | 158 | 69 | 5607 | | | | | | | | | | |
| Second | 4 | b13 | 159 | 66 | 5329 | | | | | | | | | | |
| | 102 | b13 | 160 | 70 | 5480 | | | | | | | | | | |
| Third | 103 | b13 | 161 | 66 | 5630 | | | | | | | | | | |
| Comp. | 104 | b13 | 162 | 76 | 4150 | | | | | | | | | | |
| First | 101 | b14 | 163 | 72 | 5354 | | | | | | | | | | |
| Second | 4 | b14 | 164 | 70 | 5204 | | | | | | | | | | |
| | 102 | b14 | 165 | 74 | 5325 | | | | | | | | | | |
| Third | 103 | b14 | 166 | 70 | 5430 | | | | | | | | | | |
| Comp. | 104 | b14 | 167 | 78 | 3842 | | | | | | | | | | |

In C1100, the results in Processes ZA3 and ZA4 are represented. In Processes a11, a12, a13, a21, a31, and Processes b12 to b14, the heat treatment TH2 mainly for restoration is performed during or after the drawing/wire drawing process. In the invention alloy, in each process, tensile strength, Vickers hardness, and a wire performance index I1 are very high, as compared with those of the comparative alloy or C1100. In addition, the number of repetitive bending times of the invention alloy is satisfactory, as compared with the comparative alloy or C1100. Conductivity of the comparative alloy is about 70% of C1100, but conductivity of the invention alloy is about 75% of C1100, which is satisfactory as compared with that of the comparative alloy. As can be seen from the comparison results of Processes a12 and a13 and the comparison results of Processes b13 and b14, in the invention alloy, the number of repetitive bending times is largely improved by performing the heat treatment TH2 after the wire drawing process.

Tables 20 and 21 show the results in Processes b21 to b24 and Processes b31, b41, and b42, by comparison with the results in Processes b11 and b12.

TABLE 20

| | | | | Rolling Completion | | | After Final Process | | | | | | After Final Process | | |
|---|---|---|---|---|---|---|---|---|---|---|---|---|---|---|---|
| | | | | | | | | Precipitates | | | | | | | |
| | Alloy No. | Proc. | Test No. | Wire Outer Diameter mm | Non-recrystallization Ratio % | Avg. Grain Size μm | Final Outer Diameter mm | Avg. Grain Diameter nm | Ratio of 30 nm or less % | Tensile Strength N/mm$^2$ | Vickers Hardness HV | Elongation % | Rockwell Hardness HRB | Repetitive Bending Times |
| First | 101 | b21 | 171 | 11 | 45 | 12 | 11 | 4.0 | 100 | 383 | 107 | 28 | 55 | |
| Second | 102 | b21 | 172 | 11 | 50 | 13 | 11 | 3.9 | 100 | 378 | 106 | 27 | 55 | |
| Third | 103 | b21 | 173 | 11 | 45 | 12 | 11 | 4.1 | 99 | 385 | 109 | 29 | 55 | |
| Comp. | 104 | b21 | 174 | 11 | 7.5 | 20 | 11 | 18 | 92 | 316 | 89 | 32 | 33 | |
| Second | 4 | b22 | 175 | 11 | 35 | 12 | 2 | | | 588 | 158 | | | 19 |
| First | 101 | b23 | 176 | 11 | 45 | 12 | 2 | | | 573 | 155 | | | 23 |
| Second | 4 | b23 | 177 | 11 | 35 | 12 | 2 | | | 564 | 153 | | | 23 |
| Second | 102 | b23 | 178 | 11 | 50 | 13 | 2 | | | 569 | 154 | | | 23 |
| Third | 103 | b23 | 179 | 11 | 45 | 12 | 2 | | | 578 | 158 | | | 22 |
| Comp. | 104 | b23 | 180 | 11 | 7.5 | 20 | 2 | | | 415 | 118 | | | 22 |
| First | 101 | b24 | 181 | 11 | 45 | 12 | 2 | | | 517 | 148 | 7 | | 37 |
| Third | 103 | b24 | 182 | 11 | 45 | 12 | 2 | | | 523 | 150 | 7 | | 37 |
| First | 101 | b31 | 183 | 11 | 45 | 12 | 0.8 | | | 524 | 149 | 7 | | 48 |
| Second | 102 | b31 | 184 | 11 | 50 | 13 | 0.8 | | | 516 | 150 | 7 | | 47 |
| Third | 103 | b31 | 185 | 11 | 45 | 12 | 0.8 | | | 530 | 152 | 6 | | 47 |
| Comp. | 104 | b31 | 186 | 11 | 7.5 | 20 | 0.8 | | | 330 | 93 | 7 | | 48 |
| First | 101 | b41 | 187 | 11 | 45 | 12 | 11 | 16 | 93 | 308 | 88 | 40 | | |
| First | 101 | b42 | 188 | 11 | 45 | 12 | 2 | 21 | 89 | 343 | 92 | 15 | | 42 |
| Comp. | 4 | b11 | 189 | 11 | 35 | 12 | 2 | | | 606 | 162 | | | 16 |
| First | 3 | b12 | 190 | 11 | 40 | 15 | 2 | | | 567 | 153 | | | 20 |
| | 101 | b12 | 191 | 11 | 45 | 12 | 2 | | | 580 | 157 | | | 20 |

TABLE 20-continued

| | | | | Rolling Completion | | | After Final Process | | | | | | | |
|---|---|---|---|---|---|---|---|---|---|---|---|---|---|---|
| | | | | | Non-re- | | | Precipitates | | | | | | |
| | | | | Wire | crystal- | Avg. | Final | Avg. | Ratio of | | | After Final Process | | |
| | Alloy No. | Proc. | Test No. | Outer Diameter mm | lization Ratio % | Grain Size μm | Outer Diameter mm | Grain Diameter nm | 30 nm or less % | Tensile Strength N/mm$^2$ | Vickers Hardness HV | Elongation % | Rockwell Hardness HRB | Repetitive Bending Times |
| Second | 4 | b12 | 192 | 11 | 35 | 12 | 2 | | | 563 | 152 | | | 21 |
| | 102 | b12 | 193 | 11 | 50 | 13 | 2 | | | 575 | 157 | | | 20 |
| Third | 103 | b12 | 194 | 11 | 45 | 12 | 2 | | | 588 | 160 | | | 20 |
| Comp. | 104 | b12 | 195 | 11 | 7.5 | 20 | 2 | | | 423 | 122 | | | 21 |

TABLE 21

| | | | | After Final Process | | | | | | Heat Resistance at 700° C. for 30 seconds | | | | | |
|---|---|---|---|---|---|---|---|---|---|---|---|---|---|---|---|
| | | | | | | | 400° C. | After Cold | | | | | | | |
| | | | | | Wire | Rod | High- | Compression | | | | | | Precipitates | |
| | Alloy No. | Proc. | Test No. | Con duc-tivity % IACS | Perfor-mance Index I1 | Perfor-mance Index I2 | Temp. Tensile Strength N/mm$^2$ | Hard-ness HRB | Con-duc-tivity % IACS | Process Before Heating | Vickers Hard-ness HV | Recrystal-lization Ratio % | Conduc-tivity % IACS | Avg. Grain Diameter nm | Ratio of 30 nm or less % |
| First | 101 | b21 | 171 | 76 | 3339 | 4274 | | | | | | | | | |
| Second | 102 | b21 | 172 | 78 | 3338 | 4240 | | | | | | | | | |
| Third | 103 | b21 | 173 | 73 | 3289 | 4243 | | | | | | | | | |
| Comp. | 104 | b21 | 174 | 80 | 2826 | 3731 | | | | | | | | | |
| Second | 4 | b22 | 175 | 68 | 4849 | | | | | | | | | | |
| First | 101 | b23 | 176 | 76 | 4995 | | | | | | | | | | |
| Second | 4 | b23 | 177 | 72 | 4786 | | | | | | | | | | |
| Second | 102 | b23 | 178 | 78 | 5025 | | | | | | | | | | |
| Third | 103 | b23 | 179 | 72 | 4904 | | | | | | | | | | |
| Comp. | 104 | b23 | 180 | 79 | 3689 | | | | | | | | | | |
| First | 101 | b24 | 181 | 78 | 4566 | 4886 | | | | | | | | | |
| Third | 103 | b24 | 182 | 75 | 4529 | 4846 | | | | | | | | | |
| First | 101 | b31 | 183 | 78 | 4628 | 4952 | | | | | | | | | |
| Second | 102 | b31 | 184 | 80 | 4615 | 4938 | | | | | | | | | |
| Third | 103 | b31 | 185 | 74 | 4559 | 4833 | | | | | | | | | |
| Comp. | 104 | b31 | 186 | 82 | 2988 | 3197 | | | | | | | | | |
| First | 101 | b41 | 187 | 80 | 2755 | 3857 | | | | | | | | | |
| First | 101 | b42 | 188 | 81 | 3087 | 3550 | | | | | | | | | |
| Comp. | 4 | b11 | 189 | 68 | 4997 | | | | | | | | | | |
| First | 3 | b12 | 190 | 76 | 4943 | | | | | 1 | 102 | 15 | 68 | | |
| | 101 | b12 | 191 | 74 | 4989 | | | | | | | | | | |
| Second | 4 | b12 | 192 | 71 | 4744 | | | | | | | | | | |
| | 102 | b12 | 193 | 76 | 5013 | | | | | 1 | 110 | 15 | 70 | | |
| Third | 103 | b12 | 194 | 71 | 4955 | | | | | | | | | | |
| Comp. | 104 | b12 | 195 | 79 | 3760 | | | | | | | | | | |

In Processes b22 and b23, the heat treatment TH1 is performed twice. In the wires of Processes b22 and b23, all of strength, hardness, conductivity, and a bending property are improved as compared with those of the wires in Processes b11 and b12 subjected to the heat treatment TH1 once. In Process b24 and Process 31, the final process of the producing process is the heat treatment TH1. When the heat treatment TH1 is performed at the last, a wire performance index I1 representing total balance between strength and conductivity is satisfied, and bending resistance is excellent. In the wires of Process b24 and Process b31, a rod performance index I2 with ductility also represents 4800 or more which is the most preferable range. In the wire of Process b31, the number of repetitive bending times is very high. In addition, even being compared with the comparative material or C1100 produced in each of Processes b11 to b13 in which the heat treatment TH1 is not performed at the last, strength of the invention alloy is high, and bending resistance is twice or more as high.

Tables 22 and 23 show the results in Processes c13 to c15, and Process c18.

TABLE 22

| | | | | Rolling Completion | | | After Final Process | | | | | | | |
|---|---|---|---|---|---|---|---|---|---|---|---|---|---|---|
| | | | | | | | | Precipitates | | | | | | |
| | | | | Wire | Non-recrystal- | Avg. | Final | Avg. | Ratio of | | | After Final Process | | |
| | Alloy No. | Proc. | Test No. | Outer Diameter mm | lization Ratio % | Grain Size μm | Outer Diameter mm | Grain Diameter nm | 30 nm or less % | Tensile Strength N/mm$^2$ | Vickers Hardness HV | Elon-gation % | Rockwell Hardness HRB | Repetitive Bending Times |
| First | 3 | c13 | 201 | 23 | 20 | 18 | 20 | | | 347 | | 24 | 53 | |
| | 101 | c13 | 202 | 23 | 30 | 18 | 20 | | | 361 | | 25 | 54 | |
| Second | 102 | c13 | 203 | 23 | 33 | 20 | 20 | | | 360 | | 25 | 52 | |
| Third | 103 | c13 | 204 | 23 | 30 | 18 | 20 | | | 368 | | 25 | 55 | |
| Comp. | 12 | c13 | 205 | 23 | 0 | 60 | 20 | | | 324 | | 21 | 49 | |
| C | 21 | ZC1 | 206 | 23 | 0 | 70 | 20 | | | 317 | | 19 | 44 | |
| First | 2 | c14 | 207 | 23 | 15 | 20 | 20 | | | 400 | | 28 | 58 | |
| | 3 | c14 | 208 | 23 | 20 | 18 | 20 | | | 410 | | 26 | 60 | |
| | 101 | c14 | 209 | 23 | 30 | 18 | 20 | | | 425 | | 27 | 62 | |
| Second | 5 | c14 | 210 | 23 | 25 | 18 | 20 | | | 421 | | 25 | 62 | |
| | 102 | c14 | 211 | 23 | 33 | 20 | 20 | | | 423 | | 27 | 62 | |
| Third | 7 | c14 | 212 | 23 | 20 | 18 | 20 | | | 422 | | 24 | 63 | |
| | 103 | c14 | 213 | 23 | 30 | 18 | 20 | | | 435 | | 26 | 63 | |
| Comp. | 12 | c14 | 214 | 23 | 0 | 60 | 20 | | | 261 | | 37 | 21 | |
| | 104 | c14 | 215 | 23 | 0 | 35 | 20 | | | 313 | | 32 | 32 | |
| First | 2 | c15 | 216 | 23 | 15 | 20 | 18 | | | 448 | | 17 | 70 | |
| | 101 | c15 | 217 | 23 | 30 | 18 | 18 | | | 468 | | 16 | 72 | |
| Second | 102 | c15 | 218 | 23 | 33 | 20 | 18 | | | 457 | | 17 | 69 | |
| Third | 103 | c15 | 219 | 23 | 30 | 18 | 18 | | | 482 | | 15 | 74 | |
| Comp. | 12 | c15 | 220 | 23 | 0 | 60 | 18 | | | 337 | | 21 | 51 | |
| | 104 | c15 | 221 | 23 | 0 | 35 | 20 | | | 360 | | 20 | 62 | |
| First | 101 | c18 | 222 | 23 | 30 | 18 | 20 | | | 385 | | 24 | 58 | |

TABLE 23

| | | | | After Final Process | | | | | | Heat Resistance at 700° C. for 30 seconds | | | | | |
|---|---|---|---|---|---|---|---|---|---|---|---|---|---|---|---|
| | | | | | | | 400° C. | After Cold | | | | | | | |
| | | | | | Wire | Rod | High- | Compression | | | | | | Precipitates | |
| | Alloy No. | Proc. | Test No. | Con duc-tivity % IACS | Perfor-mance Index I1 | Perfor-mance Index I2 | Temp. Tensile Strength N/mm$^2$ | Hard-ness HRB | Con-duc-tivity % IACS | Process Before Heating | Vickers Hard-ness HV | Recrystal-lization Ratio % | Conduc-tivity % IACS | Avg. Grain Diameter nm | Ratio of 30 nm or less % |
| First | 3 | c13 | 201 | 52 | | 3103 | | 84 | 71 | 3 | 113 | 10 | 66 | | |
| | 101 | c13 | 202 | 47 | | 3094 | | 87 | 73 | | | | | | |
| Second | 102 | c13 | 203 | 47 | | 3085 | | 87 | 73 | 3 | 116 | 10 | 70 | 7.1 | 98 |
| Third | 103 | c13 | 204 | 45 | | 3086 | | | | 2 | 116 | 10 | 66 | | |
| Comp. | 12 | c13 | 205 | 59 | | 3011 | | 69 | 65 | 2 | 61 | 100 | 70 | 31 | 50 |
| C | 21 | ZC1 | 206 | 100 | | 3772 | 64 | 63 | 99 | 1 | 39 | 100 | 101 | | |
| First | 2 | c14 | 207 | 80 | | 4579 | 226 | 84 | 80 | 1 | 106 | 15 | 72 | 8 | 96 |
| | 3 | c14 | 208 | 77 | | 4533 | 227 | 87 | 76 | 1 | 106 | 12 | 68 | | |
| | 101 | c14 | 209 | 76 | | 4705 | 246 | | | | | | | | |
| Second | 5 | c14 | 210 | 79 | | 4677 | 228 | 88 | 80 | | | | | | |
| | 102 | c14 | 211 | 78 | | 4745 | 248 | | | 1 | 112 | 7.5 | 71 | | |
| Third | 7 | c14 | 212 | 78 | | 4621 | 234 | 86 | 78 | 1 | 106 | 15 | 71 | | |
| | 103 | c14 | 213 | 73 | | 4683 | | | | 1 | 113 | 10 | 67 | 7.5 | 97 |
| Comp. | 12 | c14 | 214 | 75 | | 3097 | 102 | 71 | 73 | 1 | 59 | 100 | 69 | | |
| | 104 | c14 | 215 | 82 | | 3741 | | | | | | | | | |
| First | 2 | c15 | 216 | 79 | | 4659 | | | | | | | | | |
| | 101 | c15 | 217 | 74 | | 4670 | | | | | | | | | |
| Second | 102 | c15 | 218 | 76 | | 4661 | | | | | | | | | |
| Third | 103 | c15 | 219 | 71 | | 4671 | | | | | | | | | |
| Comp. | 12 | c15 | 220 | 74 | | 3508 | | 74 | 73 | | | | | | |
| | 104 | c15 | 221 | 81 | | 3888 | | | | | | | | | |
| First | 101 | c18 | 222 | 62 | | 3759 | | | | | | | | | |

In C1100, the result of Process ZC1 is represented. The invention alloy is soft after the continuous casting and rolling process (Process c1), but strength thereof becomes high after the drawing process (Process c13). Accordingly, tensile strength, elongation, Rockwell hardness, and conductivity are further improved by performing the heat treatment TH1 (Process c14). Meanwhile, in the comparative alloy, elongation and conductivity are slightly improved but tensile strength and Rockwell hardness are decreased, even when the heat treatment TH1 is performed. As described above, the invention alloy is soft when being processed, and can be strengthened after processing. Accordingly, it is possible to reduce processing costs. 400° C. high-temperature tensile strength of the invention alloy after the heat treatment TH1 (Process c14) is twice or more that of the comparative alloy. When the drawing process after the heat treatment TH1 is performed (Process c15), elongation is decreased, but tensile strength and Rockwell hardness are further increased. The invention alloy has high strength and high conductivity. That is, in 700° C. heat resistance, Vickers hardness is about 110 and conductivity is about 70, irrespective of whether a heat treatment TH1 is performed or not, whether a cold processing rate of rods is high or low, and whether the target is a rod or a compression-processed product. The reason is because the size of precipitates is as fine as about 7 nm, and a recrystallization ratio is about 10%, including the materials of Processes c1 and c12.

In the invention alloy, there is no large difference in Rockwell hardness from the comparative alloy at the step of rods after the drawing process (Process c13), and Rockwell hardness is higher than that of C1100 only by 9 points. However, after the forging and heat treatment are performed as shown in data of "after cold compression", Rockwell hardness is even higher than that of the comparative alloy and C1100. As described above, the invention alloy is even more hardened than the comparative alloy or C1100 after a heat treatment after forging, and thus exhibits excellent properties in a cold process such as forging (see Test No. 201, 205, and 206). In Process c18, the heat treatment TH1 at 420° C. for 2 hours is performed after Process c13. The heat treatment index TI of the heat treatment TH1 is below the producing condition, and thus precipitation is insufficient. Accordingly, improvement of strength by precipitation is scarce, tensile strength, Rockwell hardness, and a rod performance index I2 are low, and conductivity is also low.

Tables 24 and 25 show the result in Processes c2, c21 to c24, and Processes c3, c31, c32, and c34, by comparison with the results in Processes c1, c11 to c14.

TABLE 24

| | | | | Rolling Completion | | | After Final Process | | | | | | | |
|---|---|---|---|---|---|---|---|---|---|---|---|---|---|---|
| | | | | | | | | Precipitates | | | | | | |
| | Alloy No. | Proc. | Test No. | Wire Outer Diameter mm | Non-recrystallization Ratio % | Avg. Grain Size μm | Final Outer Diameter mm | Avg. Grain Diameter nm | Ratio of 30 nm or less % | Tensile Strength N/mm$^2$ | Vickers Hardness HV | After Final Process Elongation % | After Final Process Rockwell Hardness HRB | After Final Process Repetitive Bending Times |
| First | 3 | c1 | 231 | 23 | 20 | 18 | 23 | | | | | | | |
| | 3 | c11 | 232 | 23 | 20 | 18 | 23 | 3.8 | 100 | 348 | | 40 | 51 | |
| | 3 | c12 | 233 | 23 | 20 | 18 | 20 | | | 419 | | 22 | 67 | |
| | 3 | c13 | 234 | 23 | 20 | 18 | 20 | | | 347 | | 24 | 53 | |
| | 3 | c14 | 235 | 23 | 20 | 18 | 20 | | | 410 | | 26 | 60 | |
| | 3 | c2 | 236 | 23 | 25 | 18 | 23 | | | | | | | |
| | 3 | c21 | 237 | 23 | 25 | 18 | 23 | 3.4 | 100 | 369 | | 36 | 58 | |
| | 3 | c22 | 238 | 23 | 25 | 18 | 20 | | | 447 | | 22 | 70 | |
| | 3 | c23 | 239 | 23 | 25 | 18 | 20 | | | 341 | | 25 | 53 | |
| | 3 | c24 | 240 | 23 | 25 | 18 | 20 | | | 438 | | 27 | 63 | |
| | 101 | c1 | 241 | 23 | 30 | 18 | 23 | | | 303 | | 35 | 32 | |
| | 101 | c11 | 242 | 23 | 30 | 18 | 23 | 3.5 | 100 | 379 | | 37 | 56 | |
| | 101 | c12 | 243 | 23 | 30 | 18 | 20 | | | 436 | | 23 | 67 | |
| | 101 | c13 | 244 | 23 | 30 | 18 | 20 | | | 361 | | 25 | 54 | |
| | 101 | c14 | 245 | 23 | 30 | 18 | 20 | | | 425 | | 27 | 62 | |
| | 101 | c2 | 246 | 23 | 33 | 17 | 23 | | | | | | | |
| | 101 | c21 | 247 | 23 | 33 | 17 | 23 | 2.9 | 100 | 389 | | 39 | 58 | |
| | 101 | c22 | 248 | 23 | 33 | 17 | 20 | | | 450 | | 23 | 69 | |
| | 101 | c24 | 249 | 23 | 33 | 17 | 20 | | | 442 | | 28 | 65 | |
| | 101 | c3 | 250 | 23 | 65 | 15 | 23 | | | | | | | |
| | 101 | c31 | 251 | 23 | 65 | 15 | 23 | 16 | 89 | 330 | | 33 | 46 | |
| | 101 | c32 | 252 | 23 | 65 | 15 | 20 | | | 379 | | 20 | 59 | |
| | 101 | c34 | 253 | 23 | 65 | 15 | 20 | | | 313 | | 38 | 41 | |
| Second | 102 | c1 | 254 | 23 | 33 | 20 | 23 | | | 298 | | 36 | 28 | |
| | 102 | c11 | 255 | 23 | 33 | 20 | 23 | 3.4 | 100 | 380 | | 37 | 55 | |
| | 102 | c12 | 256 | 23 | 33 | 20 | 20 | | | 433 | | 24 | 66 | |
| | 102 | c13 | 257 | 23 | 33 | 20 | 20 | | | 360 | | 25 | 52 | |
| | 102 | c14 | 258 | 23 | 33 | 20 | 20 | | | 423 | | 27 | 62 | |
| | 102 | c2 | 259 | 23 | 35 | 17 | 23 | | | | | | | |
| | 102 | c21 | 260 | 23 | 35 | 17 | 23 | 3 | 100 | 386 | | 38 | 57 | |
| | 102 | c22 | 261 | 23 | 35 | 17 | 20 | | | 447 | | 24 | 67 | |
| | 102 | c24 | 262 | 23 | 35 | 17 | 20 | | | 438 | | 27 | 64 | |
| Third | 7 | c1 | 263 | 23 | 20 | 18 | 23 | | | 282 | | 42 | 19 | |
| | 7 | c11 | 264 | 23 | 20 | 18 | 23 | 3.6 | 100 | 357 | | 37 | 53 | |
| | 7 | c12 | 265 | 23 | 20 | 18 | 20 | | | 429 | | 20 | 71 | |
| | 7 | c14 | 266 | 23 | 20 | 18 | 20 | | | 416 | | 24 | 63 | |
| | 7 | c2 | 267 | 23 | 30 | 15 | 23 | | | | | | | |
| | 7 | c21 | 268 | 23 | 30 | 15 | 23 | 3.1 | 100 | 377 | | 35 | 58 | |
| | 7 | c22 | 269 | 23 | 30 | 15 | 20 | | | 451 | | 22 | 72 | |
| | 7 | c24 | 270 | 23 | 30 | 15 | 20 | | | 439 | | 25 | 67 | |

TABLE 25

| | | | | After Final Process | | | | | | Heat Resistance at 700° C. for 30 seconds | | | | | |
|---|---|---|---|---|---|---|---|---|---|---|---|---|---|---|---|
| | | | | | Wire Performance | Rod Performance | 400° C. High-Temp. | After Cold Compression | | | | | | Precipitates | |
| | Alloy No. | Proc. | Test No. | Conductivity % IACS | Index I1 | Index I2 | Tensile Strength N/mm$^2$ | Hardness HRB | Conductivity % IACS | Process Before Heating | Vickers Hardness HV | Recrystallization Ratio % | Conductivity % IACS | Avg. Grain Diameter nm | Ratio of 30 nm or less % |
| First | 3 | C1 | 231 | | | | | | | | | | | | |
| | 3 | c11 | 232 | 77 | | 4275 | | | | | | | | | |
| | 3 | c12 | 233 | 76 | | 4456 | 223 | 86 | 75 | 2 | 111 | 12 | 67 | | |
| | 3 | c13 | 234 | 52 | | 3103 | | 84 | 71 | 3 | 113 | 10 | 66 | | |
| | 3 | c14 | 235 | 77 | | 4533 | 227 | 87 | 76 | 1 | 106 | 12 | 68 | | |
| | 3 | C2 | 236 | | | | | | | | | | | | |
| | 3 | C21 | 237 | 77 | | 4404 | | 87 | 78 | | | | | | |
| | 3 | C22 | 238 | 75 | | 4723 | 250 | 89 | 78 | | | | | | |
| | 3 | C23 | 239 | 48 | | 2953 | | 88 | 70 | | | | | | |
| | 3 | C24 | 240 | 77 | | 4881 | 256 | 88 | 77 | | | | | | |
| | 101 | c1 | 241 | 48 | | 2834 | | 85 | 71 | | | | | | |
| | 101 | C11 | 242 | 76 | | 4527 | | | | | | | | | |
| | 101 | C12 | 243 | 74 | | 4613 | 235 | 88 | 75 | 1 | 114 | 12 | 70 | 7.2 | 97 |
| | 101 | C13 | 244 | 47 | | 3094 | | 87 | 73 | | | | | | |
| | 101 | C14 | 245 | 76 | | 4705 | 246 | | | | | | | | |
| | 101 | c2 | 246 | | | | | | | | | | | | |
| | 101 | C21 | 247 | 75 | | 4683 | | 86 | 75 | | | | | | |
| | 101 | C22 | 248 | 73 | | 4729 | 260 | 88 | 75 | | | | | | |
| | 101 | C24 | 249 | 76 | | 4932 | 265 | 88 | 76 | | | | | | |
| | 101 | c3 | 250 | | | | | | | | | | | | |
| | 101 | C31 | 251 | 78 | | 3876 | | | | | | | | | |
| | 101 | C32 | 252 | 76 | | 3965 | 144 | | | 1 | 83 | 70 | 71 | 24 | 75 |
| | 101 | C34 | 253 | 81 | | 3887 | | | | | | | | | |
| Second | 102 | c1 | 254 | 47 | | 2778 | | 84 | 74 | 2 | 119 | 7.5 | 69 | 6.7 | 98 |
| | 102 | C11 | 255 | 78 | | 4598 | | | | | | | | | |
| | 102 | C12 | 256 | 76 | | 4681 | 232 | 86 | 77 | 3 | 115 | 10 | 70 | 7.3 | 97 |
| | 102 | C13 | 257 | 47 | | 3085 | | 87 | 73 | 3 | 116 | 10 | 70 | | |
| | 102 | C14 | 258 | 78 | | 4745 | 248 | | | 1 | 112 | 7.5 | 71 | | |
| | 102 | c2 | 259 | | | | | | | | | | | | |
| | 102 | C21 | 260 | 77 | | 4674 | | 85 | 78 | | | | | | |
| | 102 | C22 | 261 | 75 | | 4800 | 257 | 87 | 77 | 1 | 114 | 7.5 | 70 | | |
| | 102 | C24 | 262 | 77 | | 4881 | 264 | 87 | 77 | | | | | | |
| Third | 7 | c1 | 263 | 56 | | 2997 | | 83 | 72 | | | | | | |
| | 7 | C11 | 264 | 78 | | 4320 | | 85 | 78 | | | | | | |
| | 7 | C12 | 265 | 80 | | 4605 | 230 | 87 | 79 | 3 | 113 | 10 | 70 | | |
| | 7 | C14 | 266 | 78 | | 4621 | 234 | 86 | 78 | 1 | 106 | 15 | 71 | | |
| | 7 | c2 | 267 | | | | | | | | | | | | |
| | 7 | C21 | 268 | 78 | | 4495 | | 86 | 77 | | | | | | |
| | 7 | C22 | 269 | 77 | | 4828 | 253 | 87 | 77 | | | | | | |
| | 7 | C24 | 270 | 78 | | 4846 | 260 | 87 | 78 | | | | | | |

In Processes c2, c21, c22, c23, and c24, a rapid water cooling process is performed after the hot rolling of the continuous casting and rolling process, and a cooling rate from 850 to 400° C. is 24° C./second. By performing the rapid water cooling process after the continuous casting and rolling process, the precipitates after the heat treatment TH1 (Process c21) immediately thereafter become fine. As a result, tensile strength of the rod, Rockwell hardness, and a rod performance index I2 are improved, and a high-temperature tensile strength at 400° C. is also high. In addition, a recrystallization ratio of the rod and compression-processed product after heating at 700° C. is low, and Vickers hardness is high. Rockwell hardness after the cold compression is also high. In the results in Process c22, c23, and c24, tensile strength, Rockwell hardness, and a rod performance index I2 are satisfactory as compared with the results in Processes c12, c13, and c14 corresponding thereto. As described above, even in the general continuous casting and rolling method, the invention alloy has high-level strength, conductivity, and balance between strength and conductivity. However, it is possible to further improve the strength, conductivity and the balance by raising an average cooling rate from 850 to 600° C. or from 850 to 400° C., and/or a cooling rate from 600° C. or lower to 400° C. or lower. In addition, improvement of high-temperature strength and heat resistance, or improvement of hardness after cold compression can be achieved.

In Processes c3, c31, c32, and c34, a slow cooling process is performed after the hot rolling of the continuous casting and rolling process, and a cooling rate from 850 to 400° C. is 8° C./second. By performing the slow cooling process after the continuous casting and rolling process, the precipitates after the heat treatment TH1 (Process c31) immediately thereafter become large. In the results in Processes c31, c32, and c34, tensile strength, elongation, Rockwell hardness, and a rod performance index I2 are deteriorated as compared with the results in Processes c11, c12, and c14 corresponding thereto. When the cooling rate during the continuous casting and rolling process and after the continuous casting and rolling process is low, the precipitates are coarsened in the course of the cooling, distribution of the precipitates becomes non-uniform, and the non-recrystallization ratio becomes also high. Accordingly, strength and ductility are low. Naturally, heat resistance of materials obtained from these processes is low.

Tables 26 and 27 show the results in Processes c4, c41, c42, c51, c6, c61, c62, and c7 by comparison with the results in Processes c1, c11, and c12.

TABLE 26

| | | | | Rolling Completion | | | After Final Process | | | | | | | |
|---|---|---|---|---|---|---|---|---|---|---|---|---|---|---|
| | | | | | | | | Precipitates | | | | | | |
| | Alloy No. | Proc. | Test No. | Wire Outer Diameter mm | Non-recrystallization Ratio % | Avg. Grain Size μm | Final Outer Diameter mm | Avg. Grain Diameter nm | Ratio of 30 nm or less % | Tensile Strength N/mm² | Vickers Hardness HV | Elongation % | Rockwell Hardness HRB | Repetitive Bending Times |
| First Inv. Alloy | 101 | c1 | 281 | 23 | 30 | 18 | 23 | | | 303 | — | 35 | 32 | |
| | 101 | c11 | 282 | 23 | 30 | 18 | 23 | 3.5 | 100 | 379 | — | 37 | 56 | |
| | 101 | c12 | 283 | 23 | 30 | 18 | 20 | | | 436 | — | 23 | 67 | |
| | 101 | c4 | 284 | 23 | 85 | 13 | | | | | | | | |
| | 101 | c41 | 285 | 23 | 85 | 13 | 23 | 12 | 88 | 338 | — | 28 | 50 | |
| | 101 | c42 | 286 | 23 | 85 | 13 | 20 | | | 391 | — | 17 | 60 | |
| | 101 | c51 | 287 | 23 | 85 | 13 | 20 | | | 320 | — | 36 | 39 | |
| | 101 | c6 | 288 | 23 | 45 | 15 | | | | | | | | |
| | 101 | c61 | 289 | 23 | 45 | 15 | 23 | 4.8 | 98 | 371 | — | 37 | 56 | |
| | 101 | c62 | 290 | 23 | 45 | 15 | 20 | | | 424 | — | 22 | 66 | |
| | 101 | c7 | 291 | | B | | | Breaking occurred in the initial-stage rolling, and thus the process was stopped. | | | | | | |
| Third Inv. Alloy | 103 | c1 | 292 | 23 | 30 | 18 | 23 | | | 314 | — | 34 | 32 | |
| | 103 | c11 | 293 | 23 | 30 | 18 | 23 | 3.5 | 100 | 382 | — | 36 | 57 | |
| | 103 | c4 | 294 | 23 | | | | Rolling load was large, and rolling was impossible. | | | | | | |

TABLE 27

| | | | | After Final Process | | | | | |
|---|---|---|---|---|---|---|---|---|---|
| | | | | | Wire Performance | Rod Performance | 400° C. High-Temp. Tensile | After Cold Compression | |
| | Alloy No. | Proc. | Test No. | Conductivity % IACS | Index I1 | Index I2 | Strength N/mm² | Hardness HRB | Conductivity % IACS |
| First Inv. Alloy | 101 | c1 | 281 | 48 | | 2834 | — | 85 | 71 |
| | 101 | c11 | 282 | 76 | | 4527 | | | |
| | 101 | c12 | 283 | 74 | | 4613 | 235 | 88 | 75 |
| | 101 | c4 | 284 | | | | | | |
| | 101 | c41 | 285 | 78 | | 3821 | | | |
| | 101 | c42 | 286 | 76 | | 3988 | | | |
| | 101 | c51 | 287 | 80 | | 3893 | | | |
| | 101 | c6 | 288 | | | | | | |
| | 101 | c61 | 289 | 76 | | 4431 | | | |
| | 101 | c62 | 290 | 76 | | 4510 | | | |
| | 101 | c7 | 291 | | | | | | |

TABLE 27-continued

| | | | | | |
|---|---|---|---|---|---|
| Third | 103 | c1 | 292 | 46 | 2854 |
| Inv. | 103 | c11 | 293 | 73 | 4439 |
| Alloy | 103 | c4 | 294 | | |

| | | | | Heat Resistance at 700° C. for 30 seconds | | | | | |
|---|---|---|---|---|---|---|---|---|---|
| | | | | | | | | Precipitates | |
| | Alloy No. | Proc. | Test No. | Process Before Heating | Vickers Hardness HV | Recrystallization Ratio % | Conductivity % IACS | Avg. Grain Diameter nm | Ratio of 30 nm or less % |
| First | 101 | c1 | 281 | | | | | | |
| Inv. | 101 | c11 | 282 | | | | | | |
| Alloy | 101 | c12 | 283 | 1 | 114 | 12 | 70 | 7.2 | 97 |
| | 101 | c4 | 284 | | | | | | |
| | 101 | c41 | 285 | | | | | | |
| | 101 | c42 | 286 | 1 | 79 | 75 | 71 | 21 | 80 |
| | 101 | c51 | 287 | | | | | | |
| | 101 | c6 | 288 | | | | | | |
| | 101 | c61 | 289 | | | | | | |
| | 101 | c62 | 290 | | | | | | |
| | 101 | c7 | 291 | | | | | | |
| Third | 103 | c1 | 292 | 2 | 117 | 10 | 66 | | |
| Inv. | 103 | c11 | 293 | | | | | | |
| Alloy | 103 | c4 | 294 | | | | | | |

Like Process c7, when a hot rolling start temperature was 1025° C. higher than the producing condition, hot rolling crack occurred (see Test No. 291). Meanwhile, like Process c4, when a hot rolling process is started at a hot rolling start temperature of 850° C. lower than the producing condition, a non-recrystallization ratio after rolling is high because Co, P, and the like are subjected to solid solution insufficiently, and the precipitates are coarsened in the later heat treatment process. For this reason, in the results in Processes c41 and c42, tensile strength, elongation, Rockwell hardness, and a rod performance index I2 are deteriorated, as compared with the result in Processes c11 and c12 corresponding thereto. In addition, since load of the hot rolling process becomes high, there is a case where the continuous casting and rolling process cannot be performed (see Test No. 294). Even when a drawing process is performed after Process c4 and then the heat treatment TH1 is performed (Process c51), tensile strength, Rockwell hardness, and a rod performance index I2 are low. The results in Processes c61 and c62 in which a hot rolling start temperature is 930° C. within the producing condition are satisfactory as well as the case of Processes c11 and c12.

As described above, Co, P, and the like are subjected to solid solution sufficiently by controlling the hot rolling start temperature and the cooling rate. Accordingly, it is possible to obtain continuous casting and rolling materials, in which Co, P, and the like are uniformly and finely precipitated in the later heat treatment process, recrystallized grains are fine in a metal structure, and a ratio of recrystallized parts and non-recrystallized parts is proper. In addition, in the later process, when precipitation hardening and drawing, or process hardening by wire drawing are appropriately designed, it is possible to obtain copper alloy having excellent strength, conductivity, and ductility, and having excellently-balanced properties thereof.

Tables 28 and 29 show the results in Processes G1 to G3, and Process H, by comparison with the results in Processes a3, a11, a13, and Process c12.

TABLE 28

| | | | | | | | After Final Process | | | | | | | |
|---|---|---|---|---|---|---|---|---|---|---|---|---|---|---|
| | | | | Rolling Completion | | | | Precipitates | | | | After Final Process | | |
| | Alloy No. | Proc. | Test No. | Wire Outer Diameter mm | Non-recrystallization Ratio % | Avg. Grain Size μm | Final Outer Diameter mm | Avg. Grain Diameter nm | Ratio of 30 nm or less % | Tensile Strength N/mm$^2$ | Vickers Hardness HV | Elongation % | Rockwell Hardness HRB | Repetitive Bending Times |
| First | 1 | a3 | 301 | 8 | 35 | 10 | 2 | | | 530 | 146 | | | 17 |
| | | G1 | 302 | 8 | | 150 | 2 | | | 521 | 144 | | | 15 |
| | 2 | a3 | 303 | 8 | 45 | 10 | 2 | | | 551 | 150 | | | 16 |
| | | G1 | 304 | 8 | | 100 | 2 | | | 543 | 148 | | | 14 |
| Third | 7 | a3 | 305 | 8 | 45 | 7.5 | 2 | | | 570 | 155 | | | 17 |
| | | G1 | 306 | 8 | | 80 | 2 | 2.9 | 100 | 599 | 160 | | | 14 |
| First | 2 | a11 | 307 | 8 | 45 | 10 | 2 | | | 530 | 146 | | | 20 |
| | | G2 | 308 | 8 | | | 2 | | | 528 | 145 | | | 18 |
| Third | 7 | a11 | 309 | 8 | 45 | 7.5 | 2 | | | 543 | 147 | | | 20 |
| | | G2 | 310 | 8 | | 80 | 2 | | | 575 | 159 | | | 17 |
| First | 2 | a13 | 311 | 8 | 45 | 10 | 0.8 | | | 570 | 153 | | | 29 |
| | | G3 | 312 | 8 | | | 0.8 | | | 573 | 162 | | | 24 |

TABLE 28-continued

| | | | | Rolling Completion | | | After Final Process | | | | | | | |
|---|---|---|---|---|---|---|---|---|---|---|---|---|---|---|
| | | | | | | | | Precipitates | | | | After Final Process | | |
| | Alloy No. | Proc. | Test No. | Wire Outer Diameter mm | Non-recrystallization Ratio % | Avg. Grain Size μm | Final Outer Diameter mm | Avg. Grain Diameter nm | Ratio of 30 nm or less % | Tensile Strength N/mm$^2$ | Vickers Hardness HV | Elongation % | Rockwell Hardness HRB | Repetitive Bending Times |
| Third | 7 | a13 | 313 | 8 | 45 | 7.5 | 0.8 | | | 580 | 156 | | | 28 |
| Inv. Alloy | | G3 | 314 | 8 | | 80 | 0.8 | | | 622 | 167 | | | 20 |
| First | 2 | c12 | 315 | 23 | 15 | 20 | 20 | | | 408 | | 24 | 62 | |
| | | H | 316 | 23 | | 120 | 20 | 3.1 | 100 | 434 | | 20 | 68 | |
| Third | 7 | c12 | 317 | 23 | 20 | 18 | 20 | | | 429 | | 20 | 71 | |
| | | H | 318 | 23 | | 100 | 20 | | | 456 | | 14 | 73 | |

TABLE 29

| | | | | After Final Process | | | | | |
|---|---|---|---|---|---|---|---|---|---|
| | | | | | Wire Performance | Rod Performance | 400° C. High-Temp. Tensile | After Cold Compression | |
| | Alloy No. | Proc. | Test No. | Conductivity % IACS | Index I1 | Index I2 | Strength N/mm$^2$ | Hardness HRB | Conductivity % IACS |
| First | 1 | a3 | 301 | 79 | 4711 | | | | |
| | | G1 | 302 | 78 | 4601 | | | | |
| | 2 | a3 | 303 | 75 | 4772 | | | | |
| | | G1 | 304 | 76 | 4734 | | | | |
| Third | 7 | a3 | 305 | 72 | 4837 | | | | |
| | | G1 | 306 | 80 | 5358 | | | | |
| First | 2 | a11 | 307 | 80 | 4740 | | | | |
| | | G2 | 308 | 80 | 4723 | | | | |
| Third | 7 | a11 | 309 | 76 | 4734 | | | | |
| | | G2 | 310 | 83 | 5238 | | | | |
| First | 2 | a13 | 311 | 79 | 5066 | | | | |
| | | G3 | 312 | 81 | 5157 | | | | |
| Third | 7 | a13 | 313 | 75 | 5023 | | | | |
| Inv. Alloy | | G3 | 314 | 81 | 5598 | | | | |
| First | 2 | c12 | 315 | 78 | | 4468 | 221 | 83 | 81 |
| | | H | 316 | 82 | | 4716 | 205 | | |
| Third | 7 | c12 | 317 | 80 | | 4605 | 230 | 87 | 79 |
| | | H | 318 | 81 | | 4679 | 226 | | |

| | | | | Heat Resistance at 700° C. for 30 seconds | | | | | |
|---|---|---|---|---|---|---|---|---|---|
| | | | | | | | | Precipitates | |
| | Alloy No. | Proc. | Test No. | Process Before Heating | Vickers Hardness HV | Recrystallization Ratio % | Conductivity % IACS | Avg. Grain Diameter nm | Ratio of 30 nm or less % |
| First | 1 | a3 | 301 | | | | | | |
| | | G1 | 302 | | | | | | |
| | 2 | a3 | 303 | 1 | 99 | 20 | 71 | | |
| | | G1 | 304 | | | | | | |
| Third | 7 | a3 | 305 | | | | | | |
| | | G1 | 306 | | | | | | |
| First | 2 | a11 | 307 | | | | | | |
| | | G2 | 308 | | | | | | |
| Third | 7 | a11 | 309 | | | | | | |
| | | G2 | 310 | | | | | | |
| First | 2 | a13 | 311 | | | | | | |
| | | G3 | 312 | | | | | | |
| Third | 7 | a13 | 313 | | | | | | |
| Inv. Alloy | | G3 | 314 | | | | | | |
| First | 2 | c12 | 315 | | | | | | |
| | | H | 316 | 1 | 107 | 15 | 73 | 6.4 | 97 |
| Third | 7 | c12 | 317 | 3 | 113 | 10 | 70 | | |
| | | H | 318 | | | | | | |

In Processes G1 to G3, and Process H1, a solution-precipitation process is performed. In Processes a3, a11, a13, and c12 including the continuous casting and rolling process according to the embodiment, Process G1 corresponds to Process a3, Process G2 corresponds to Process a11, Process G3 corresponds to Process a13, and Process H1 corresponds to Process c12, on the basis of a configuration of each process. In comparison of processes, in the high performance copper rod or wire according to the embodiment, tensile strength is high, the number of repetitive bending times is high, and elongation of a rod or wire is high, as compared with those of a rod or wire subjected to the solution-precipitation process.

In the above-described actual equipment test, a rod or wire could be obtained in which a hot processing rate of a continuous casting and rolling process is 75% or higher and lower than 95%, a non-recrystallization ratio of a metal structure after hot rolling is 1 to 60%, and a grain size of a recrystallized part is 4 to 40 μm (see Test No. 91 to 95 in Tables 13 and 14, etc.).

A rod or wire could be obtained in which a hot processing rate of a continuous casting and rolling process is 95% or higher, a non-recrystallization ratio of a metal structure after hot rolling is 10 to 80%, and a grain size of a recrystallized part is 2.5 to 25 μm (see Test No. 61 to 65 in Tables 11 and 12, etc.).

A rod or wire could be obtained in which a cold drawing/wire drawing process is performed after a continuous casting and rolling process, a heat treatment at 350 to 620° C. for 0.5 to 16 hours is performed before, after, or during the cold drawing/wire drawing process, substantially circular or substantially oval fine precipitates are uniformly dispersed, an average grain diameter of the precipitates is 2 to 20 nm, or 90% or more of all precipitates have a size of 30 nm or less (see Test No. 74 to 76 in Tables 11 and 12, etc.).

A rod or wire could be obtained in which a heat treatment at 200 to 700° C. for 0.001 seconds to 180 minutes is performed during or after a cold wire drawing process, and bending resistance is excellent (see Test No. 121 to 125 in Tables 16 and 17, etc.).

A rod or wire could be obtained in which an outer diameter is 3 mm or less as a wire, conductivity is 45 (% IACS) or higher, a wire performance index I1 is 4300 or more, and bending resistance is excellent (see Test No. 74 to 76 in Tables 11 and 12, etc.).

A rod or wire could be obtained in which conductivity is 45 (% IACS) or higher, elongation is 5% or higher, and a rod performance index I2 is 4200 or more (see Test No. 107 to 111 in Tables 13 and 14, etc.).

A rod or wire could be obtained in which tensile strength at 400° C. is 180 ($N/mm^2$) or higher as heat resistance strength (see Test No. 107 to 111 in Tables 13 and 14, etc.).

A rod or wire could be obtained in which heating at 700° C. for 30 seconds is performed, Vickers hardness (HV) after water cooling is 90 or higher, conductivity is 45% or higher, an average grain diameter of precipitates in a metal structure after heating is 2 to 20 nm, or 90% or more of all precipitates have a size of 30 nm or less, or a recrystallization ratio in a metal structure is 45% or lower.

Particularly, in case of precipitation hardening copper alloy, when a heating process at a high temperature of 700° C. and a cooling process are performed, conductivity is decreased by 20% IACS (absolute value) or decreased by 30% or higher (relative value) of the original conductivity. However, in the invention alloy, the decrease in conductivity is as high as 10% IACS or lower (absolute value), or by 15% or lower (relative value) as compared with the original conductivity, and high conductivity is kept. In addition, all the none of the comparative alloys satisfy Vickers hardness, a recrystallization ratio in a metal structure, and a size of precipitates.

The followings can be said from the results of the above-described actual equipment tests. In C1100, there are crystallized grains of $Cu_2O$, but the grains do not contribute to strength since the grain diameters are as large as 2 μm, and an influence on the metal structure is small. For this reason, high-temperature strength is low, and a grain diameter is large. Accordingly, it cannot be said that repetitive bending workability is satisfactory (see Test No. 130 in Tables 16 and 17, etc.).

In Alloy No. 11 and 12 of the comparative alloy, the amount of Co or P is small, and balance in the relational formulas of Co, P, and the like is not satisfactory. Grain diameters of the precipitates of Co, P, and the like are large, and the amount thereof is small. For this reason, a non-recrystallization ratio of the materials is low, a recrystallized grain diameter of a recrystallized part is large, and thus strength is low. In addition, conductivity is low since Co, P, and the like are not satisfactorily balanced. In addition, a wire performance index I1 is not satisfactory. This is clear, when comparing with Alloy No. 1 in which one of Co and P has the same amount (see Test No. 74, 77, and 78 in Tables 11 and 12, and Test No. 121, 126, and 127 in Tables 16 and 17, etc.).

In Test No. 104, the content of Sn is small. For this reason, heat resistance of matrix is low. Accordingly, recrystallization occurs on the low-temperature side, a non-recrystallization ratio is low, and sizes of precipitated grains are large. For this reason, it is considered that strength becomes low, and a wire performance index I1 or a rod performance index I2 is low.

In the invention alloy, Co, P, and the like are finely precipitated. Accordingly, movement of atoms is obstructed, heat resistance of matrix is also improved by Sn, there is a little structural variation even at a high temperature of 400° C., and high strength is obtained. In Alloy No. 11 and 12 of the comparative alloy, a precipitation amount is small. Accordingly, heat resistance is insufficient, and high-temperature strength at 400° C. is low (see Test No. 107 to 112, 114 to 116, and 119 in Tables 13 and 14, etc.).

In the invention alloy, deformability in all the embodied materials is excellent, and thus cracks did not occur. In addition, deformation resistance is low, and thus any trouble like rolling machine stoppage did not occur.

The invention alloy contains a predetermined amount of Co, P, and the like. Accordingly, a predetermined amount of non-recrystallized parts occurs, and a recrystallized grain diameter size of the recrystallized parts is small. In solution according to the present process, Co, P, and the like in a solid solution state are finely precipitated by a precipitation process thereafter, and it is possible to obtain high strength. Most of Co, P, and the like are precipitated, and thus it is possible to obtain high conductivity. In addition, the precipitates are small, and a repetitive bending property is excellent.

Even in rods, recrystallized grains are fine, and precipitates are small. Accordingly, elongation, strength, and conductivity are high, and a rod performance index I2 is also high (see Test No. 107 to 116 in Tables 13 and 14, etc.)

When the processing capacity of equipment is low, a process is performed in a solid solution state or a light plasticity process state, and then a heat treatment TH1 is performed, thereby obtaining high conductivity and strength (see Test No. 91 to 106 in Tables 13 and 14, and Test No. 201 to 215 in Tables 22 and 23, etc.). Even when heated at a high temperature of 700° C., most of precipitates do not disappear and are not subjected to solid solution. Accordingly, conductivity is high. In addition, the precipitates are fine, the recrystallization of the precipitates may be disturbed, and thus hardness is high. When heating at about 700° C. is performed by brazing or the like while in use, it is possible to obtain high hardness and high conductivity although the precipitation heat treatments TH1 and TH2 are not performed in the course of the producing process.

In the rod or wire according to the embodiment, tensile strength is high and hardness is high. Accordingly, it is considered that the wear resistance, which depends no tensile strength and hardness, is also excellent for the rod or wire.

In addition, the invention is not limited to the configurations of the above-described various embodiments, and may be variously modified within the scope of the invention. For example, a peeling process or a washing process may be performed at arbitrary part in the course of the process.

INDUSTRIAL APPLICABILITY

As described above, the high performance copper rod or wire according to the invention has high strength, high conductivity, and excellent bending resistance, and thus is most suitable for wire harnesses, cables for robots, cables for airplanes, wiring materials of electronic devices, and the like. In addition, high-temperature strength, wear resistance, and durability are excellent, and thus the rod or wire is most suitable for connector wires (bus bar), wire cut (electric discharging) wires, trolley lines, welding tips, spot welding tips, stud welding base points, electric discharging electrode materials, bus bars, rotor bars of motors, and electric components (fixers, fasteners, electric wiring tools, electrodes, power relays, relays, connection terminals, etc.). In addition, workability for forging, pressing, and the like is also excellent, and thus the rod or wire is most suitable for hot forgings, cold forgings, rolling threads, bolts, nuts, piping components, and the like.

The present application claims the priority of Japanese Patent Application 2008-044353, the entire contents of which is incorporated herein by reference.

The invention claimed is:

1. A high strength and high conductivity copper rod or wire produced by a process including a continuous casting and rolling process, the copper rod or wire comprising:

Co of 0.12 to 0.32 mass %;

P of 0.042 to 0.095 mass %;

Sn of 0.005 to 0.70 mass %;

O of 0.00005 to 0.0050 mass %; and at least one element selected from the group consisting of Ni of 0.01 to 0.15 mass % and Fe of 0.005 to 0.07 mass %, wherein a relationship of $3.0 \leq ([Co]+0.85\times[Ni]+0.75\times[Fe]-0.007)/([P]-0.008) \leq 6.2$ and a relationship of $0.015 \leq 1.5\times[Ni]+3\times[Fe] \leq [Co]$ are satisfied among a content [Co] mass % of Co, a content [Ni] mass % of Ni, a content [Fe] mass % of Fe, and a content [P] mass % of P, and the remainder includes Cu and inevitable impurities, and wherein when a total hot processing rate in the continuous casting and rolling process is 75% or higher and lower than 95%, a non-recrystallization ratio of a metal structure at completion of the continuous casting and rolling process is 1 to 60% and an average grain size of a recrystallized part is 4 to 40 μm, and when the hot processing rate is 95% or higher, a non-recrystallization ratio of a metal structure at completion of the continuous casting and rolling process is 10 to 80% and an average grain size of a recrystallized part is 2.5 to 25 μm, and wherein a rolling start temperature in the continuous casting and rolling process is 860 to 1000° C., a total hot processing rate is 75% or higher, and an average cooling rate in a temperature range of 850 to 400° C. is 10° C./second or higher, and wherein the non-crystallization ratio in a vicinity of an outer peripheral portion of the copper rod or wire is effectively higher than the non-recrystallization ratio in a center portion of the copper rod or wire, effective to increase the tensile strength in the outer peripheral portion, the outer peripheral portion corresponding to a portion of 6/7R from the center portion of the copper rod or wire.

2. The high strength and high conductivity copper rod or wire according to claim 1, further comprising at least one additional element selected from the group consisting of Zn of 0.002 to 0.5 mass %, Mg of 0.002 to 0.25 mass %, Ag of 0.002 to 0.25 mass %, and Zr of 0.001 to 0.1 mass %.

3. The high strength and high conductivity copper rod or wire according to claim 1, wherein a cold drawing/wire drawing process is performed after the continuous casting and rolling process, wherein a heat treatment at 350 to 620° C. for 0.5 to 16 hours is performed before, after, or during the cold drawing/wire drawing process, wherein substantially circular or substantially oval fine precipitates are uniformly dispersed in the copper rod or wire, and wherein an average grain diameter of the precipitates is 2 to 20 nm, or 90% or more of all precipitates have a size of 30 nm or less.

4. The high strength and high conductivity copper rod or wire according to claim 2, wherein a cold drawing/wire drawing process is performed after the continuous casting and rolling process, wherein a heat treatment at 350 to 620° C. for 0.5 to 16 hours is performed before, after, or during the cold drawing/wire drawing process, wherein substantially circular or substantially oval fine precipitates are uniformly dispersed in the copper rod or wire, and wherein an average grain diameter of the precipitates is 2 to 20 nm, or 90% or more of all precipitates have a size of 30 nm or less.

5. The high strength and high conductivity copper rod or wire according to claim 1, wherein a heat treatment at 200 to 700° C. for 0.001 seconds to 180 minutes is performed during or after the cold wire drawing process, and bending resistance is excellent.

6. The high strength and high conductivity copper rod or wire according to claim 1, wherein the wire has an outer diameter of 3 mm or less, and bending resistance is excellent.

7. The high strength and high conductivity copper rod or wire according to claim 1, wherein the wire has an outer diameter of 3 mm or less, conductivity is 45 (% IACS) or higher, a value of $R^{1/2}\times S$ is 4300 or more, where R (% IACS) is conductivity and S ($N/mm^2$) is tensile strength, and bending resistance is excellent.

8. The high strength and high conductivity copper rod or wire according to claim 2, wherein the wire has an outer diameter of 3 mm or less, conductivity is 45 (% IACS) or higher, a value of $R^{1/2} \times S$ is 4300 or more, where R (% IACS) is conductivity and S ($N/mm^2$) is tensile strength, and bending resistance is excellent.

9. The high strength and high conductivity copper rod or wire according to claim 1, wherein the copper rod or wire forms a wire harness.

10. The high strength and high conductivity copper rod or wire according to claim 2, wherein the copper rod or wire forms a wire harness.

11. The high strength and high conductivity copper rod or wire according to claim 1, wherein conductivity is 45 (% IACS) or higher, elongation is 5% or higher, and a value of $(R^{1/2} \times S \times (100+L)/100)$ is 4200 or more, where R (% IACS) is conductivity, S ($N/mm^2$) is tensile strength, and L (%) is elongation.

12. The high strength and high conductivity copper rod or wire according to claim 2, wherein conductivity is 45 (% IACS) or higher, elongation is 5% or higher, and a value of $(R^{1/2} \times S \times (100+L)/100)$ is 4200 or more, where R (% IACS) is conductivity, S ($N/mm^2$) is tensile strength, and L (%) is elongation.

13. The high strength and high conductivity copper rod or wire according to claim 1, wherein the copper rod or wire is used for cold forging or pressing.

14. The high strength and high conductivity copper rod or wire according to claim 2, wherein the copper rod or wire is used for cold forging or pressing.

15. The high strength and high conductivity copper rod or wire according to claim 1, wherein Vickers hardness (HV) after heating at 700° C. for 30 seconds is 90 or higher, conductivity is 45 (% IACS) or higher, and an average grain diameter of precipitates in a metal structure after the heating is 2 to 20 nm, 90% or more of all precipitates have a size of 30 nm or less, or a recrystallization ratio of the metal structure is 45% or lower.

16. The high strength and high conductivity copper rod or wire according to claim 2, wherein Vickers hardness (HV) after heating at 700° C. for 30 seconds is 90 or higher, conductivity is 45 (% IACS) or higher, and an average grain diameter of precipitates in a metal structure after the heating is 2 to 20 nm, 90% or more of all precipitates have a size of 30 nm or less, or a recrystallization ratio of the metal structure is 45% or lower.

* * * * *